US008171911B2

(12) United States Patent
Oledzki

(10) Patent No.: US 8,171,911 B2
(45) Date of Patent: May 8, 2012

(54) INTERNAL COMBUSTION TWO STROKE ROTARY ENGINE SYSTEM

(76) Inventor: Wieslaw Julian Oledzki, Bialystok (PL)

( * ) Notice: Subject to any disclaimer, the term of this patent is extended or adjusted under 35 U.S.C. 154(b) by 753 days.

(21) Appl. No.: 12/218,959

(22) Filed: Jul. 21, 2008

(65) Prior Publication Data

US 2010/0012077 A1 Jan. 21, 2010

(51) Int. Cl.
*F02B 53/04* (2006.01)
*F02B 53/00* (2006.01)

(52) U.S. Cl. ..... 123/223; 123/242; 123/212; 123/214; 123/241; 123/243; 123/43 B

(58) Field of Classification Search ..... 123/242, 123/212, 214, 223, 241, 243, 43 B; 418/36, 418/37

See application file for complete search history.

(56) References Cited

U.S. PATENT DOCUMENTS

| | | | | | |
|---|---|---|---|---|---|
| 3,719,438 | A * | 3/1973 | Howard | 418/36 |
| 3,955,541 | A * | 5/1976 | Seybold | 418/37 |
| 3,981,638 | A * | 9/1976 | Hutterer | 418/36 |
| 4,257,752 | A * | 3/1981 | Fogarty | 418/37 |
| 4,434,751 | A * | 3/1984 | Pavincic | 123/43 B |
| 4,901,694 | A * | 2/1990 | Sakita | 418/36 |
| 2010/0024765 | A1 * | 2/2010 | Eckhardt et al. | 123/234 |

* cited by examiner

*Primary Examiner* — Mary A Davis

(57) ABSTRACT

The invention provides the proper form for the rotary positive displacement internal combustion engine. The construction of the engines according to the invention is based on a specific form of four bar mechanism and features unique simplicity (only three moving parts, no valves or camshafts, no gears to transfer piston movement to rotary movement), compactness and strength that make the engines according to the invention similar in these and some other aspects (e.g. power density) to gas turbines.

8 Claims, 48 Drawing Sheets

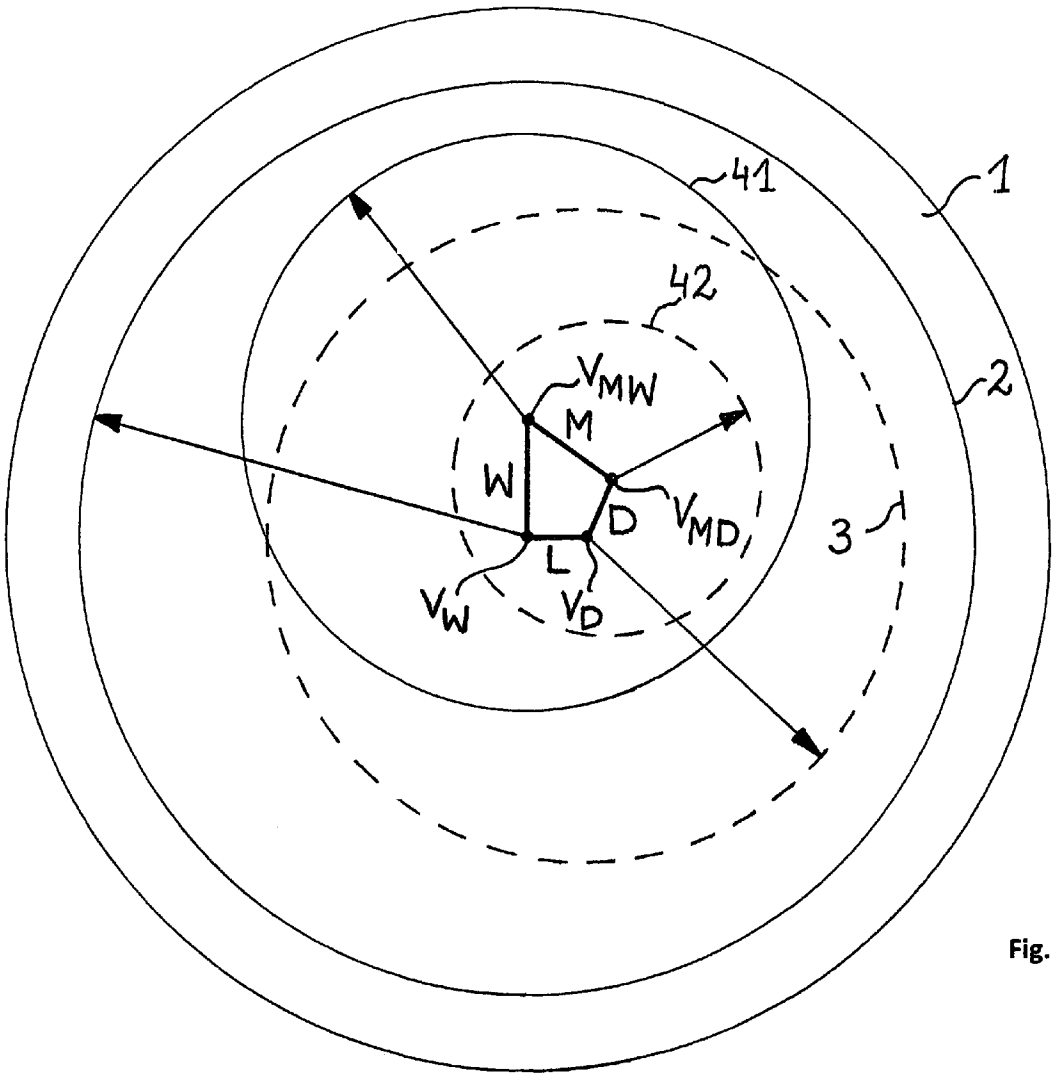
Fig. 9a1

INTERNAL COMBUSTION TWO STROKE ROTARY ENGINE SYSTEM

TECHNICAL FIELD OF THE INVENTION

The invention relates to heat engines and more specifically to positive displacement internal combustion engines, and is particularly concerned with rotary engines i.e. engines, in which piston executes rotary/oscillating motion. The invention provides the optimal, "canonical" form for the two stroke rotary engine of unique strength and compactness.

STATE OF THE ART AND BACKGROUND OF THE INVENTION

Existing successful heat engines are steam turbines, gas turbines and positive displacement engines (reciprocating piston and rotary Wankel) utilizing various thermodynamic cycles (Diesel (or rather Sabathe), Otto and Stirling cycle). These engines, although now having been developed for more than century (almost 2 centuries in the case of Stirling), still stop short from fulfilling the requirements imposed on prime movers by modern economy. Thus steam turbines require huge steam boilers and steam condensers and are troublesome to exploit, therefore their applications are restricted to power plants and propulsion of ships and some other heavy machinery. Gas turbines, thermal efficiency of which can achieve even 65% in large units destined for power generation and industrial applications (e.g. in most recent large turbines built by GE, which in fact are compound heat machines with large heat exchanger), usually, particularly in small units, display much poorer figure than positive displacement engines, are more complicated technologically and more expensive, and therefore are unlikely to earn as dominant position as Diesels enjoy today due to these and other well-known inherent drawbacks and limitations. Thus positive displacement engines still have important advantages over turbines that render them irreplaceable for most applications.

Most common positive displacement engine in use (and in fact most common heat engine), Diesel engine, achieves maximum overall efficiency of slightly beyond 50% (large stationary or marine units, which again are compound heat machines comprising Diesel engine, turbocharger, supercharging air cooler and auxiliary power turbine), and average Diesel efficiency is merely ~40%, a poor figure in comparison with 70-75% originally assumed by its inventor in late $19^{th}$ century. Thermal efficiency of Diesel cycle rises with the compression ratio, but this method for improving overall efficiency of real Diesel engines is obstructed by friction loses rapidly rising with loads of engine's mechanism. Moreover, conventional connecting rod—crank mechanism's strength becomes a concern in highly loaded Diesel engines.

Another well-known positive displacement heat engine is the (external combustion) Stirling engine. This engine is closest to the ideal Carnot engine in terms of thermal efficiency, and another important advantage over known internal combustion engines is its capability to utilize various sources of thermal energy. However, Stirling engine is expensive to manufacture and troublesome to maintain, and this renders it considerably inferior to internal combustion engine in most applications, and prevents from earning wide acceptance.

There are many non-conventional designs of heat engines (most of them focusing on transforming gas force into driving torque of rotating shaft), e.g. rotary engines like Wankel, recently patented quasi turbine (see U.S. Pat. Nos. 6,164,263 and 6,899,075), spherical engines (see U.S. Pat. Nos. 6,325,038, and 6,941,900, and Russian patent 2,227,211) and oscillating pivotal engine (see www.PivotalEngine.com). However, so far none of those non-conventional engines, with Wankel-type engine being the only exception of economically (but certainly not conceptually) marginal importance, was successful, and probably none of them has any chance to even go beyond the stage of prototyping. Technically, this is due to the fact that the answer to the principal question any new engine is obliged to answer: "Does the new engine do its work better than conventional one?" is decidedly negative for all those non-conventional designs, including Wankel's. Even the answer to the more general question: "Does the new engine do its work in any aspect better than conventional one?" is negative for almost all non-conventional engines. (In the case of the Wankel engine, the answer to this more general question is positive, but superiority of Wankel over conventional engines in certain aspects (great power/weight and power/volume ratios, kinetic simplicity and smoothness of operation) is overshadowed by its inherent drawbacks (weak structure, inability to cope with large outputs, inferior efficiency, weakness of sealing, inherent inability to incorporate high compression ratios)). Conceptually, this is mainly due to the fact that those new engine designs (e.g. quasi turbine) focus on certain isolated aspects of heat engine while ignoring some other aspects (e.g. sealing, mechanical strength and reliability).

For example, recently patented positive displacement rotary engine, quasi-turbine, is complex both kinetically and structurally, its moving elements of complicated shapes are likely to be subjected to excessive thermal stresses and renders the engine weak structurally and more difficult to seal than Wankel engine; thus the engine is unlikely to do well the job of heat engine (it would be better as pump or compressor). Some other rotary engines (e.g. satellite engine, see publication WO9618024) use toothed wheels to transfer the pistons movement to rotary motion of engine's shaft. This not only makes these engines complex but also unreliable, as engine's elements that meet along a line are not well suited to bear shock loads met with in internal combustion engines.

Fuel cell is a very promising source of power for many applications, but it seems improbable it will become appropriate for applications where high power density is essential in any foreseeable future.

Thus there is a need for highly efficient universal source of mechanical power, and highly efficient and clean thermodynamic processes for producing hot high pressure gases, like detonation, compression ignited combustion of homogeneous charge and very high-pressure Sabathe cycle, render positive displacement internal combustion engines a very interesting proposition, provided that efficient way for converting thermal energy into useful mechanical power is incorporated. It is to be stressed that lack of such effective method for converting thermal energy into driving torque is an important obstacle to develop a practical Homogeneous Charge Compression Ignition (HCCI) and Positive Displacement Detonation (PDD) engine. The reason is that maximum gas forces themselves, as well as gradients of gas forces (understood as function of time), met with in HCCI and PDD engines (at least those utilizing stoichiometric mixture, which is the most efficient thermodynamically, and also most efficient from the point of view of power/weight and power/volume parameters) are much higher than in conventional IC engines, and conventional mechanisms are unable to cope with such extreme loads. This is one of the reasons, for which the planned "HCCI engines" are to utilize the more efficient HCCI mode of operation only while producing power at a moderate rate (and working on loan mixtures), converting into ordinary Diesel mode of operation when the power demand rises (the other reason is that IC engine working on loan mixture produces less pollutant nitrogen oxides).

It is to be stressed that none of the non-conventional engine designs in United States Patent and Trademark Office (USPTO) and European Patent Office (EPO) patent data bases offers satisfactory mechanical structure of the ICE suitable for coping with extreme loads while assuring engine's compactness and good sealing. Moreover, none of the known positive-displacement internal combustion engines approaches highly desirable structural simplicity of gas turbines.

SUMMARY OF THE INVENTION

Thus the principal objective of the present invention is to provide a high power density positive-displacement internal combustion engine of simple and extraordinarily robust structure, capable to withstand extremely high loads and thus to utilize highly efficient ultra-high pressure Diesel cycle or HCCI and PDD modes of operation without increasing specific loads of engine's elements beyond limits that are standard for ordinary piston engines and without decreasing mechanical efficiency of the engine.

Another objective of the invention is to provide a structure for a valve-less two stroke engine that guarantees good constraint for engine's piston and piston sealing elements.

Yet another objective of the invention is to provide a compact structure for the internal combustion engine with no hot load bearing sliding elements.

Another objective of the invention is to substantially increase thermal efficiency of engines by improving combustion and increasing such parameters as maximum combustion pressure without increasing specific loads of engine's parts.

Yet another objective of the invention is to provide a structure for positive displacement engines that offers substantial improvement of such important engine parameters as swept volume/total volume, power/total volume and power/weight ratio, without increasing specific loads and thus without sacrificing engine's strength and reliability.

Another objective of the invention is to provide a structure for the positive displacement engines that offer a large variety of engine's configurations (e.g. considerable variety of scavenging systems, ignition systems etc.) capable of being adjusted to various specific requirements.

Yet another objective of the invention is to provide rotary engines that have sealing almost as simple, tight and reliable as conventional ones and much simpler, tighter and much more reliable than conventional (Wankel) rotary engines.

More specifically, the objective of the invention is to provide a proper structure of rotary positive displacement engine having some specific qualities of gas turbines, namely high power density, structural simplicity combined with good driving torque smoothness, having scavenging system that makes the gas flow almost as smooth as (and similar to) that to be found in gas turbines and assuring engine's good balance thus enabling it to rotate at high speeds.

It is clear that at the core of such an engine should be a mechanism, desirably the strongest and simplest mechanism in existence, that would provide the optimal method for converting gas pressure directly into rotary movement of a solid body.

In order to find such a mechanism some initial conditions should be imposed upon it. Thus gears (toothed wheels) or other mechanisms comprising elements meeting along a line, mechanisms complex from kinetic point of view (for example comprising elements executing complex motion) loaded with extreme gas forces and rendering the engine difficult to seal are unacceptable.

Thus the general idea behind the invention is to take a solid body, as regular as possible, cut out the combustion chamber, and cut the remaining portion of the body along some surfaces (preferably planes) into a minimum number of elements of a mechanism capable of converting gas pressure directly into driving torque (that is to say executing pure rotary movement, or at least "close" to it). This would provide the simplest, strongest, most robust and compact (no vacuum inside of the engine) structure of internal combustion engine, capable of bearing extreme mechanical loads produced by high-efficiency thermodynamic processes without increasing specific loads and friction losses, and substantially improving weight/power ratio at the same time, thus displaying substantial overall efficiency improvement over existing heat engines.

The construction of the strongest mechanisms in existence presented below provides strong indications that the proper form of the engine capable to satisfy all the above-formulated requirements is the rotary/oscillating ("cat and mouse") engine. Thus another, more specific objective of the present invention is to provide the proper form of the rotary/oscillating engine.

In the next paragraphs I present six preferred embodiments of rotary engines utilizing various variants of the flat mechanism constructed below.

BRIEF DESCRIPTION OF THE DRAWINGS

FIG. 9*a*1 explains the relationship between the kinetic scheme (being the ordinary four-bar linkage L-W-M-D) shown in FIG. 9*a* of the rotary engine according to the present invention (producing two power impulses per revolution of the main rotor), and the arrangement of four links 1, 2, 3, 4 (see FIGS. 10-48) of the engine mechanism converting thermal energy of combustion gases to rotary motion, wherein links 2, 3 and 4 are made in the form of rotors.

FIG. 10 is a general view of the engine, FIG. 11 is an expanded view of the engine, FIG. 12 shows the assembly of the engine rotors, FIG. 13 is a cut-away expanded view, FIG. 14 is another view of the assembly of engine's rotors, FIG. 15 is a cut-away view of the assembled engine, FIGS. 16 and 17 are a longitudinal and transverse cross sections respectively.

FIGS. 18 and 19 are two expanded views of the engine, FIG. 20 is a cut-away view, FIG. 21 respectively 22 is a longitudinal and transverse cross section, and FIGS. 23 and 24 are two views of the assembly of engine's rotors.

FIG. 25 is a general view of the engine, FIGS. 26 and 27 are two expanded views of the engine, FIG. 28 is a cut-away view, FIG. 29 provides a longitudinal cross-section, FIG. 30 depicts the assembly of engine's rotors and the central part of engine's body, and FIG. 31 is a transverse cross-section. Moreover, the correlation between engine's mechanism and its components (rotors) and links L, W, D, M of engine's kinetic scheme shown in FIG. 9*a* is shown in FIGS. 27, 30 and FIG. 9*a*1.

FIG. 32 is an expanded view of the engine, FIG. 33 is another expanded view of the engine, FIG. 34 is a transverse cross-section of the engine, FIG. 35 is another transverse cross-section of the engine, FIG. 36 is a perspective cut-away view of the engine, and FIG. 37 is yet another perspective cut away view of the engine.

FIG. 38 is a general view of the engine, FIGS. 39, 40, 41 correspond to FIGS. 32, 33 and are three exploded views of the engine with alternatively shaped rotors.

FIG. 42 is an expanded view of the engine, FIGS. 43, 44 are two cut-away views, FIG. 45 is a longitudinal cross-section and FIG. 46 is a transverse cross-section through the combustion chambers, FIG. 47 provides some details of the construction of the main rotor, and FIG. 48 provides details of the construction of the engine's intermediate rotor.

DETAILED DESCRIPTION OF THE PREFERRED EMBODIMENTS OF THE INVENTION AND THE MAIN CONSTRUCTION

Main Geometric Constructions

I start this section with a short description of my method for achieving the strongest mechanism in existence capable of being applied in positive displacement engines. In fact the construction of these mechanisms lies at the very heart of the present invention.

The construction will be carried out in several simple steps (see FIGS. 1-7).

Figure 1:
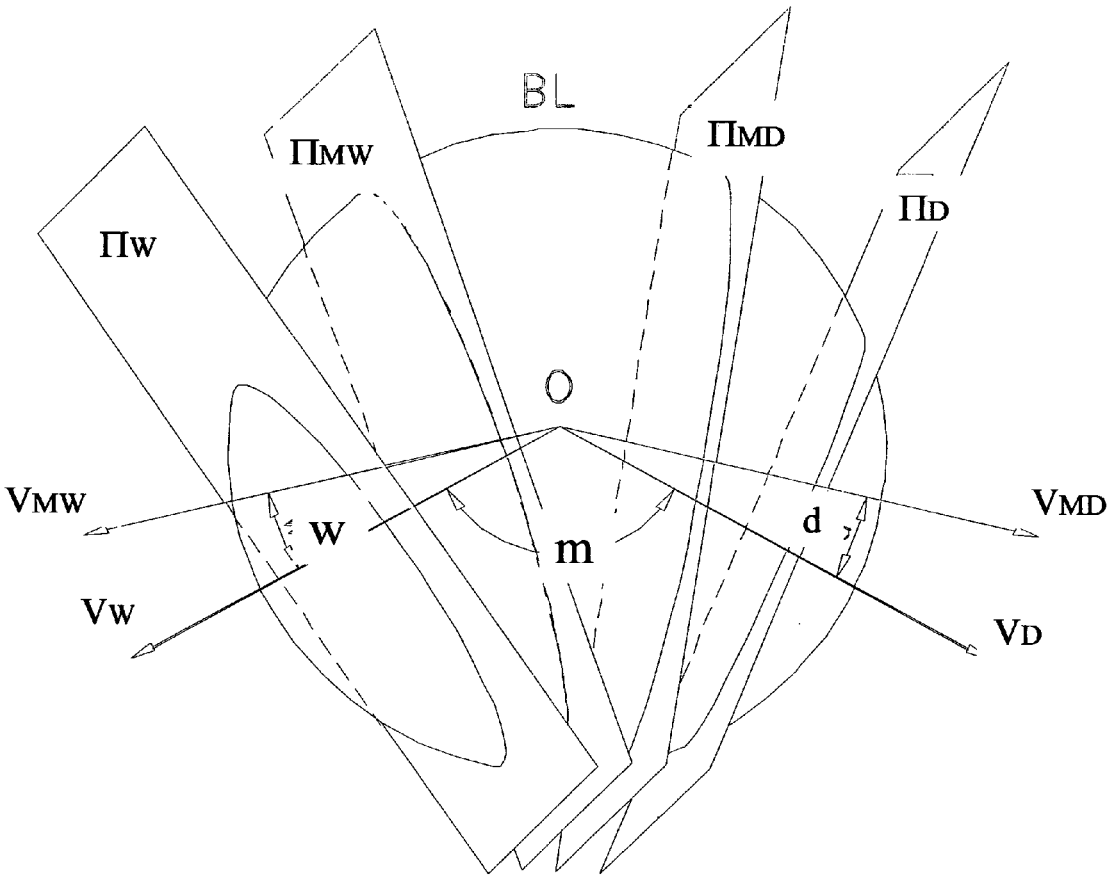
FIGS. 1-7 illustrate the construction of my mechanisms described in the next paragraph.

A. In the Euclidean 3-dimensional space choose a ball BL of radius R and center O and four vectors $\nu_w$, $\nu_d$, $\nu_{mw}$ and $\nu_{md}$ of length R and based at the point O (FIG. 1). Any two of these vectors should not be parallel.

B. Fix planes π(w), π(d), π(mw) and π(md) perpendicular to the vectors $\nu_w$, $\nu_d$, $\nu_{mw}$ and $\nu_{md}$ respectively so as each of these planes non-trivially intersects the ball BL (FIG. 1).

Figure 2:
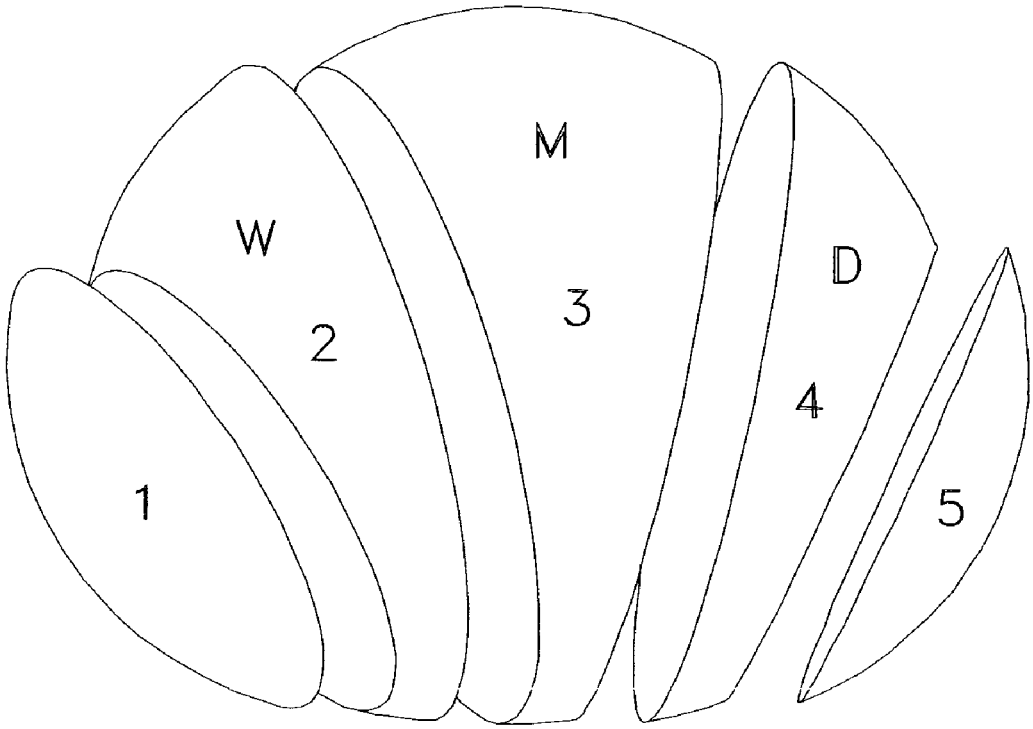

C. Cut the ball BL along the planes π(w), π(d), π(mw) and π(md) into five components, say 1,2,3,4,5 (FIG. 2). Reject two extreme components 1 and 5 and save three central elements 2,3,4. These elements are segments of the ball BL bounded respectively by pairs of the planes: (π(w),π(mw)), (π(mw),π(md)) and (π(d),π(md)), and are denoted by W, M, and D respectively (FIG. 2). W, M, and D are the "moving" links of the desired mechanism.

Figure 3:
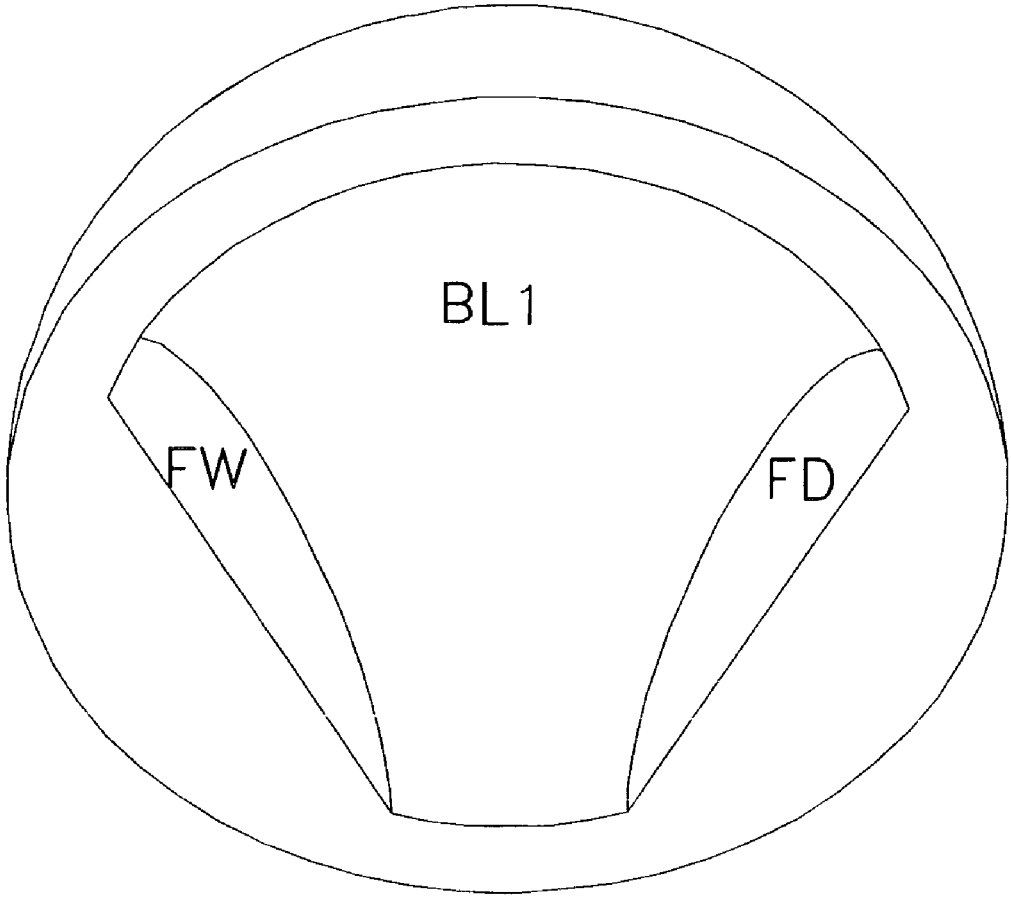

D. Take another element L with (substantially) spherical bore chamber BL1 of radius R and two flat surfaces FW and FD perpendicular to the vectors $\nu_w$, $\nu_d$ respectively; the distance from the center of the chamber BL1 to the flat surface FW (resp. FD) equals the distance from the center of the ball BL to the plane π(w) (resp. π(d)) (FIG. 3). The element L will be called the body of the mechanism.

Figure 4:
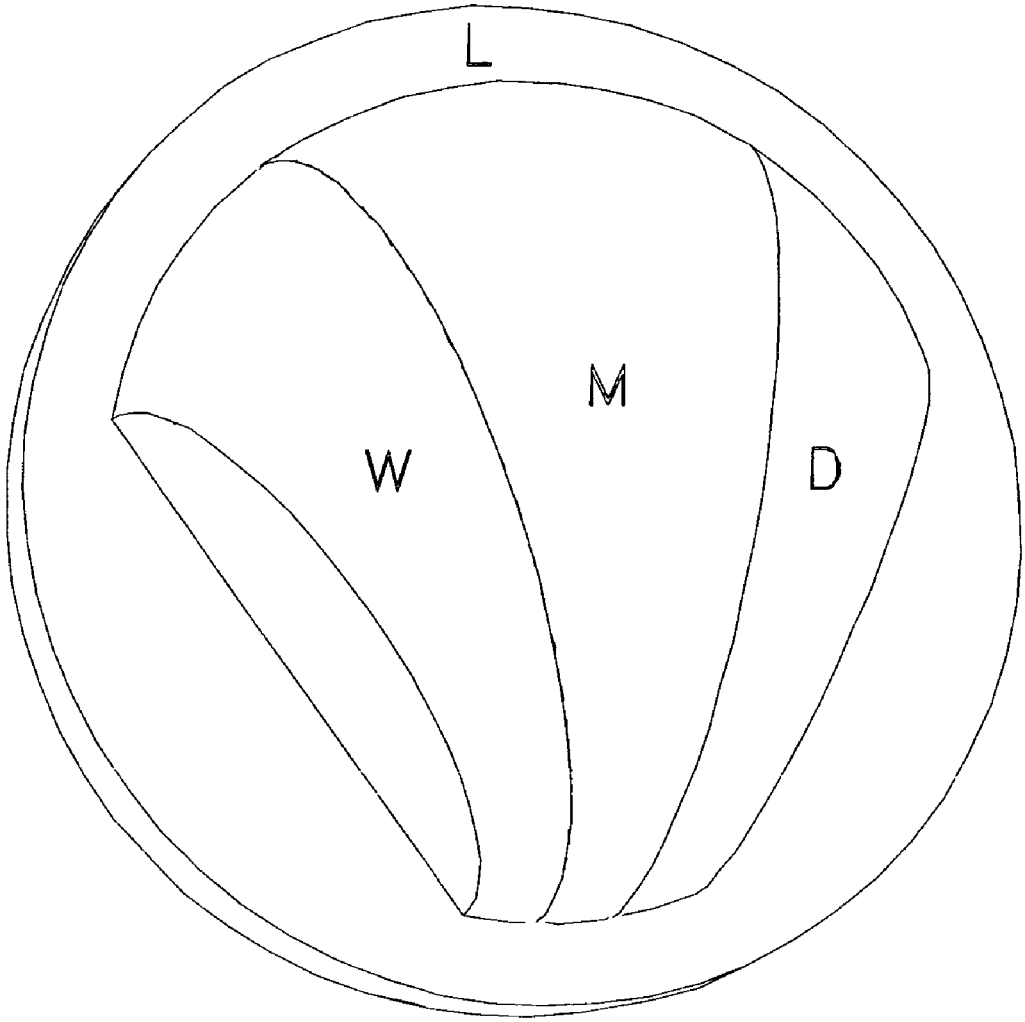

E. Insert the elements W, M, and D in the bore chamber BL1 of the element L as shown in FIG. 4 (clearly this can be done in only one way).

The resulting device is the desired (spatial) mechanism. It has five kinetic couples, namely (L,W), (W,M), (M,D), (D,L) and (M,L). The couples (L,W), (W,M), (M,D), (D,L) are higher rotational kinetic couples, while the couple (ML) is a lower ball joint-like kinetic couple.

Figure 5:
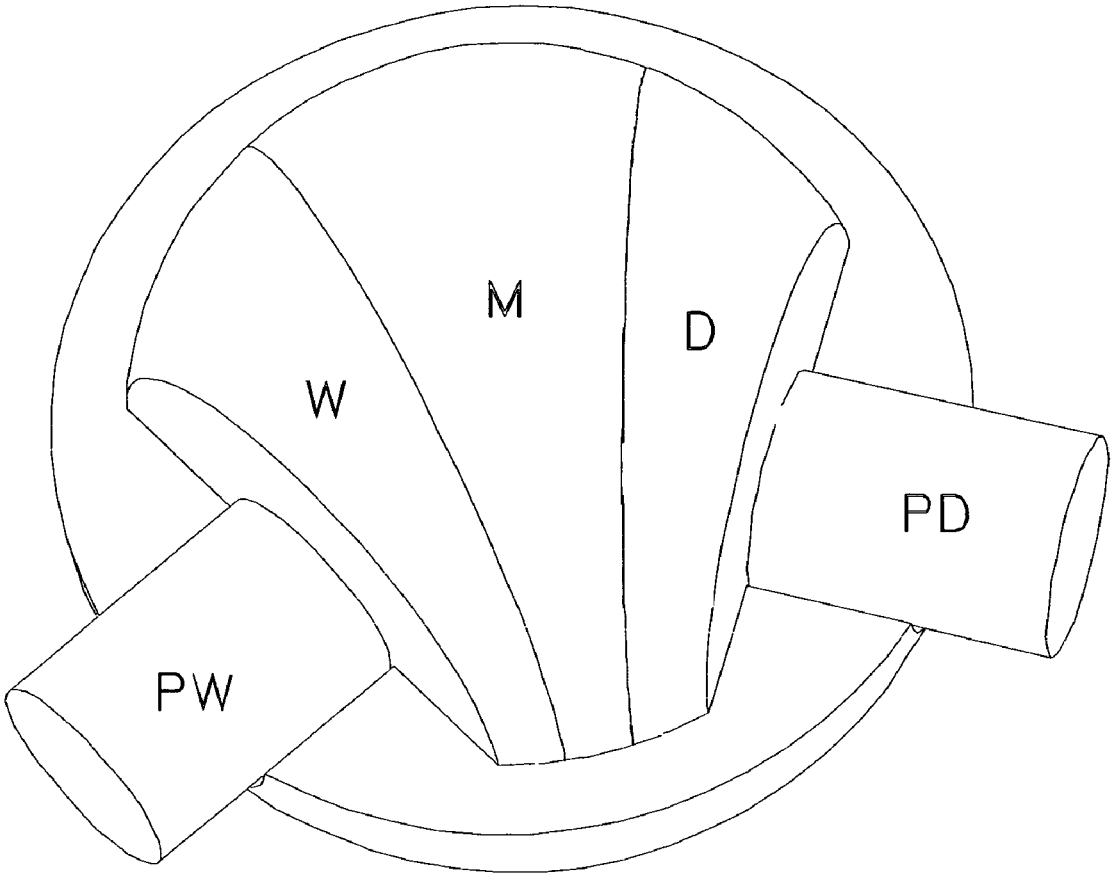

In order to enable receiving mechanical energy produced inside the mechanism body, we have to make "moving" elements of the mechanism accessible from the exterior of the body L. This is achieved by equipping said body L with one or two circular bore chambers that accommodate a pin attached to the element W or D or both (FIG. 5).

Figure 6:
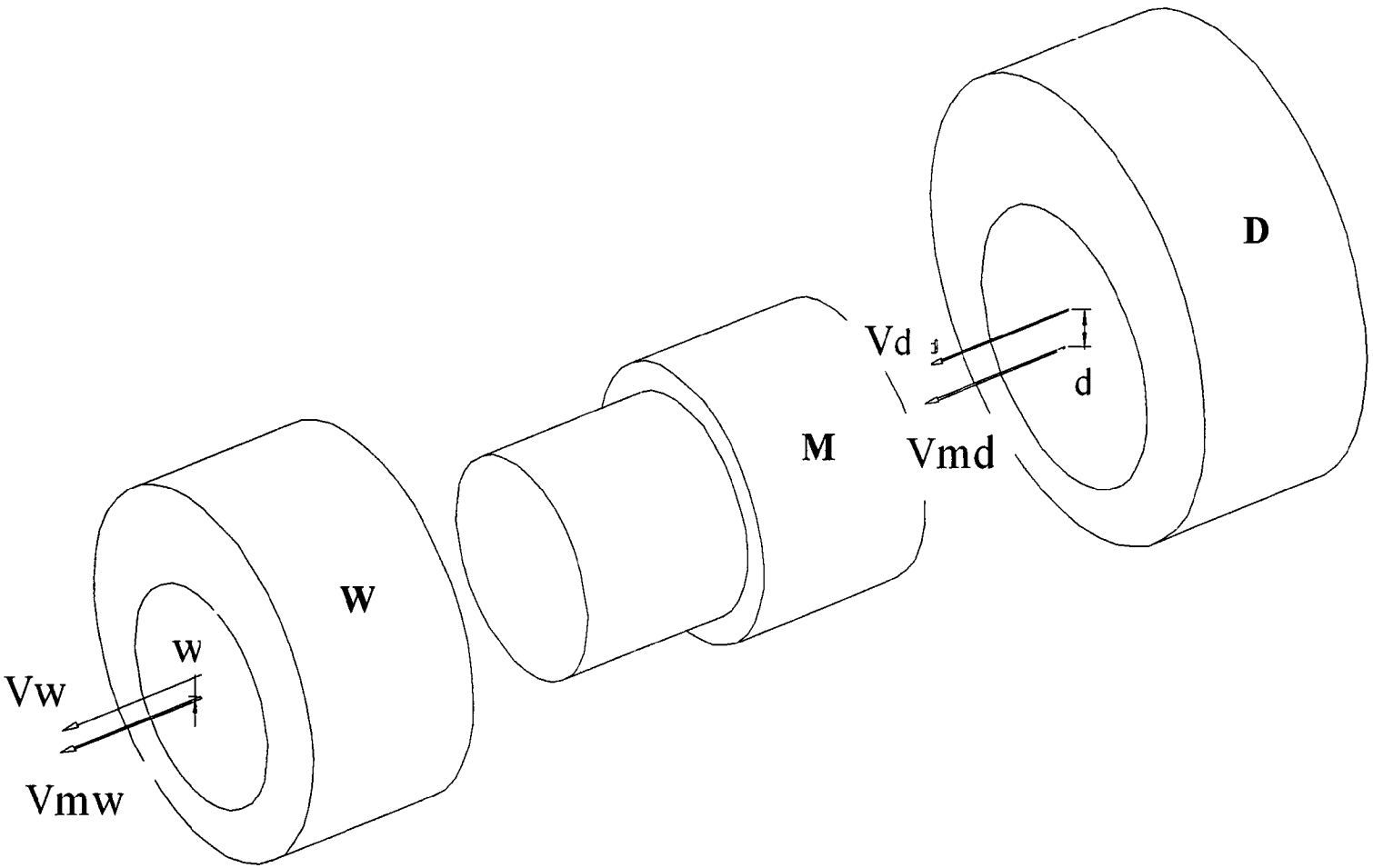
Figure 7:
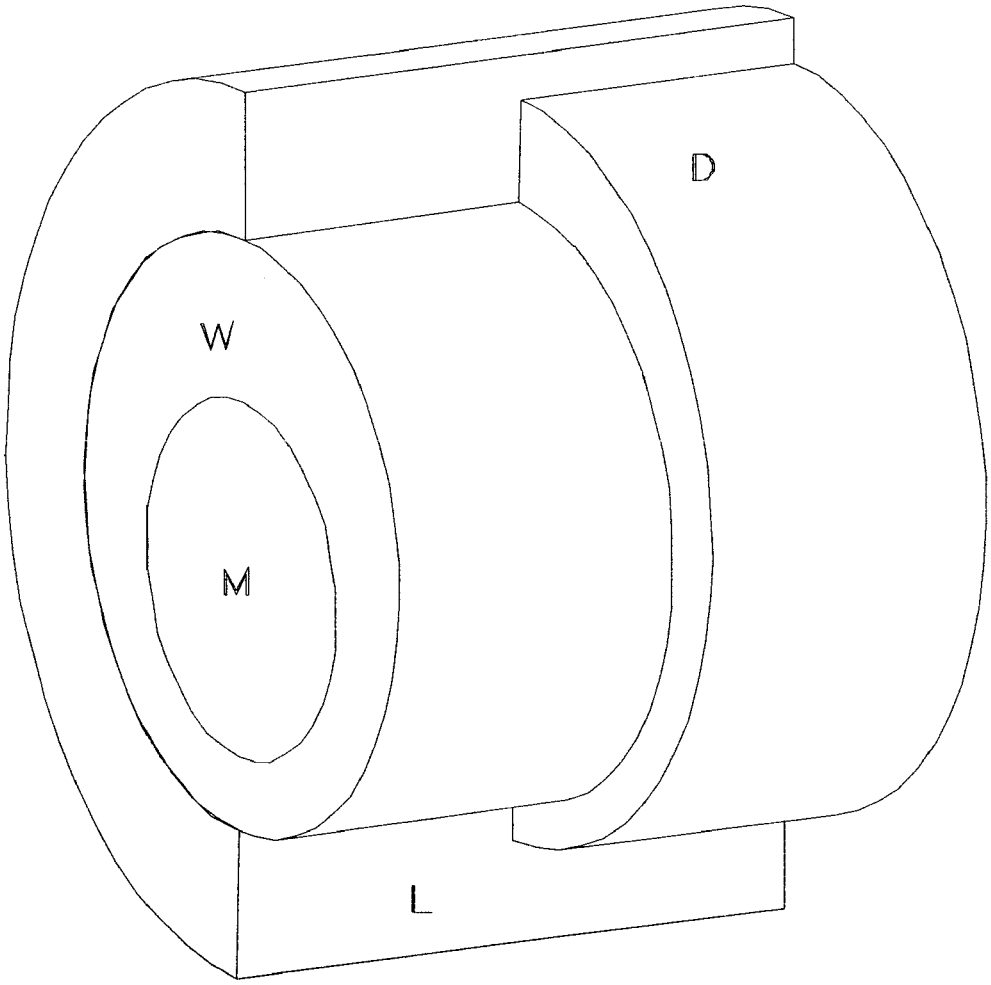

REMARK 1. In general this procedure provides spatial mechanisms, but in a limiting case it can give flat mechanisms, and in this case all the parts of the mechanism are obtained by cutting a cylinder rather than a ball into 4 pieces, each of them bearing circular symmetry. From the mathematical point of view, the flat mechanism alluded to above is a limiting case of the spatial mechanism obtained by placing the point O at infinity and letting the radius R tend to infinity. In this way we get a mechanism composed of three ordinary flat eccentrics W, M, D placed in the body L, which is composed of four higher (rotational) couples (L,W), (W,M), (M,D), (DL). In this case the vectors $\nu_w$, $\nu_d$, $\nu_{mw}$ and $\nu_{md}$ (directional vectors of the axes of rotation of the members of the kinetic couples) are all mutually parallel (FIGS. 6 and 7). The present invention utilizes only flat mechanisms.

REMARK 2. It is clear from this description and accompanying figures that this is the strongest mechanism in existence (which is not merely a kinetic pair such as the ball joint) as its 3 moving parts occupy the whole internal space of its body and all its components assume general form of the ball or segments of a ball. Therefore the mechanism is particularly well suited for heavy-duty applications, including high power density, extreme loads, detonation and HCCI engines. Another unusual feature of the presented 4-link spatial mechanism is that its four elements form five kinetic pairs, namely (L,W), (W,M), (M,D), (D,L) and (M,L). The presence of an extra kinetic pair (M,L) (which is a lower ball joint-like kinetic couple) contributes significantly to the mechanism strength and further decreases specific loads.

REMARK 3. It is clear that kinetics of the spatial mechanism is determined exclusively by the relative position of the vectors $\nu_w$, $\nu_d$, $\nu_{mw}$ and $\nu_{md}$ or, equivalently, by the angles between these vectors (this will be discussed below).

Similarly, kinetics of the "flat" mechanism is determined by the distances between the axes of rotation of the mechanism elements.

In order to determine kinetics of the spatial mechanism we join the end points of the vectors $\nu_w$, $\nu_d$, $\nu_{mw}$ and $\nu_{md}$ by geodesic arcs placed in the sphere BL to obtain the ordinary spherical geodesic tetragon (FIG. 1). This proves that from the kinetic point of view our mechanism is the ordinary spherical four-bar linkage.

Similarly, from the kinetic point of view, the "flat" mechanism is the usual flat four-bar linkage. This can be seen by suitably joining by straight segments the intersection points of the rotation axes of the elements W, M and D determined by the vectors $\nu_w$, $\nu_d$, $\nu_{mw}$ and $\nu_{md}$ with a plane perpendicular to these vectors.

Thus any kinetic pair of the presented mechanism is the rotary or spherical one, and the mechanism is capable of producing rotary movement of one of its elements from oscillating movement of another element and rotary movement of one of its elements from rotary-oscillating movement of some other elements. This feature is utilized in my engines presented in the next section.

REMARK 4. Specific loads within the mechanism (given external loads applied to the mechanism) depend on the relative position of the vectors $v_w$, $v_d$, $v_{mw}$ and $v_{md}$, as well as on the radius R and distances from the center O to the planes π(w), π(d), π(mw) and π(md). This problem will be briefly discussed in forthcoming paragraphs.

REMARK 5. It is worth noticing that the presented mechanism is not only simple structurally, but also easy to manufacture. All its moving elements have the same very simple structure thus can be manufactured using the same general-purpose machines like forging machine, lathe and milling machine, quite unlike the mechanism of the ordinary piston engine comprising technologically different and complicated elements (crankshaft) and requiring highly specialized equipment to manufacture.

Below I present a variety of rotary engines utilizing various variants of the flat mechanism constructed above. All the designs are based on the following three principles:

PRINCIPLE 1. Cut out the combustion chambers (or "pistons") in some elements of the mechanism presented above.

PRINCIPLE 2. Make the engine producing as many power strokes per revolution as possible. Make phasing of power strokes optimum.

PRINCIPLE 3. Make the engine as well balanced as possible.

1. Rotary "Flat" Positive-Displacement Turbine-Like Engine—6 Power Strokes Per Shaft Revolution (FIGS. 10-17)

In the next three subsections I present basic designs of my rotary "turbine-like" positive displacement engine, or to be more precise, three variants of the engine, namely engines producing 2, 4 and 6 power strokes per shaft revolution, and utilizing variants of the flat mechanism. Next I present some variations on the theme. The reason for presenting this variety of "turbine-like" rotary positive displacement engines is that it is not possible to optimize various parameters of the engine at the same time, and any of the engines presented below has some advantages over the other engines. In fact, maximizing the number of power strokes per shaft revolution obstructs optimizing the engine balance, while obtaining almost perfect engine?s balance prevents the engine from producing more than 2 power strokes per shaft revolution. (Theoretically, it is possible to construct a well-balanced engine producing 6 power strokes per shaft revolution, however only at the cost of engine's simplicity).

Since Principles 2 and 3 formulated at the end of the previous section are clearly of great importance for this "turbine-like" engine, now I discuss briefly kinetics of the mechanism of the engines of the present invention.

In order to fulfill the requirement of Principle 2 let us recall that any kinetic couple of the mechanism in question is a rotary one, therefore combustion chambers of changing volume can be formed only between pairs of mechanism's elements executing oscillating movement one relative the other (these will be called oscillating kinetic couples). Moreover, it is essential that as many such pairs as possible exist in the mechanism, in order to make the engine close to continuous combustion gas turbine. In fact, upon properly choosing mechanism's geometry (see Remark 3 of the previous section and FIG. 8), I get a mechanism comprising 3 such pairs, and utilizing double-acting "pistons" I obtain a valve-less rotary turbine-like positive-displacement engine producing 2, 4 or 6 power strokes per shaft revolution and having only 3 moving parts.

Figure 8A:
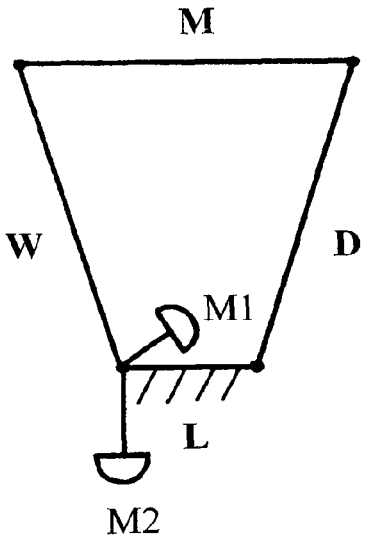
FIGS. 8*a*, 8*b* provides the kinetic scheme of the mechanism of the rotary engine producing 6 power strokes per shaft revolution.

Let us concentrate on the problem of maximizing the number of power strokes per shaft revolution and optimal phasing of power strokes. FIG. 8*a* shows the kinetic scheme of the "turbine-like" rotary engine producing 6 power strokes per shaft revolution (it is an even-armed trapezoid-like four bar linkage), where the letter "w" denotes the distance between the axis of rotation of the element W (shaft) relative the element L (body) and (moving) axis of rotation of the element M (intermediate eccentric) relative the shaft W, and similar notation is applied to the other geometric parameters (distances between rotation axes) of the mechanism.

Thus the mechanism contains 3 oscillating kinetic couples, namely (W,M), (W,D) and (D,M), and a simple computation shows that for w=m=d and l=0.16 w the engine fires (approximately) at the following angles of rotation of the shaft W: 0, 52, 115, 180, 240 and 308 degrees (these are approximately the degrees of rotation of the element W, at which the angle between the members of 3 oscillating couples of the mechanism assumes its maximum or minimum, and thus volume of one of 6 combustion chambers placed between double-acting pistons assumes its minimum). This phasing of the power strokes assures excellent smoothness of the engine driving torque.

Let us mention that there is the rule "the smaller l:w ratio the better engine's balance" (the closer the mechanism to the rigid rotating triangle, see FIG. 8), however decreasing l:w ratio decreases also "piston stroke" and thus engine's swept volume (assuming the other parameters are kept constant).

Now let us turn to Principle 3 i.e. the problem of balancing the engine. This is a non-trivial problem and providing its complete solution requires lengthy computations, which is beyond the scope of the present patent specification. However, the problem turns out to be analogous to that of balancing ordinary piston engine (the mechanism of which is kinetically just a special example of my mechanism) and therefore can be solved by analogous means. My solution (in its general form) is based on the following assertion, the enunciation of which is much longer than its proof OBSERVATION 1 (see FIG. 8) Assume we are given a (moving) mechanism (or kinetic chain) composed of links A1, . . . ,An. Let a(i,j)=a(i,j;t) be the acceleration of the link Ai in the reference system of the link Aj, where t is the time (to be more precise, a(ij) is the acceleration of the origin of a reference system of the link Ai relative a reference system of the link Aj); thus a(i,j)=−a(j,i). Assume that the link A1 is stationary in an inertial reference frame, and that the link Aj executes purely rotational movement in the reference system of A1 (inertial) around a point O of contact of the links A1 and Aj. Assume that the origin of the reference system A1 lies at the end of a vector V based at the point O, and that the origin of the reference system Aj lies at the end of a vector −V based at the point O (an auxiliary technical assumption simplifying computation of accelerations). Assume further that the body force exerted by the link Ai upon the link Aj in the reference system of Aj can be balanced by attaching to the link A1 a mass M1 (counterweight) at the end of the vector V. Then the body force exerted by the link Ai upon the link A1 in the reference system of A1 (inertial) can be balanced by attaching to the link Aj the mass M1 at the end of the vector −V (based at the same point of contact of the links Aj and A1 as the vector V), and then attaching to the link Aj a mass M2 balancing the centrifugal force generated by the link Ai.

Figure 8B:
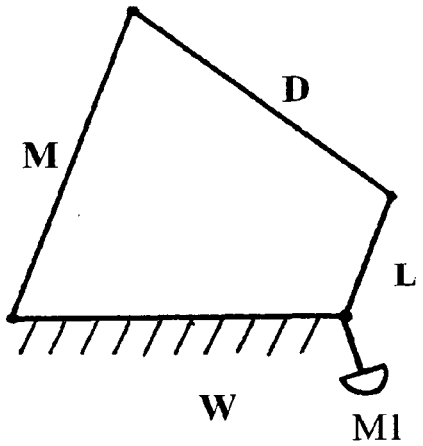

Now let us apply this observation to the mechanism of my "turbine-like" rotary engine producing 6 power strokes per revolution of its main shaft W (see FIGS. 8 a, b and FIGS. 10-17). FIG. 8*a* shows the kinetic scheme of the mechanism under consideration. Let Aj=W, Ai=D or M and A1=L; thus in the reference system of "stationary" link L (engine's body) the element W (main shaft) rotates with a constant rotational velocity, the element D rotates with a changing rotational velocity, and the element M executes a compound movement. In the reference system of the link Aj=W we get the situation illustrated in FIG. 8*b* (the mechanism obtained from the original one by stopping the element Aj=W and letting the element A1=L to rotate). Thus what we obtain is the mechanism of an oscillating engine (i.e. an engine, in which pistons execute oscillating motion; or rather one of the variants of the mechanism of the oscillating engine; the other one will be discussed below together with the mechanism of another variant of the rotary engine), in which the element M (now the oscillator) executes oscillatory movement, the element L (now the engine crankshaft) rotates, and the element D (now the intermediate eccentric) executes a compound movement. In the limiting case when m tends to infinity (and the point of rotation of the element D relative the element M is placed at infinity) we obtain the crank mechanism of the ordinary piston (1-cylinder) engine, in which the kinetic couple (M,W) is a sliding one. Now, it is well known that half of the first order body force produced by the piston and connecting rod of the ordinary 1-cylinder engine can be balanced by attaching to the crankshaft a suitable counterweight M1 (one has to divide the mass of the connecting rod into the portion executing rotational movement and a portion executing rectilinear movement). Analogously, also approximately half of the first order body force produced by the oscillator M and the intermediate eccentric D can be balanced by attaching to the shaft L a suitable counterweight M1 (assuming m is "sufficiently" large; in fact this mechanism, like the mechanism of ordinary 1-cylinder engine, can be fully balanced by more complicated impractical means). This is the solution to the problem of balancing of one variant of my 1-oscillator oscillating engine alluded to above; the above-mentioned method for nearly perfect balancing of the oscillating engine (equipped with another version of my mechanism) will be discussed below. Now, applying Observation 1 above I conclude that the mechanism of my "turbine-like" rotary engine shown in FIG. 8*a* can be partially balanced by attaching suitable counterweights M1 and M2 to the element W (M2 is to balance the centrifugal force generated by the elements M and D), and this method of balancing the engine is incorporated in my design shown in FIGS. 10-17.

The following simple Observation is also of some importance for solving the problem of balancing the rotary engine in question.

OBSERVATION 2 The mechanism shown in FIG. 8*a* "lies between" two "limiting case" mechanisms that can be perfectly balanced by simple means. To be more precise, by letting I tend to zero we obtain a triangle rotating with the element W, which can be perfectly balanced by attaching to W a suitable counterweight. On the other hand, in the limiting case when l=m we get the parallel mechanism, which also can be fully balanced by attaching suitable counterweights to the elements W and D. Thus choosing its parameters close to any of these two limiting mechanisms and attaching appropriate counterweights one can balance the mechanism of the engine.

Now I am in a position to describe my "turbine-like" rotary engine producing 6 power strokes per shaft revolution. In accordance with the character of the present patent application, I concentrate on the mechanical structure of the engine, therefore the treatment of thermodynamic aspects of the engine is much less detailed, but let us indicate that this is a HCCI two-stroke engine. Now, the engine utilizes a flat mechanism of the type described in the previous section, the kinetic scheme of which is shown in FIG. 8*a*. Thus the engine has only three moving parts: 2=W-the main (outboard) rotor, forming a unique whole with the flywheel and the engine main shaft, 4=M-an intermediate rotor, and 3=D-a secondary (outboard) rotor. The main rotor 2 and the secondary rotor 3 are both supported rotationally in their respective bearings 12 and 13 in the engine body 1=L. There are two main portions of the massive main rotor 2=W: "hot portion" and "cold portion". The "hot portion" includes parts that contact hot gases produced during the engine work; these are two fins (or pistons) 21 and 22 and a massive cylinder-shaped wall 23 of combustion chambers, the flat surface of which carries the two fins, the circular surface of which supports the intermediate rotor M at its one end, and which separates the combustion chambers from the "cold portion" of the main rotor (FIGS. 11-14).

Figure 12:
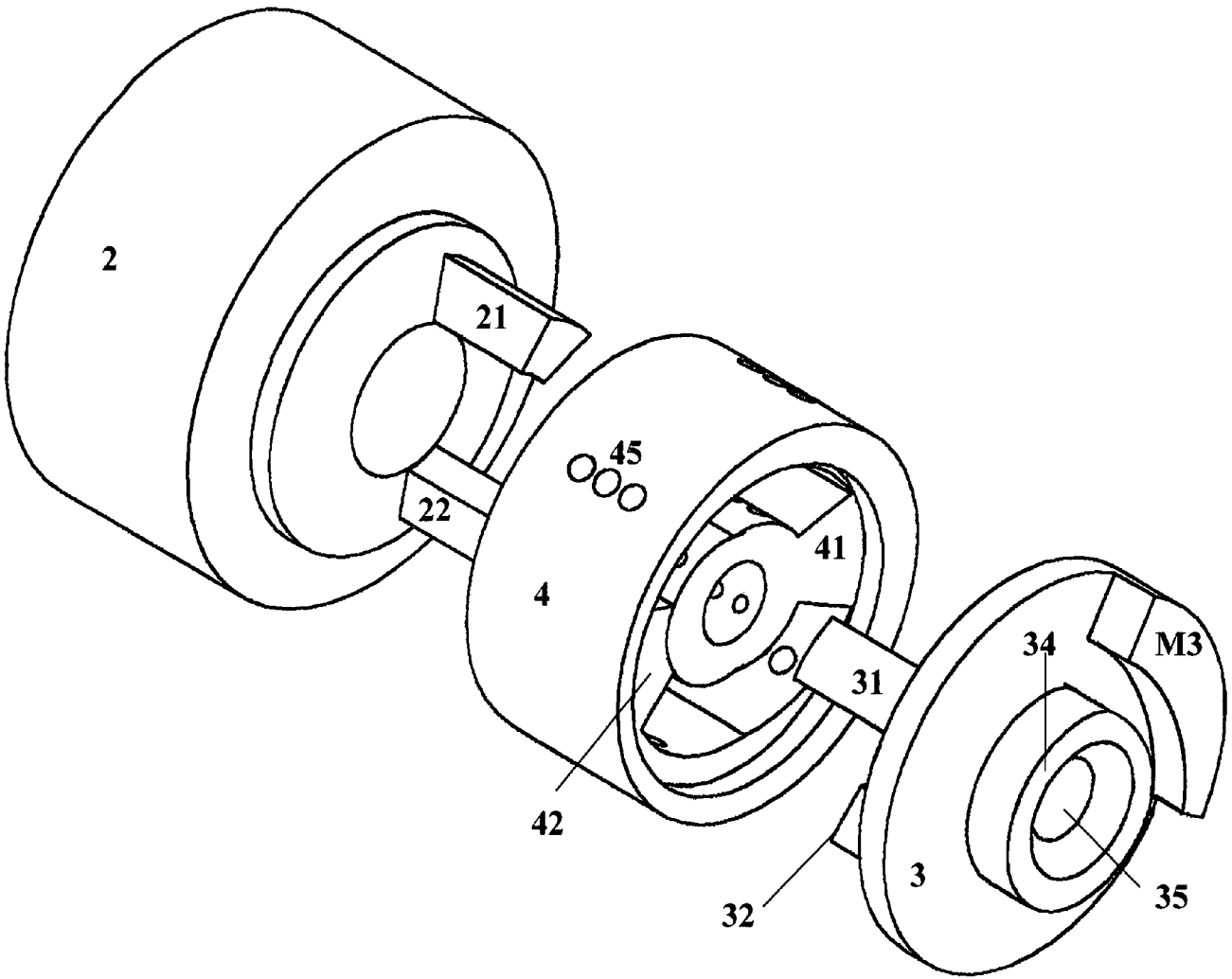
Figure 13:
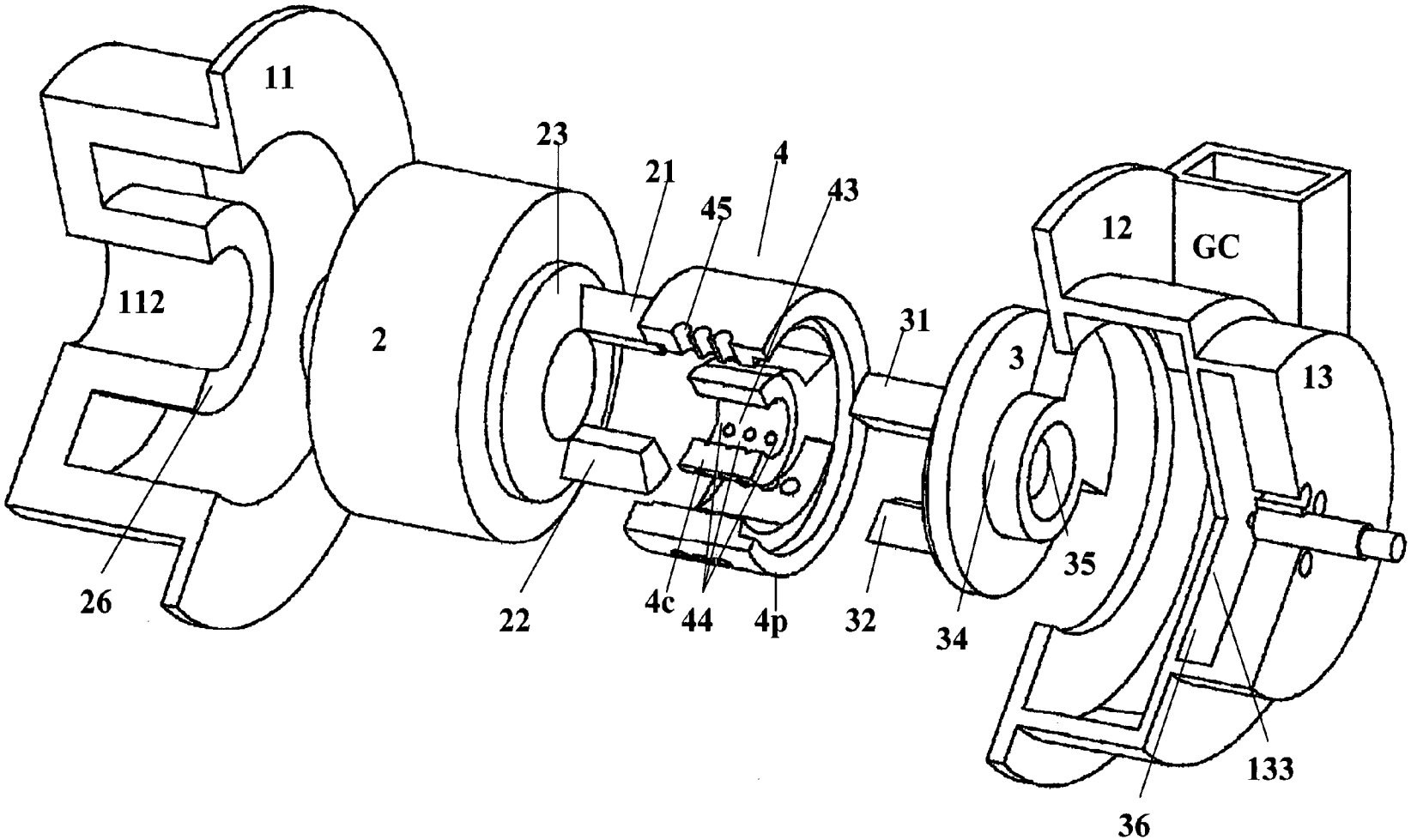
Figure 14:
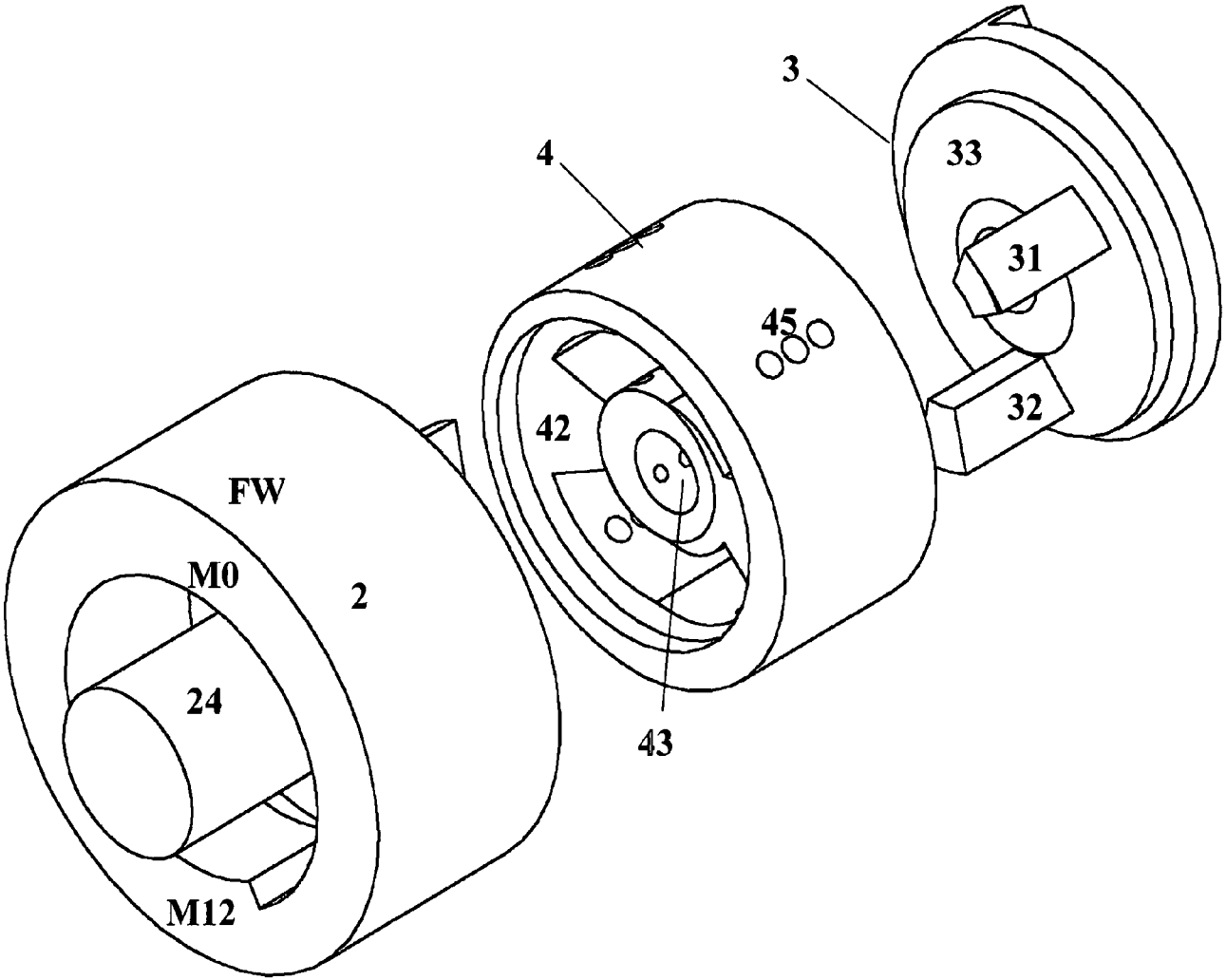
Figure 15:
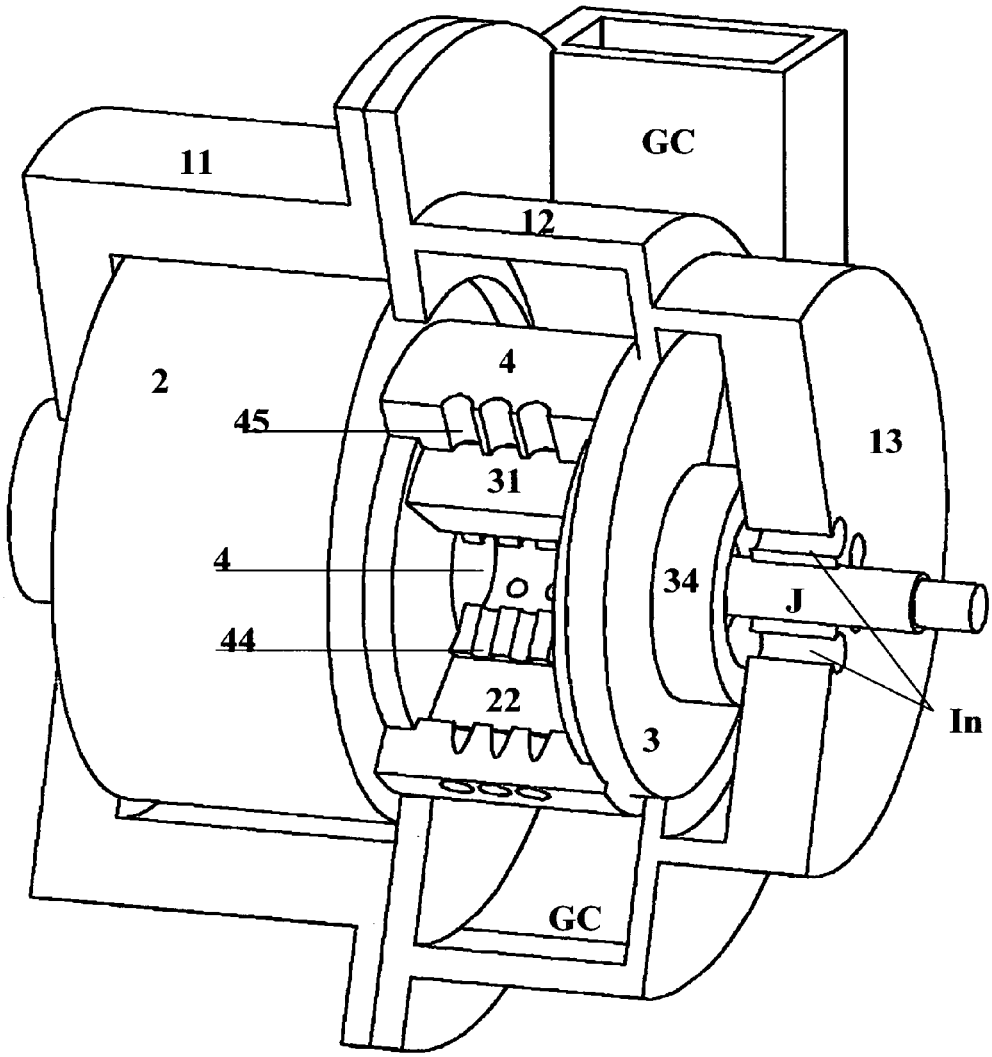
Figure 16:
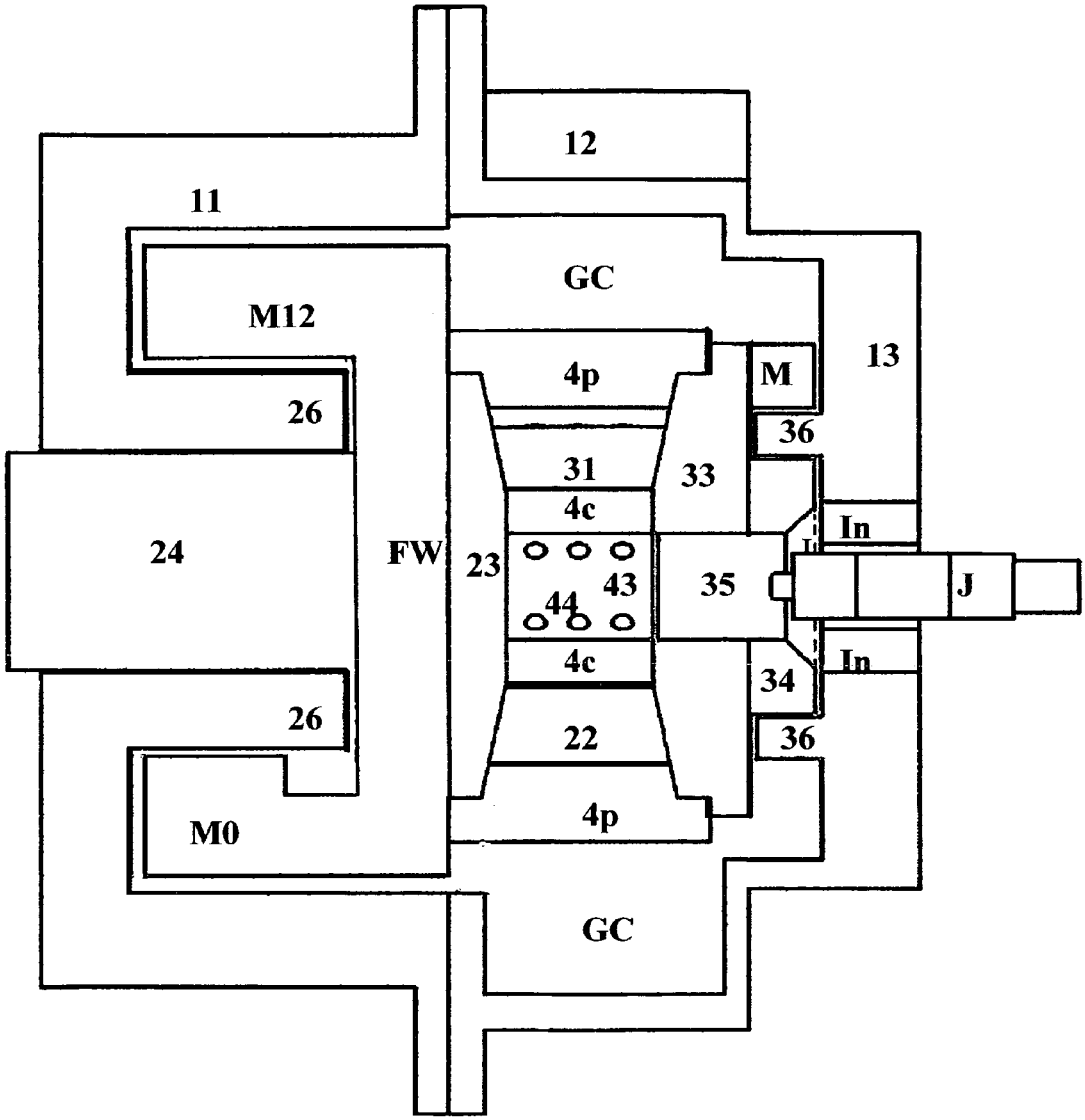

The "hot portion" of the main rotor is placed eccentrically relative its main pin (the center of the "hot portion" is the point of contact of the members 2=W and 4=M of the engine mechanism, see FIG. 8*a*, and FIGS. 12, 13). The massive "cold portion" of the main rotor 2 (FIG. 14) includes the flywheel FW and two counterweights M0 and M12. The counterweight M0 is intended to balance moment of the body (centrifugal) force generated by the eccentric "hot portion" of the main rotor 2 and by the intermediate rotor 4 (that overhang the bearing of the main rotor) and is placed at the opposite side of the bearing. The counterweight M12 (a combination of counterweights M1 and M2—see the discussion above) is intended to balance in combination the body force generated by the intermediate and secondary rotors in the reference system of the main rotor 2=W-and the centrifugal force generated by these two rotors and the eccentric "hot portion" of the main rotor in the reference system (inertial) of the engine body 1=L; therefore this counterweight is placed so as its center of gravity is positioned in the plane perpendicular to the axis of rotation of the main rotor, which intersects said axis at the center of the bearing (and thus the center of the main pin 24, see below) of the rotor 2. The main rotor 2 is supported in the bearing 112 placed at one end of engine's body part 11 through its massive main pin (or shaft) 24.

Structure of the secondary rotor 3 is slightly different from that of the main rotor 2 (FIGS. 11-14). There is also "hot portion", which includes parts that contact hot gases produced during the engine work; these are two fins (or pistons) 31 and 32 and a massive stepped cylinder-shaped wall 33 of combustion chambers, the flat surface of which carries the two fins, the circular surface of which supports the intermediate rotor 4 at the other end, and which separates the combustion chambers from the "cold portion" of the secondary rotor and its bearing. The "cold portion" of the secondary rotor consists of the massive pin 34 rotationally supported in a bearing 133 placed in the engine body 13, however there is no flywheel and the moment of inertia of the secondary rotor is substantially smaller than that of the main rotor (in fact it should be as small as possible to diminish body forces generated by the secondary rotor (executing variable velocity rotational movement)).

At the center of the secondary rotor there is a circular air inlet passage 35 (FIGS. 12, 13, and 16) intended to direct the scavenging air to the combustion chambers. The "hot portion" of the secondary rotor is placed eccentrically relative its main pin (the center of the "hot portion" is the point of contact of the members 3=D and 4=M of the engine mechanism, see FIG. 8*a*). Opposing the "hot portion" there is a counterweight M3 intended to balance the centrifugal force generated by the eccentrically placed "hot portion" (FIG. 12).

Intermediate rotor 4=M (FIGS. 12-17) is composed of the central portion 4*c* and peripheral ring-shaped portion 4*p* connected by two massive fins (or pistons) 41 and 42. Placed in the central portion of the intermediate rotor there is a primary circular air inlet passage 43 and four assemblies of radially disposed secondary air inlet passages 44; these air passages are intended to direct the scavenging air to six combustion chambers of the engine (see the discussion of the engine work below). Placed in the peripheral ring-shaped portion 4*p* of the secondary rotor there are four assemblies of hot gases outlet passages 45 intended to exhaust low pressure hot gases from the combustion chambers of the engine. Internal wall of the peripheral ring-shaped portion 4*p* of the intermediate rotor consists of two interfering circular surfaces 4*p*1 and 4*p*2 the centers of which are displaced one relative the other by a distance dictated by the geometry of the engine mechanism (see FIG. 8*a*; the center of one of these circular surfaces is the point of contact of the members 2=W and 4=M of the mechanism, and the center of the other circular surface is the point of contact of the members 3=D and 4=M). Corresponding to the two circular surfaces 4*p*1 and 4*p*2 forming the internal wall of the peripheral ring-shaped portion 4*p* of the intermediate rotor there are two smaller interfering circular surfaces 4*c*1 and 4*c*2 forming the external wall of the central portion 4*c* of the intermediate rotor. The pistons 21 and 22 attached to the main rotor 2 slide over the pair of the circular surfaces 4*c*1 and 4*p*1, and the pistons 31 and 32 attached to the secondary rotor 3 slide along the other pair of the circular surfaces 4*c*2 and 4*p*2 opening and closing the inlet passages 44 and outlet passages 45. One of the circular sections of the internal wall of the ring-shaped member 4*p* of the intermediate rotor 4 slides over the massive circular wall 23 of the "hot portion" of the main rotor 2, and the other circular section slides over the massive circular wall 33 of the "hot portion" of the secondary rotor 3 giving the engine mechanism the required kinetics. Circular walls 23 and 33 of the "hot portions" of the main and secondary rotors, double acting pistons 21, 22, 31, 32, 41, 42, and peripheral and central portions of the intermediate rotor 4=M confine 6 combustion chambers of the engine that rotate during engine's work (FIG. 17).

The engine body 1 is formed from three main pieces 11, 12, and 13. The two side pieces 11 and 13 ("cold" pieces of the body) supports the main and secondary rotors in their respective bearings 112 and 133. Placed in the "cold" side piece 13 there is an air inlet port In and a fuel injector J. The central "hot" piece 12 of the body houses the intermediate rotor 4 and "hot portions" of the main and secondary rotors. There is also a "turbine-type" spiral hot gases exhaust collector GC.

As the high-pressure gas contained in the combustion chambers exerts axial forces on both the main and secondary rotors, there are thrust bearings 26 and 36 supporting the main and the secondary rotors respectively. Below I discuss another construction of the rotary engine that does not require thrust bearings.

Figure 17:
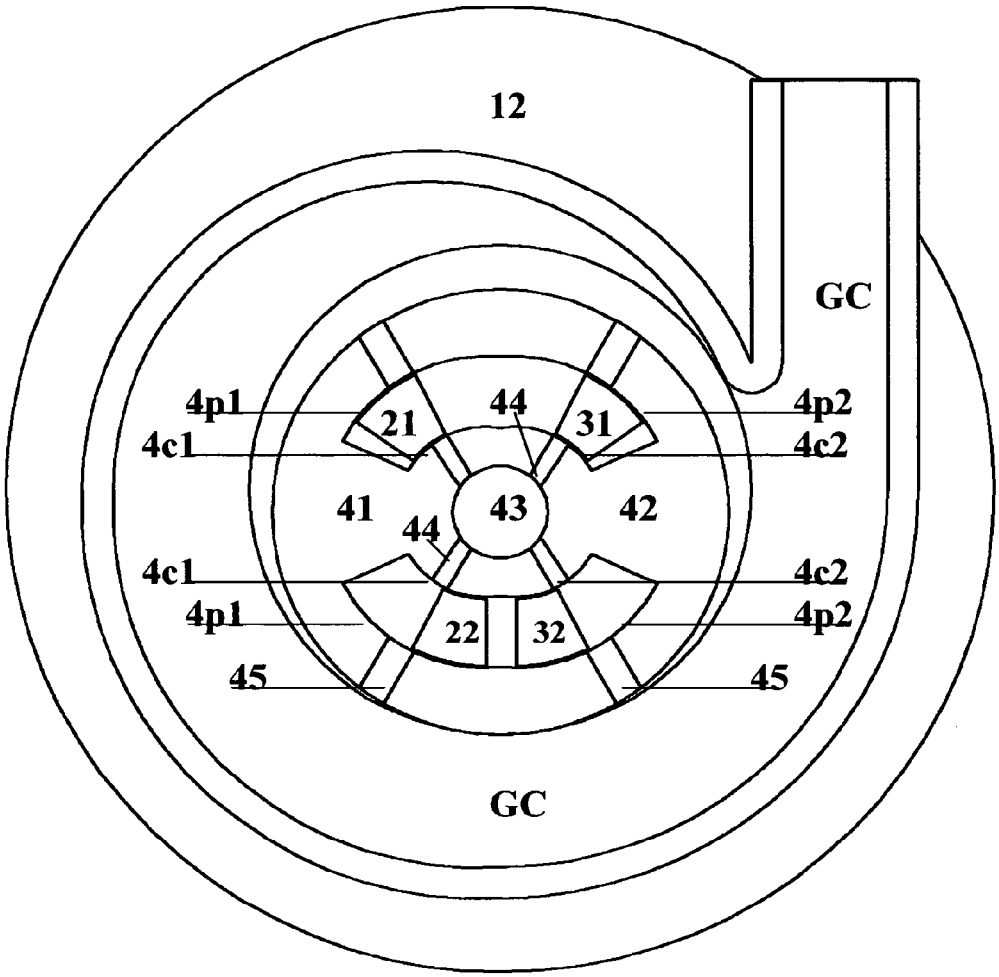
Figure 18:
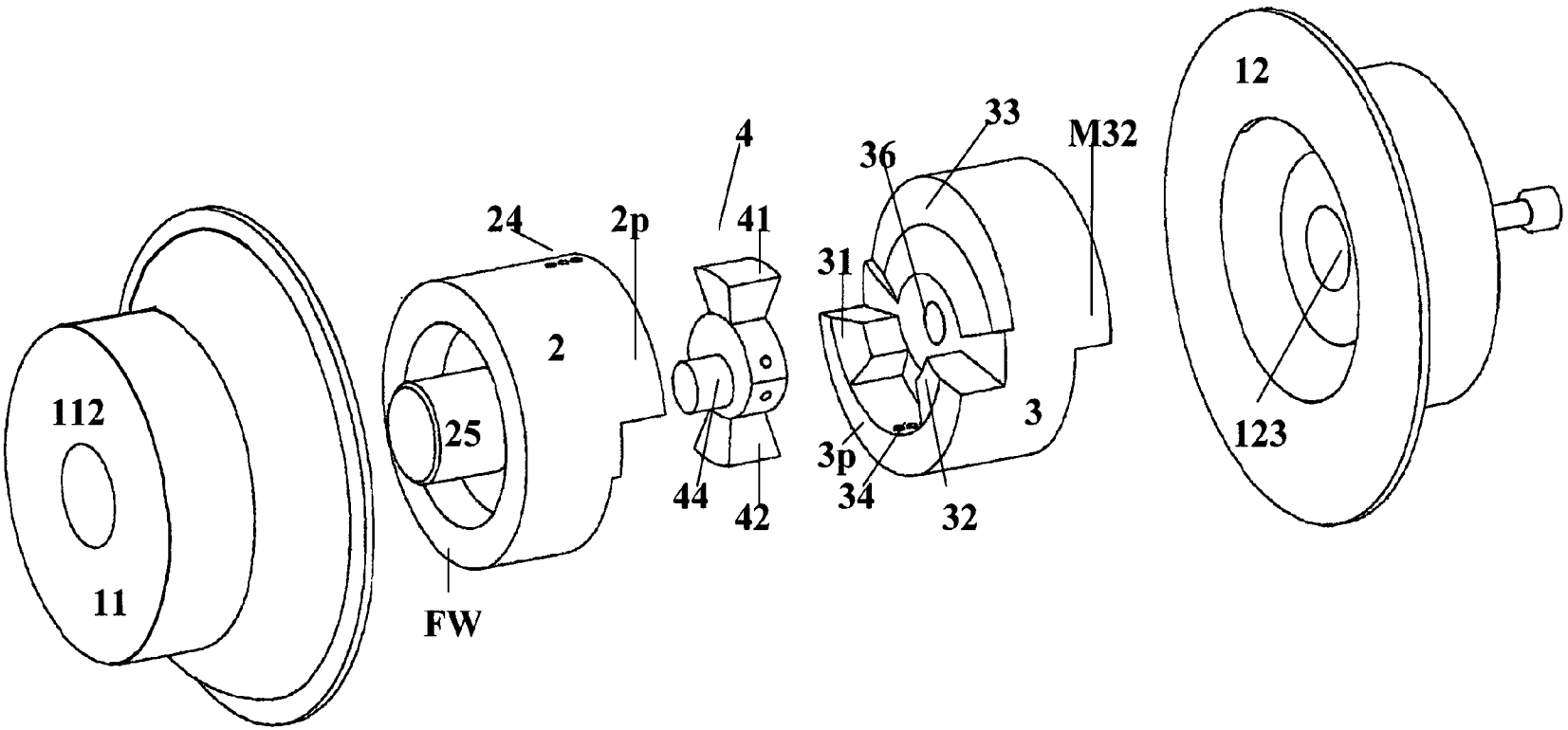
FIGS. 18-24 illustrate the rotary engine according to the invention producing 4 power strokes per shaft revolution. More specifically.
Figure 19:
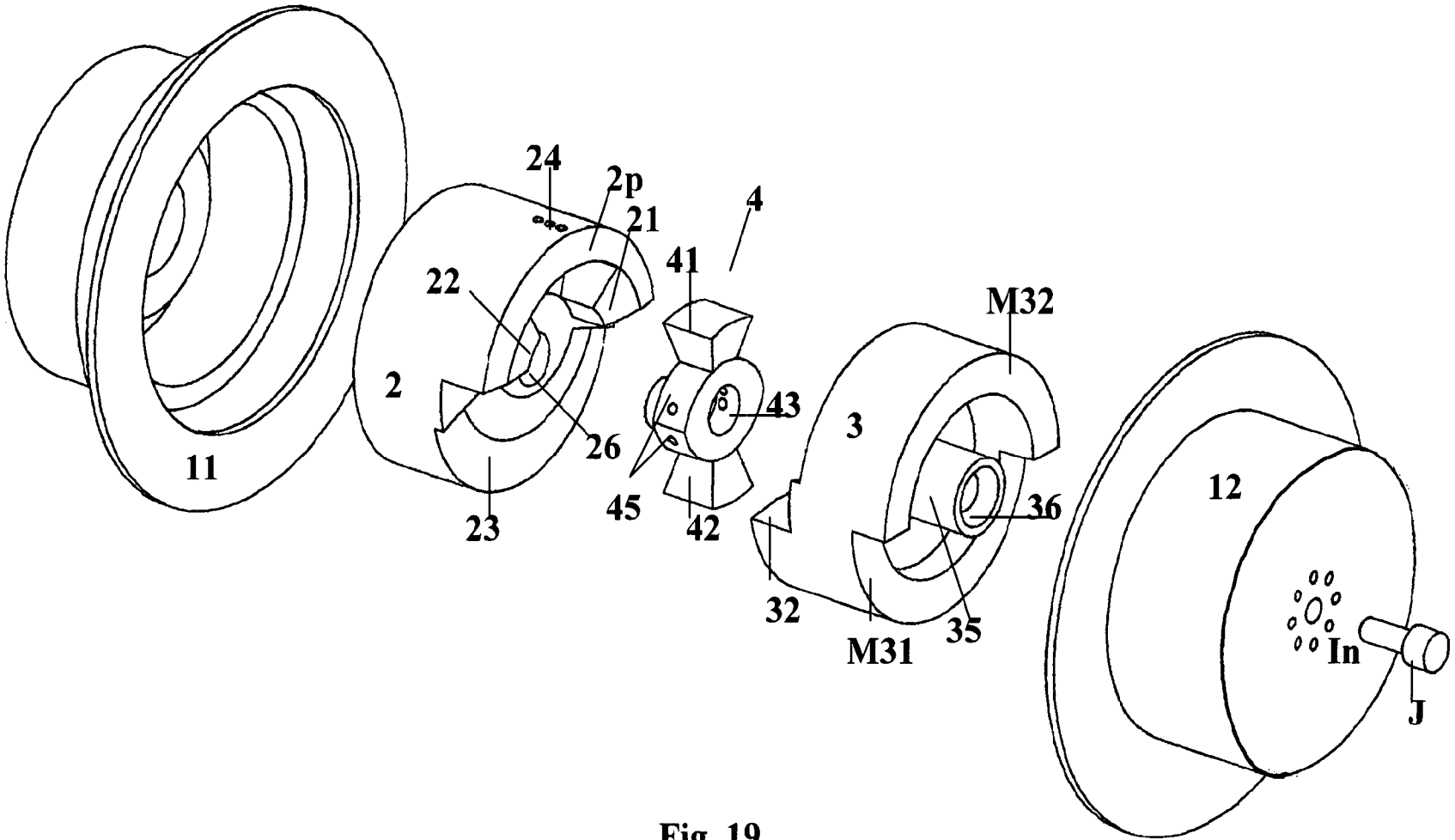
Figure 20:
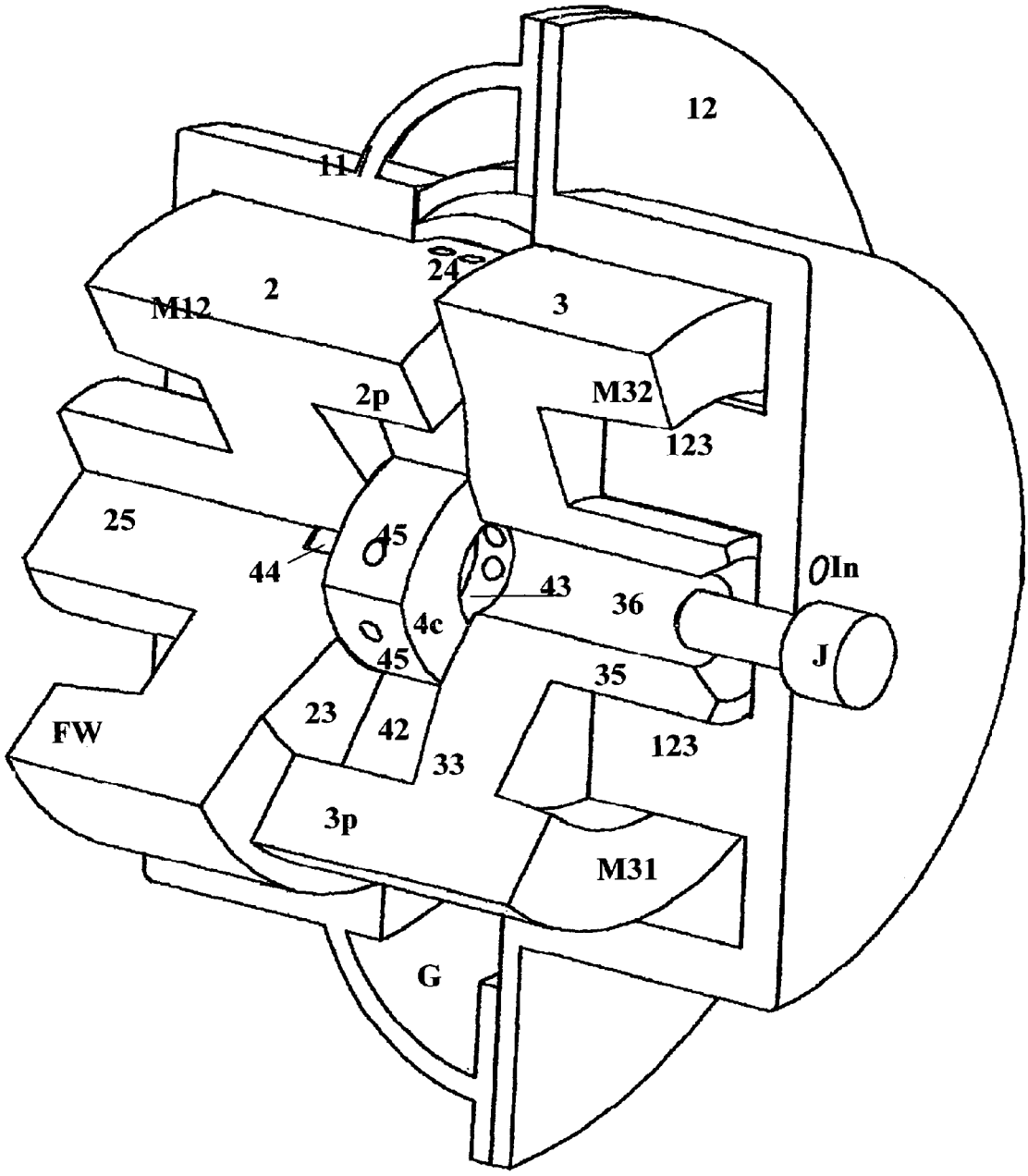
Figure 21:
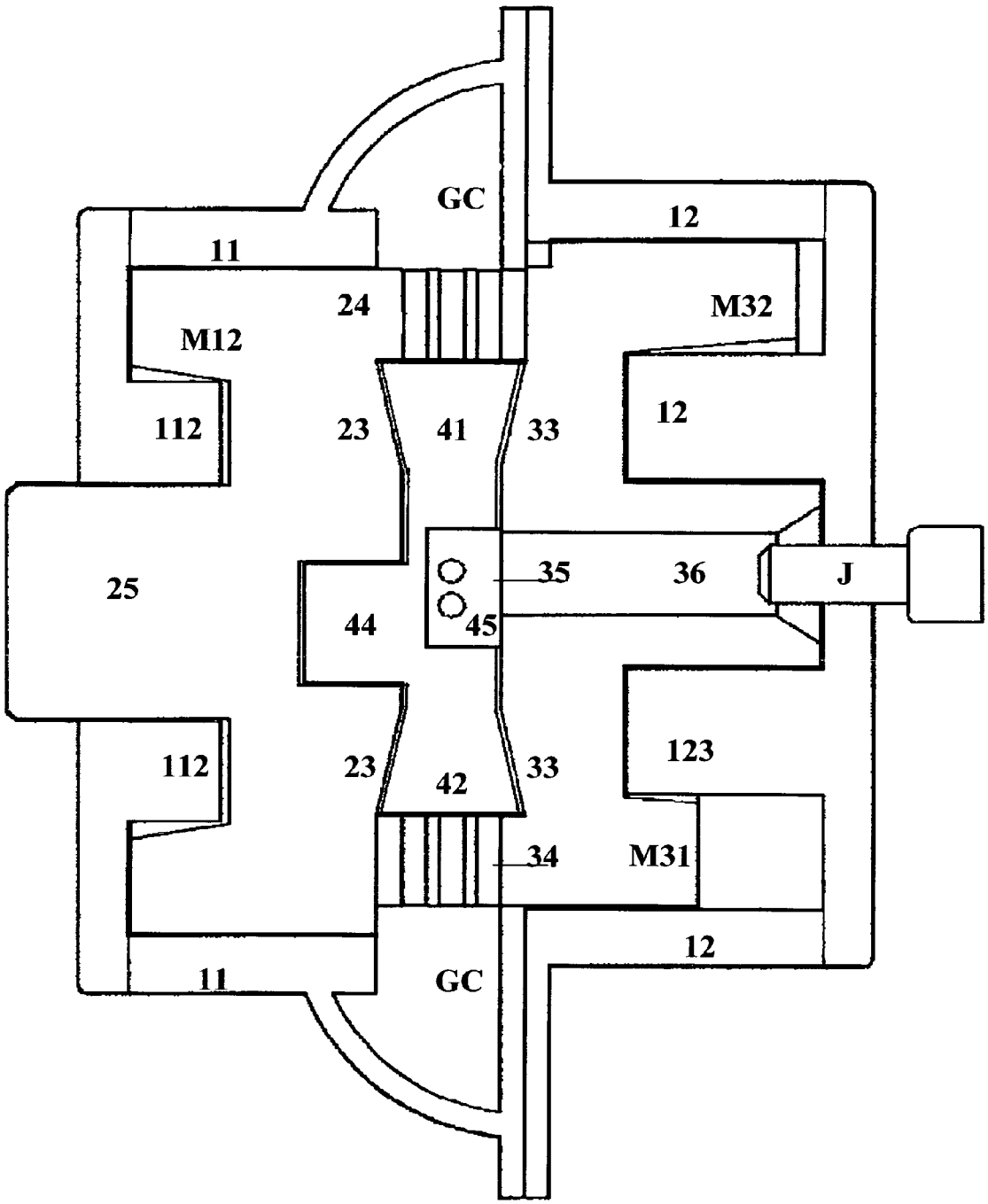

Now a brief discussion of the engine work follows (see a transverse cross-section in FIG. 17 where combustion chambers and gas passages 43, 44, 45 and GC are shown). As mentioned above the engine has six rotating combustion chambers that fire at 0, 52, 115, 180, 240 and 308 degrees of rotation of the main rotor 2. As the rotor 2 rotates and volume of one of the combustion chambers approaches its maximum the corresponding piston open the outlet ports 45 placed at the peripheral ring-shaped portion of the intermediate rotor 4 and hot low-pressure gases driven by centrifugal forces exit said combustion chamber, flow through the spiral collector GC, and are finally exhausted. Next, as volume of the combustion chamber still rises, the piston opens inlet ports 44 placed at the central piece of the intermediate rotor 4. Fresh air, driven by centrifugal forces, enters the inlet port In placed at the "cold" side component 13 of the engine body. Then the injector J injects fuel into the air stream and homogeneous charge is produced in the central air passage 35 of the secondary rotor 3 and central air passage 43 of the intermediate rotor 4. The homogeneous charge passes through said central air passages, and enters the combustion chamber through the air passages 44 disposed radially in the central piece 4*c* of the intermediate rotor 4 displacing remaining hot low-pressure gases; this is the scavenging. Next, as the rotors further rotate, volume of the combustion chamber decreases, the piston closes the inlet 44 and outlet 45 ports, and the homogeneous charge is compressed. As volume of the combustion chamber approaches its minimum, the homogeneous charge ignites and rapidly burns producing hot high-pressure gases. Next the gases expand producing useful power (received from the main rotor 2) and the whole process repeats. The same process occurs in all six combustion chambers during each revolution of the rotor, rendering the engine nearly a continuous combustion engine.

In this brief discussion I completely ignore the subtle problem of controlling this HCCI engine, as this is beyond the scope of the present patent application, the focus of which is on the mechanical aspects of the engine. The problem of controlling my rotary HCCI engines will be discussed in the presentation of another engine below. The method indicated below is applicable to the present engine.

Let us note that there is also a mechanically similar engine working on traditional Diesel cycle, the general layout of which (including the effective centrifugal forces-enhanced uniflow scavenging system) is completely analogous, with the only essential difference being a plurality of injectors adjacent to the combustion chambers (some minor structural changes are also required).

2. Rotary "Flat" Positive-Displacement Turbine-Like Engine Producing 4 Power Strokes Per Shaft Revolution (FIGS. 18-24)

The next design of my rotary "turbine-like" engine is aimed at improving engine's balance and making it lighter. This is achieved mainly by diminishing mass and moment of inertia of the intermediate rotor M=4, which is obtained by differently shaping said rotor. Namely, I remove the massive peripheral ring-shaped portion of the intermediate rotor and, in a sense, place it partially on the main rotor and partially on the secondary rotor. This increases mass and moment of inertia of the secondary rotor in comparison with that of the previous design, but diminishes mass and moment of inertia of the intermediate rotor by approximately double of the amount and enables the counterweight M12 (balancing the first order body force generated by the intermediate and secondary rotors in the reference system of the main rotor W=2 and the centrifugal force generated by these two rotors and the eccentric "hot portion" of the main rotor in the reference system of the engine body) to be substantially diminished, and also makes the counterweight M0 (balancing the moment of centrifugal force generated by the intermediate rotor) unnecessary (see the discussion below), which in combination contributes to the overall engine's mass reduction. The improvement of engine's balance however is achieved at the cost of diminishing by two the number of power strokes per the main rotor revolution.

Kinetics of the engine is precisely the same as that of the previous one (FIG. 8*a*). Thus the engine has only three moving parts: W=2-the main (outboard) rotor, forming a unique whole with the flywheel and the engine main shaft, M=4-an intermediate rotor, and D=3-a secondary (outboard) rotor. The main rotor 2 and the secondary rotor 3 are both supported rotationally in their respective bearings 12 and 13 in the engine body 1.

Like in the previous engine, the main rotor 2 (FIGS. 23, 24) has "hot portion" and "cold portion" but differently shaped.

The "hot portion" assumes the general form of a segment of circle and consists of two fins (or pistons) 21 and 22, a peripheral wall 2*p* assuming the shape of a segment of the ring (replacing the peripheral ring-shaped wall 4*p* of the intermediate rotor of the previous-discussed engine), and a massive circular wall 23 of combustion chambers carrying the two fins and separating the combustion chambers from the "cold portion" of the main rotor. Placed radially in the peripheral ring-shaped "hot portion" 2*p* of the main rotor there is a hot gases passage 24. The "hot portion" of the main rotor is placed eccentrically relative its main pin 25 (the center of the "hot portion" is the point of contact of the members W=2 and M=4 of the engine mechanism, see FIG. 8*a*). The massive "cold portion" of the main rotor 2 has an eccentrically placed circular hollow 26, in which the main pin 44 of the intermediate rotor 4 is supported pivotally. The "cold portion" of the main rotor, besides the pin 25, includes the flywheel FW and a counterweight M12 placed opposite the hollow 26.

Again, structure of the secondary rotor 3 (FIGS. 23, 24) is slightly different from that of the main rotor 2. The "hot portion" assumes the general form of a segment of circle and consists of two fins (or pistons) 31 and 32, a peripheral wall 3*p* assuming the shape of a segment of the ring, and a massive circular wall 33 of combustion chambers carrying the two fins and separating the combustion chambers from the "cold portion" of the secondary rotor and its bearing. Placed radially in the peripheral ring-shaped "hot portion" of the secondary rotor there is a hot gases passage 34. The "cold portion" of the secondary rotor consists of the massive pin 35 rotationally supported in a bearing 123 placed in the part 12 of the engine body 1, however there is no flywheel, and the moment of inertia of the secondary rotor should be as small as possible to diminish body forces generated by the secondary rotor executing variable velocity rotational movement. At the center of the secondary rotor there is a circular air inlet passage 36 (FIGS. 19-21, 24) intended to direct the scavenging air to the combustion chambers. The "hot portion" of the secondary rotor is placed eccentrically relative its main pin 35 (the center of the "hot portion" is the point of contact of the members D=3 and M=4 of the engine mechanism, see FIG. 8*a*). There is a counterweight M31 placed at the opposite side of the circular "hot" wall balancing the moment of the centrifugal force generated by the "hot portion" of the secondary rotor. Opposing the "hot portion" and the counterweight M31 there is a counterweight M32 intended to balance the centrifugal force generated by the eccentrically placed "hot portion" of the secondary rotor and the counterweight M31.

Intermediate rotor 4 (FIGS. 23, 24) consists of the central portion 4*c* carrying two massive fins (or pistons) 41 and 42, but there is no peripheral ring-shaped portion. Placed in the central portion 4*c* of the intermediate rotor 4 there is a primary circular air inlet passage 43 and four assemblies of radially disposed secondary air inlet passages 45; these air passages are intended to direct the scavenging air to four combustion chambers of the engine.

Figure 22:
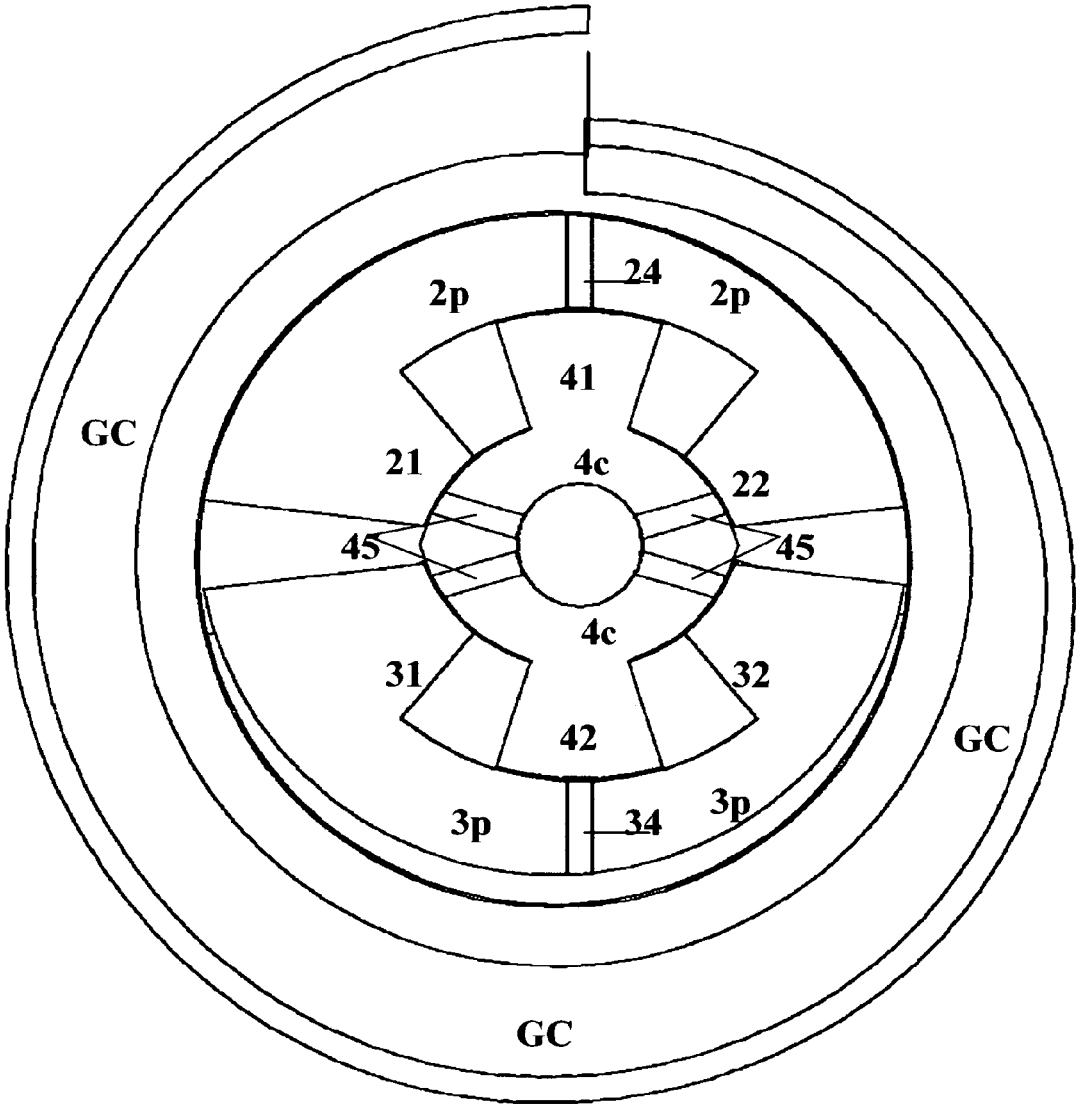
Figure 23:
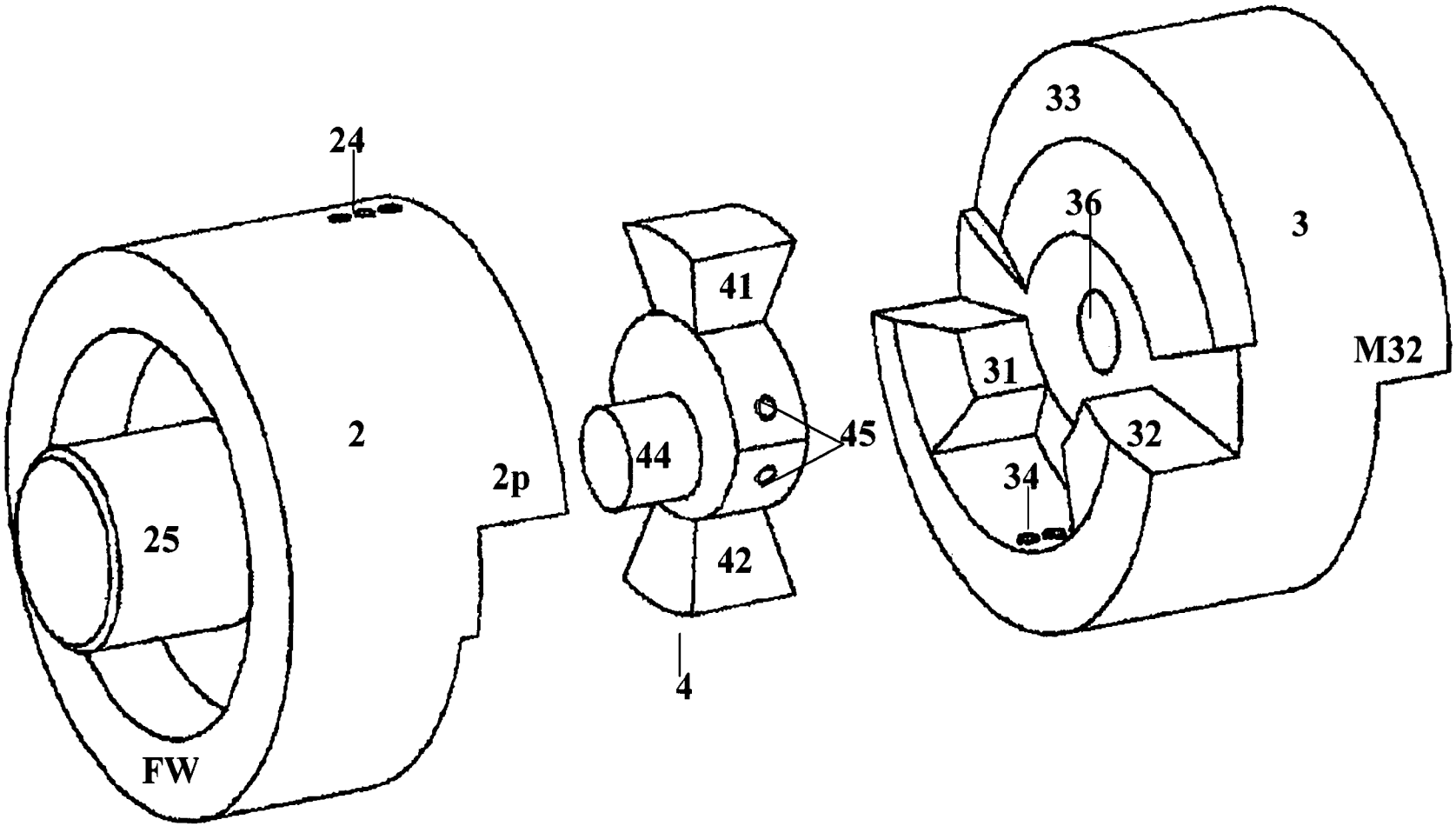
Figure 24:
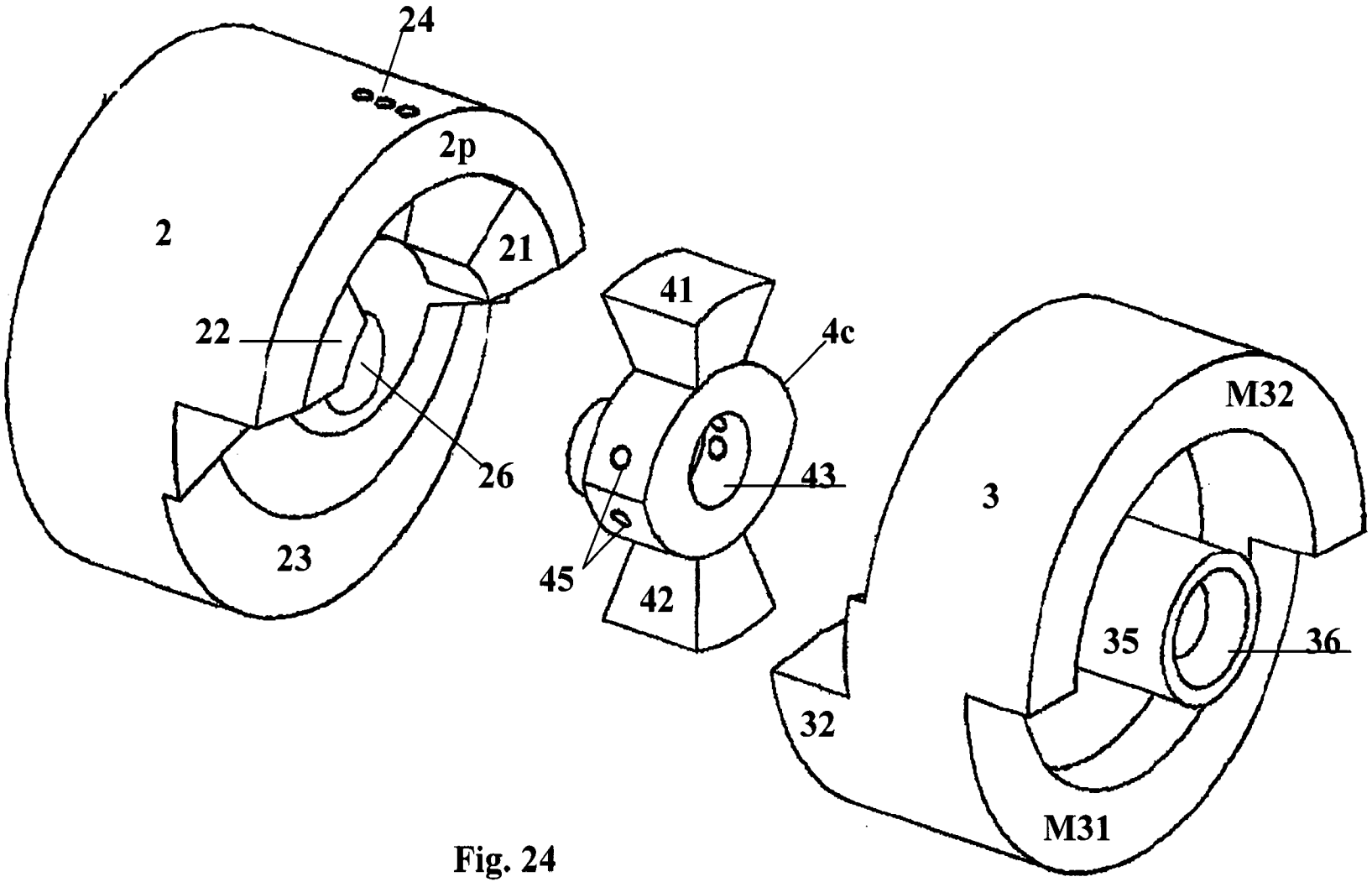
Figure 25:
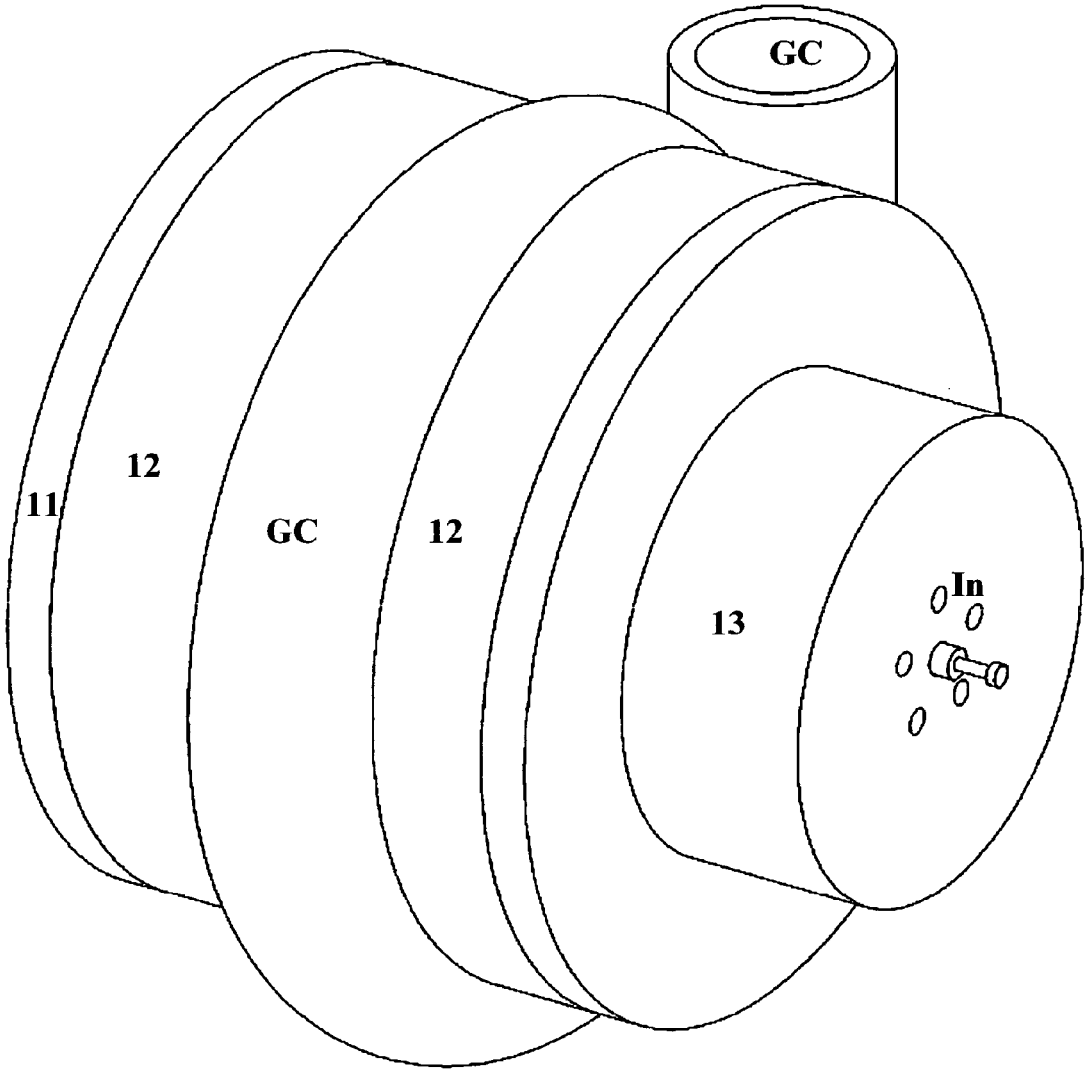
FIGS. 25-31 show the rotary engine according to the invention producing 2 power strokes per shaft revolution. More specifically.
Figure 26:
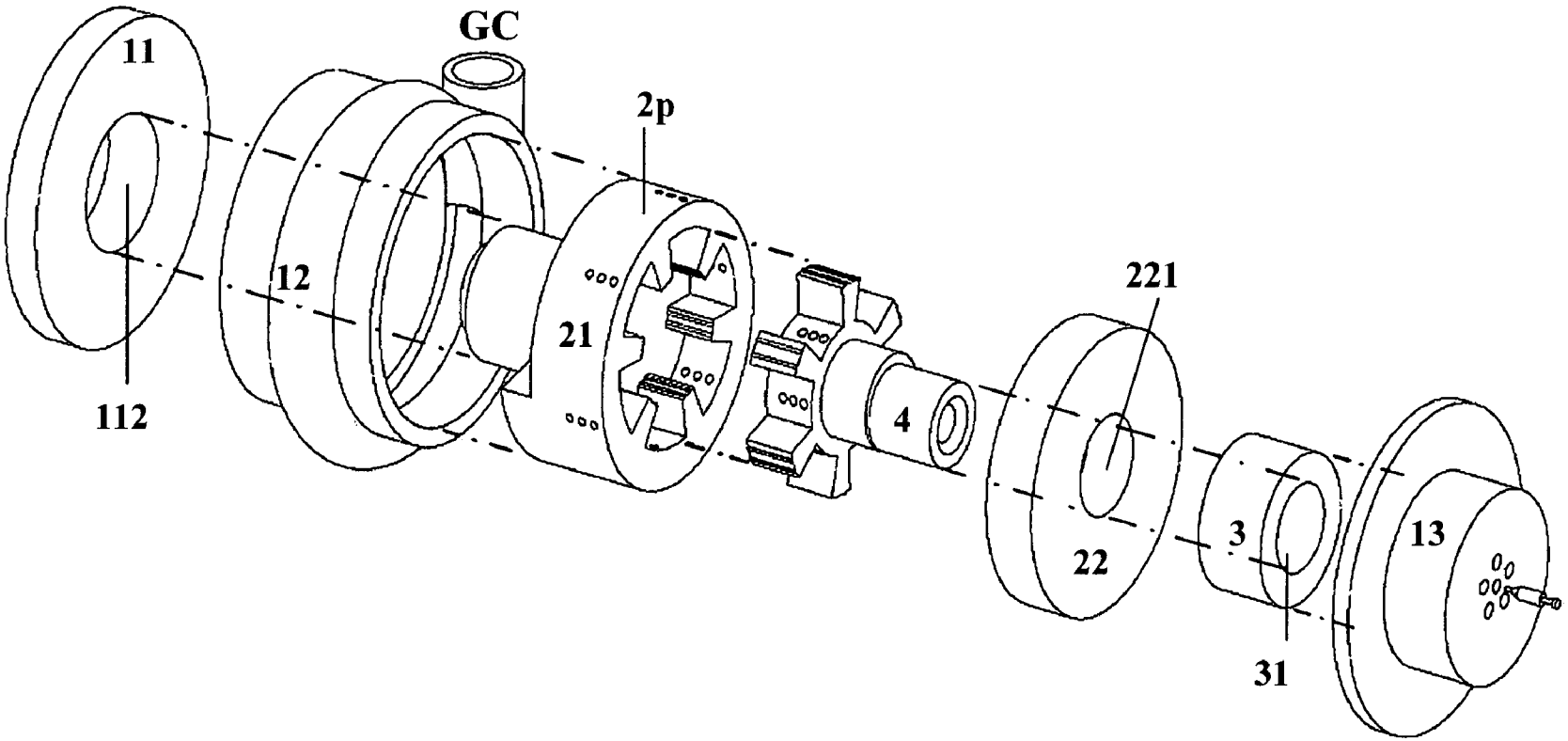
Figure 27:
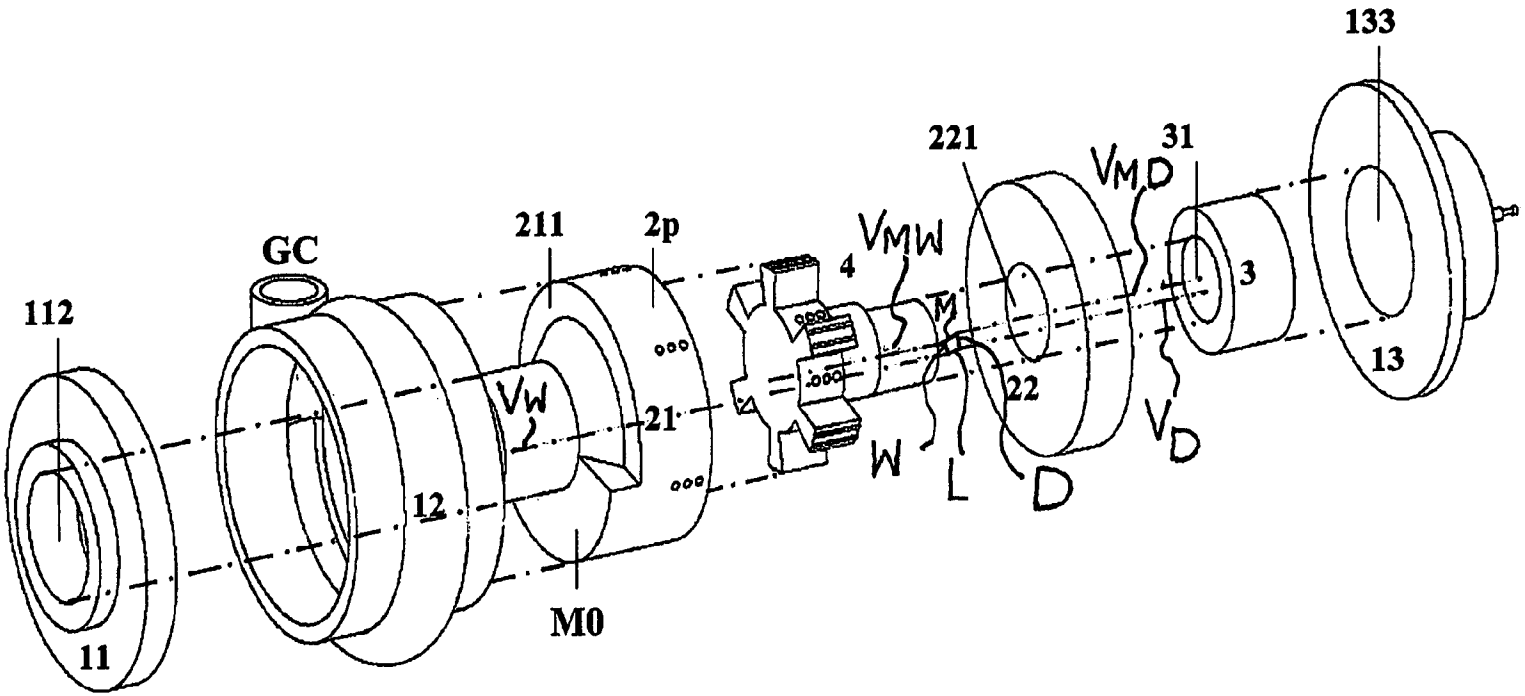

Circular and peripheral ring shaped walls of the "hot portions" of the main and secondary rotors, double acting pistons FW1, FW2, FD1, FD2, FM1, FM2, and the central portion of the intermediate rotor 4 confine 4 combustion chambers of the engine that rotate during engine's work (FIG. 22).

The entire mass of the intermediate rotor M is assumed to be supported in the hollow HW placed in the main rotor W. Thanks to the absence of the ring-shaped portion of the intermediate rotor, the center of gravity of the counterweight on the main rotor balancing the centrifugal force produced by the eccentrically mounted intermediate rotor can be placed in the same plane as the center of gravity of the intermediate rotor. Therefore the counterweight M0 is no longer necessary, and the counterweight M12 can be smaller than in the previous design, as already mentioned above.

The engine body is formed from three main parts. The two side pieces ("cold" pieces of the body) 11 and 12 supports the main 2 and secondary 3 rotors in their respective (radial and thrust) bearings 112 and 123. Placed in one of the "cold" side pieces (the right hand side piece in FIGS. 19-21) there is an air inlet port In and a fuel injector J. The central "hot" portion of the body houses the intermediate rotor 4 and "hot portions" of the main and secondary rotors. There is also a "turbine-type" spiral hot gases exhaust collector GC placed in the central portion of the engine body.

The high-pressure gas contained in the combustion chambers exerts axial forces on both the main and secondary rotors, hence there are thrust bearings supporting both the rotors.

The discussion of the rotary engine work above almost literally applies to the present case, therefore is omitted in the interests of brevity.

3. Rotary "Flat" Positive-Displacement Turbine-Like Engine—2 Power Strokes Per Shaft Revolution (FIGS. 25-31, 9*a*-9*d* and 9*a*1)

The third design of the "turbine-like" rotary engine is aimed at further improving engine's balance and maximizing its rotary speed and hence power density, and also at disposing of thrust bearings and hot load bearing engine's components (these are the intermediate rotors in the two previously-discussed engines). The first two goals are achieved partially by further reducing mass and moment of inertia of the engine parts, the rotational speed of which varies during the engine work (secondary and intermediate rotors), and partially by choosing different geometry and kinetics of the engine mechanism. To be more precise, further reduction of mass and moment of inertia of secondary and intermediate rotors forces further reduction of the number of power strokes, but once one accepts this reduced number of power strokes it is possible to choose a different engine's mechanism that can be better balanced (FIGS. 9*a*-9*d*). Thus once again the number of power strokes is diminished by two (therefore the engine produces two power strokes per shaft revolution), but we obtain not only well-balanced engine, but also particularly compact, robust, simple and logical structure of the engine main parts and the engine as a whole. The third goal, that is to say disposing of the thrust bearings and hot load bearing engine's components, is achieved in the most natural way as a "by-product" of the procedure of improving engine's balance. Moreover, the swept volume/total volume ratio is believed to be considerably increased in comparison with the two previous designs.

Now I once again embark on the discussion of balancing of my engine's mechanisms (FIGS. 9*a*-9*d*; again I apply some analogies and general arguments to indicate the general method for balancing the engine instead of complicated mathematical formulas). Since the engine is to produce only two power strokes per shaft revolution, the engine mechanism is allowed to have only one "oscillating" kinetic couple (the engine will incorporate double-acting pistons), and I choose the mechanism schematically illustrated in FIG. 9*a*.

I use another observation concerning methods for balancing mechanisms.

OBSERVATION 3. Assume we are given a mechanism as described in Observation 1 above. Further assume that the mechanism can be balanced in the reference system Aj by balancing the body force generated by certain elements Ai1 and Ai2 by attaching to the element Ai1 a counterweight M1, so as the center of gravity of the system composed of the elements Ai1 and Ai2 and the counterweight M1 lies at the center of rotation O1 of the element Ai1 relative the element Aj; let O1 be the end point of a vector V based at the common origins of the reference systems A1 and Aj. Then the mechanism can be balanced in the reference system A1 by additionally attaching to the element Aj a counterweight M2 (equal to the total mass of the elements Ai1 Ai2 and the counterweight M1) at the end of the vector −V (FIG. 9).

Again the proof of this statement is just an immediate computation.

Figure 9A:
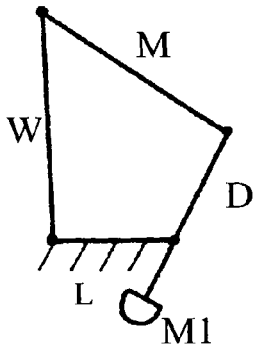
FIGS. 9*a*-9*d* depict the kinetic scheme of the rotary engine producing 2 power strokes per shaft revolution and some other schemes illustrating a method for balancing the engine.
Figure 9B:
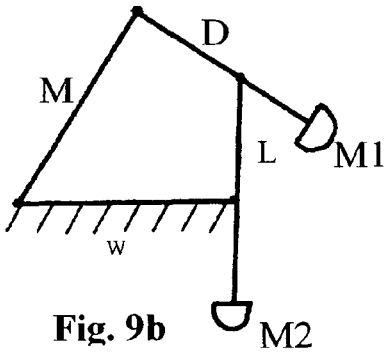
Figure 9C:
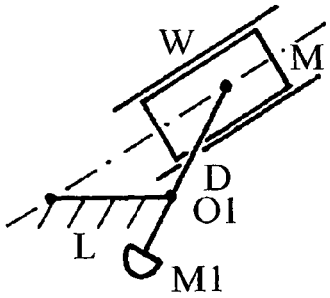
Figure 9D:
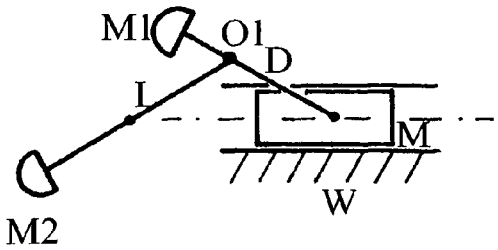
Figure 10:
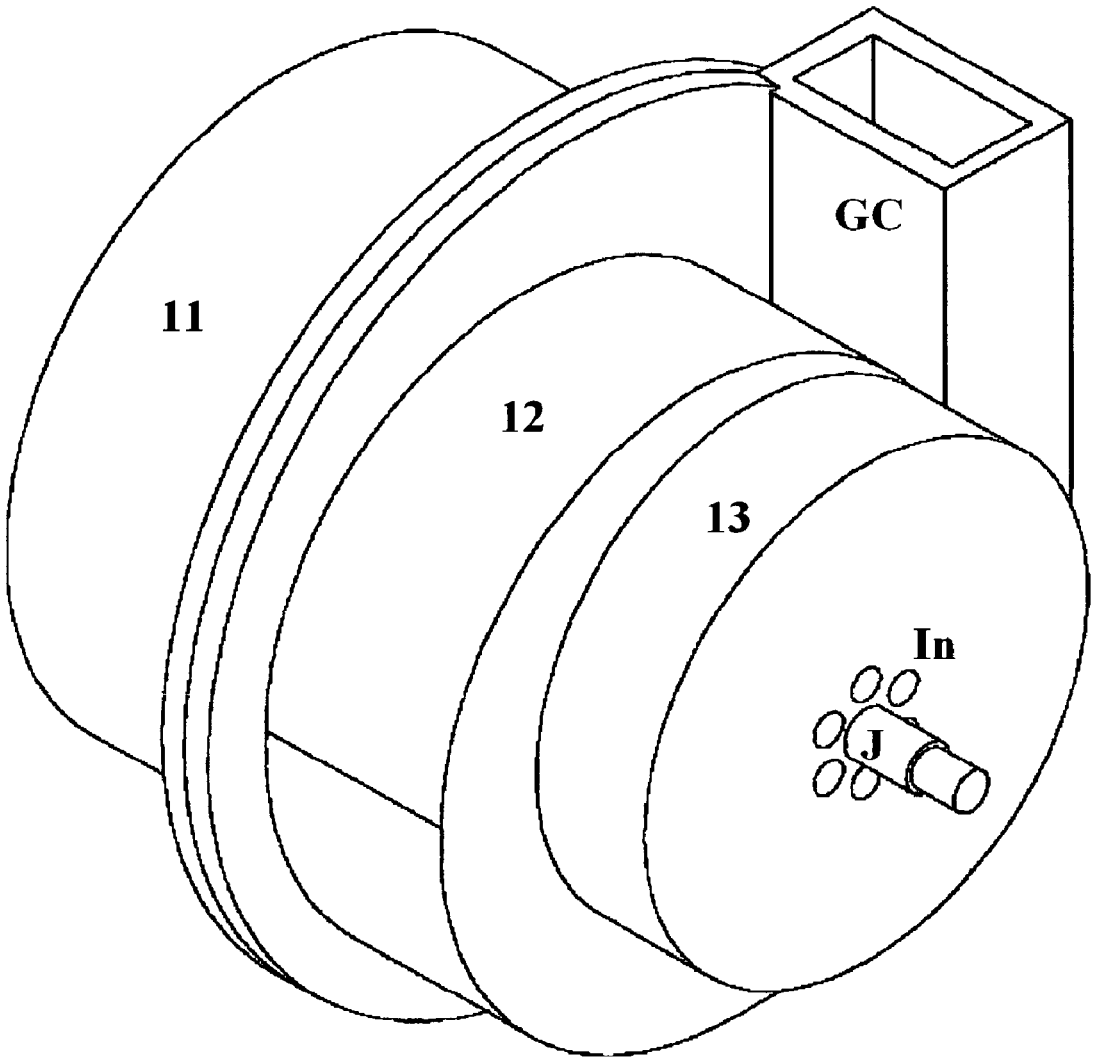
FIGS. 10-17 illustrate the rotary engine according to the present invention producing 6 power strokes per shaft revolution. More specifically.
Figure 11:
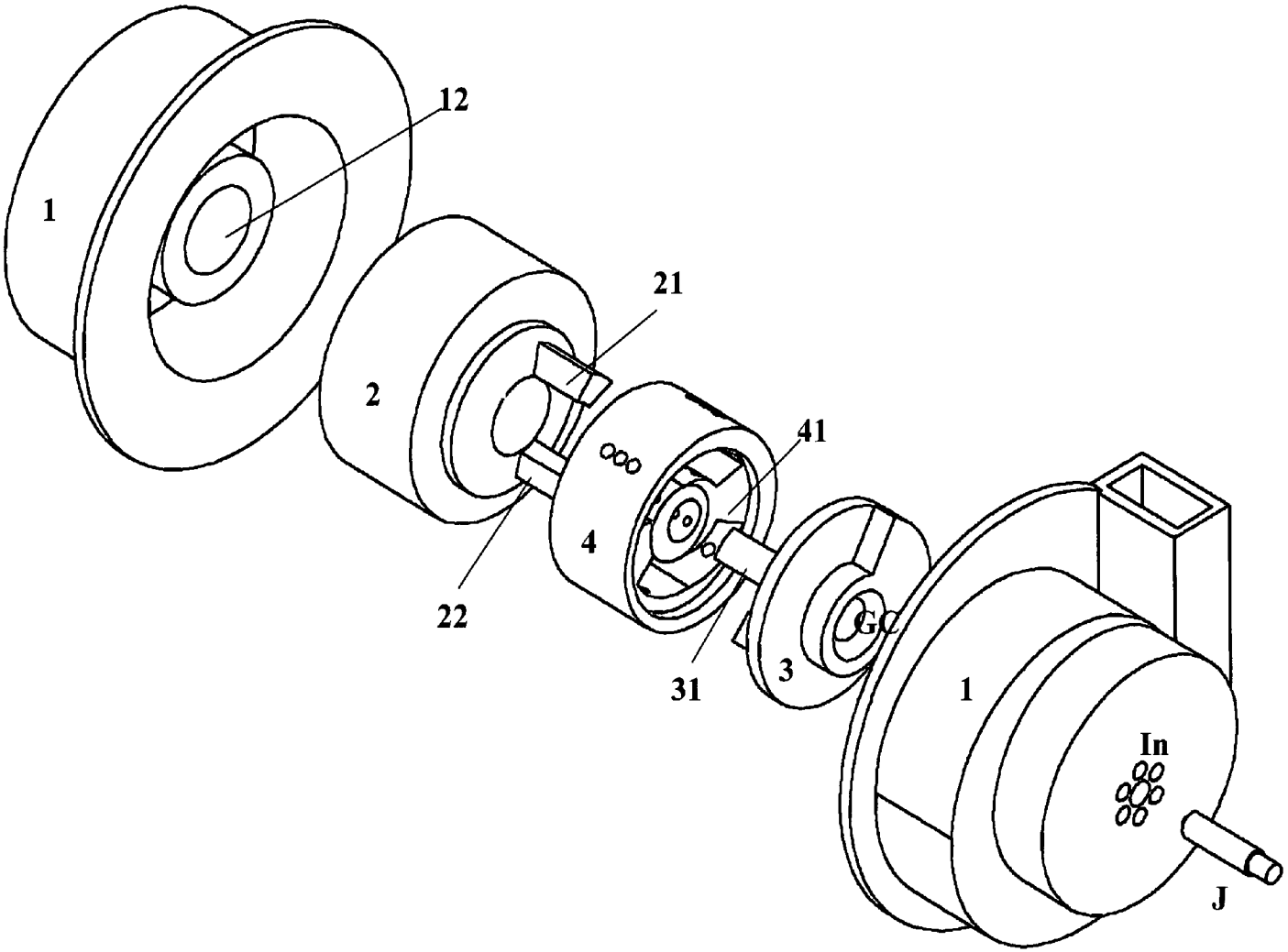

The mechanism of the rotary engine is schematically shown in FIG. 9*a*. Thus it is a deltoid-shaped four bar linkage. In the limiting case as the parameter m tends to infinity, we obtain the mechanism shown in FIG. 9*c*. The limiting case comprises three moving parts, namely two shafts: the "slow" shaft W and the "fast" shaft D, and the slider M. The slider M rotates relative the shaft D and executes reciprocating movement relative the shaft W. The distance between the rotation axes of the two shafts relative the body L equals the distance between the rotation axis of the shaft D relative body L and the rotation axis of the slider M relative shaft D. As the shaft W rotates (relative body L) with the (constant) rotational speed R, shaft D rotates relative the body with the rotational speed 2R, and the slider M rotates relative shaft D with the rotational speed −R. Thus the mechanism can be fully balanced by attaching to the shaft D a suitable counterweight balancing the centrifugal force generated by the elements D and M. Consequently, by choosing the parameter m large enough, we can almost perfectly balance the mechanism of the rotary engine shown in FIG. 9*a* attaching to the shaft D a suitable counterweight (the larger parameter m the closer is the mechanism to the limiting case of FIG. 9*c* and the better balance). (However, for the reasons that will be clarified below, in the design of the rotary engine producing 2 power strokes/revolution, I apply a different method for balancing the engine.)

In order to emphasize the resemblance of the problem of balancing our rotary engines to that of balancing of the ordinary piston ones I apply Observation 3 to the mechanism of the oscillating engine producing 2 power strokes per shaft revolution (I apply notation used in the discussion of kinetics of the rotary engine producing 6 power strokes per revolution and oscillating engine above). The alternative version of the oscillating engine mechanism is shown schematically in FIG. 9*b*. It is obtained from the mechanism shown in FIG. 9*a* by stopping the element W and letting the element L to rotate. In the limiting case as the parameter m tends to infinity we obtain the mechanism schematically shown in FIG. 9*d*. Alternatively, this last mechanism can be obtained from the mechanism shown in FIG. 9*c* by stopping the element W and letting the element L to rotate. Now, using Observation 3 (where I substitute A1:=W, Ai1:=D, Ai2=M, and Aj:=L), I conclude that the mechanism shown in FIG. 9*d* can be balanced by additionally attaching a counterweight M2 to the element L. Therefore, assuming the parameter m is sufficiently large, the mechanism of the oscillating engine shown in FIG. 9*b* can be balanced by additionally attaching a counterweight to the element L (now the engine shaft); again we have the rule that the larger parameter m the closer is the mechanism to the limiting case of FIG. 9*c* and the better balance.

Figure 28:
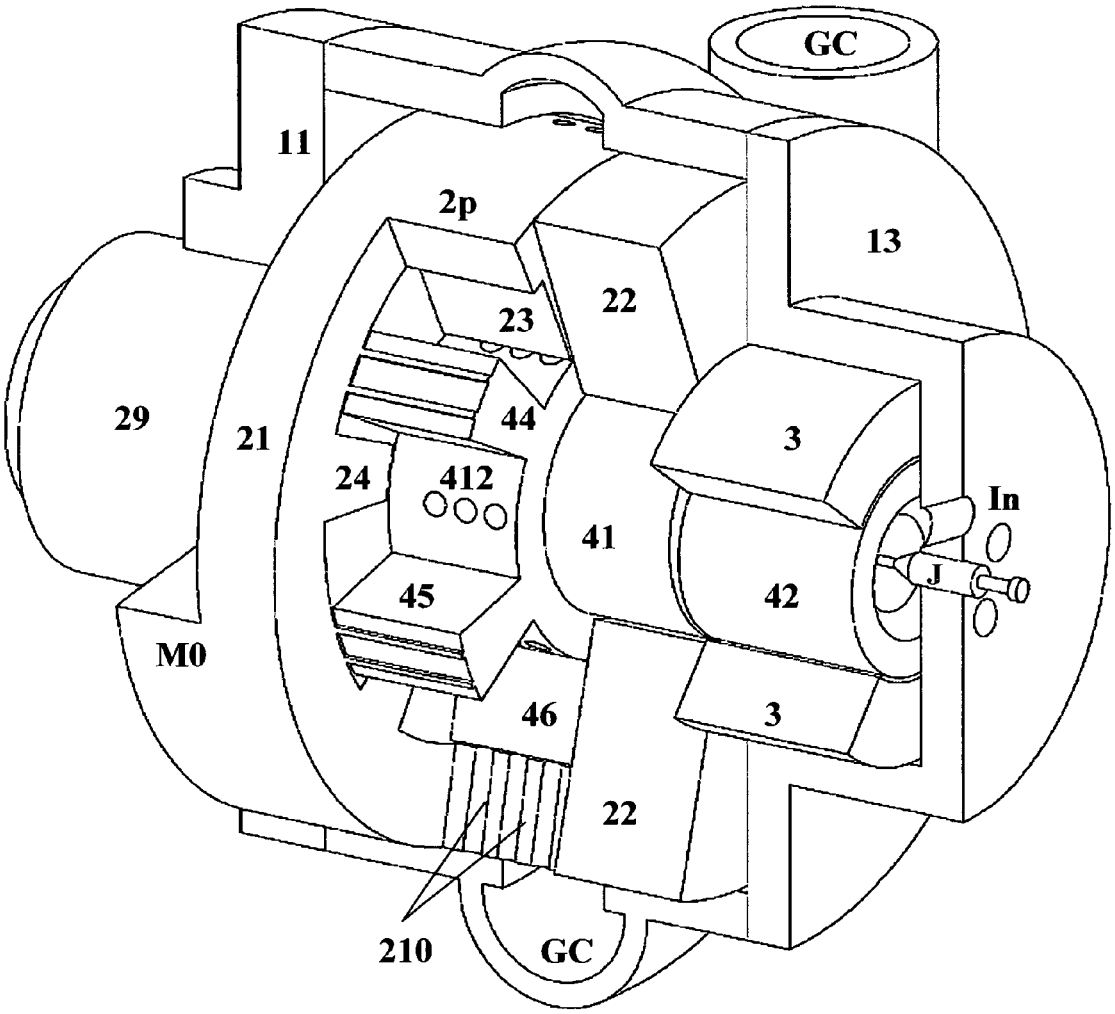
Figure 29:
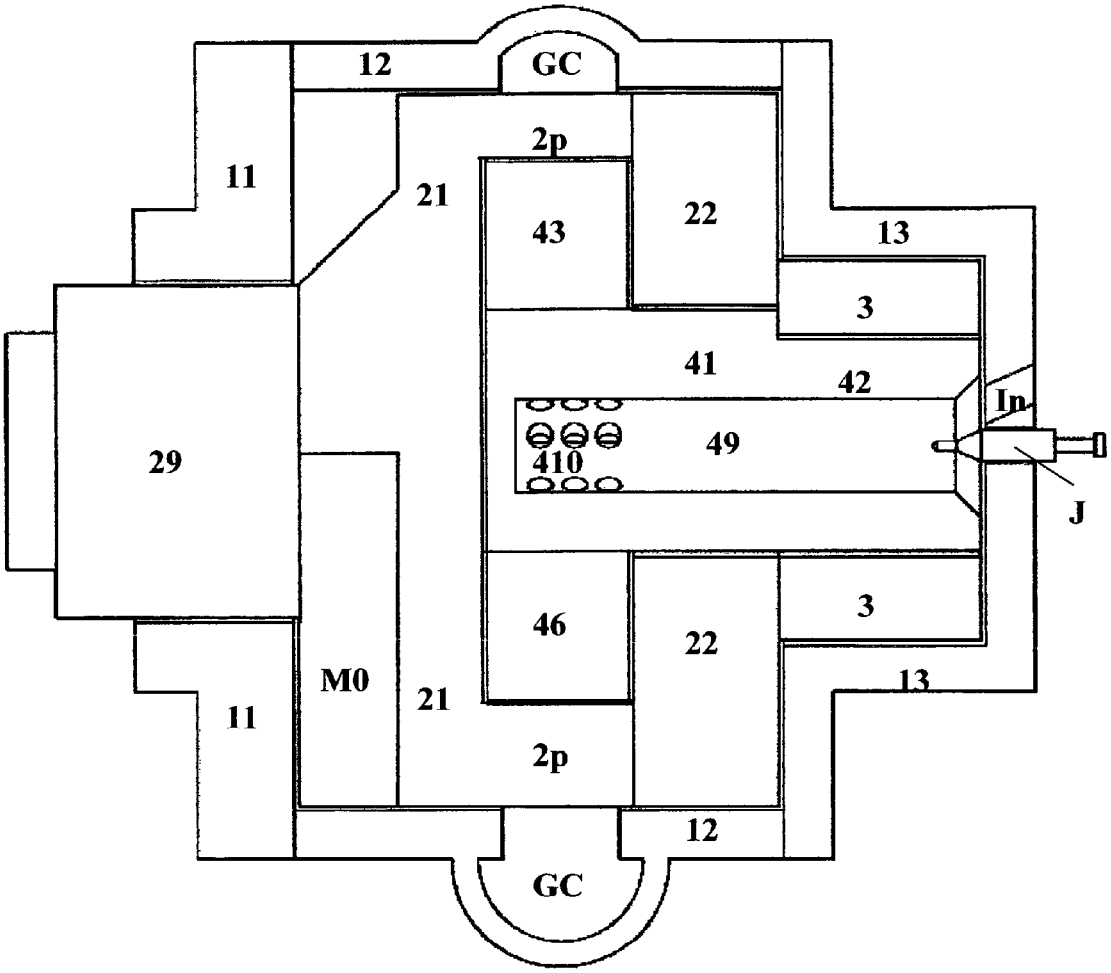
Figure 30:
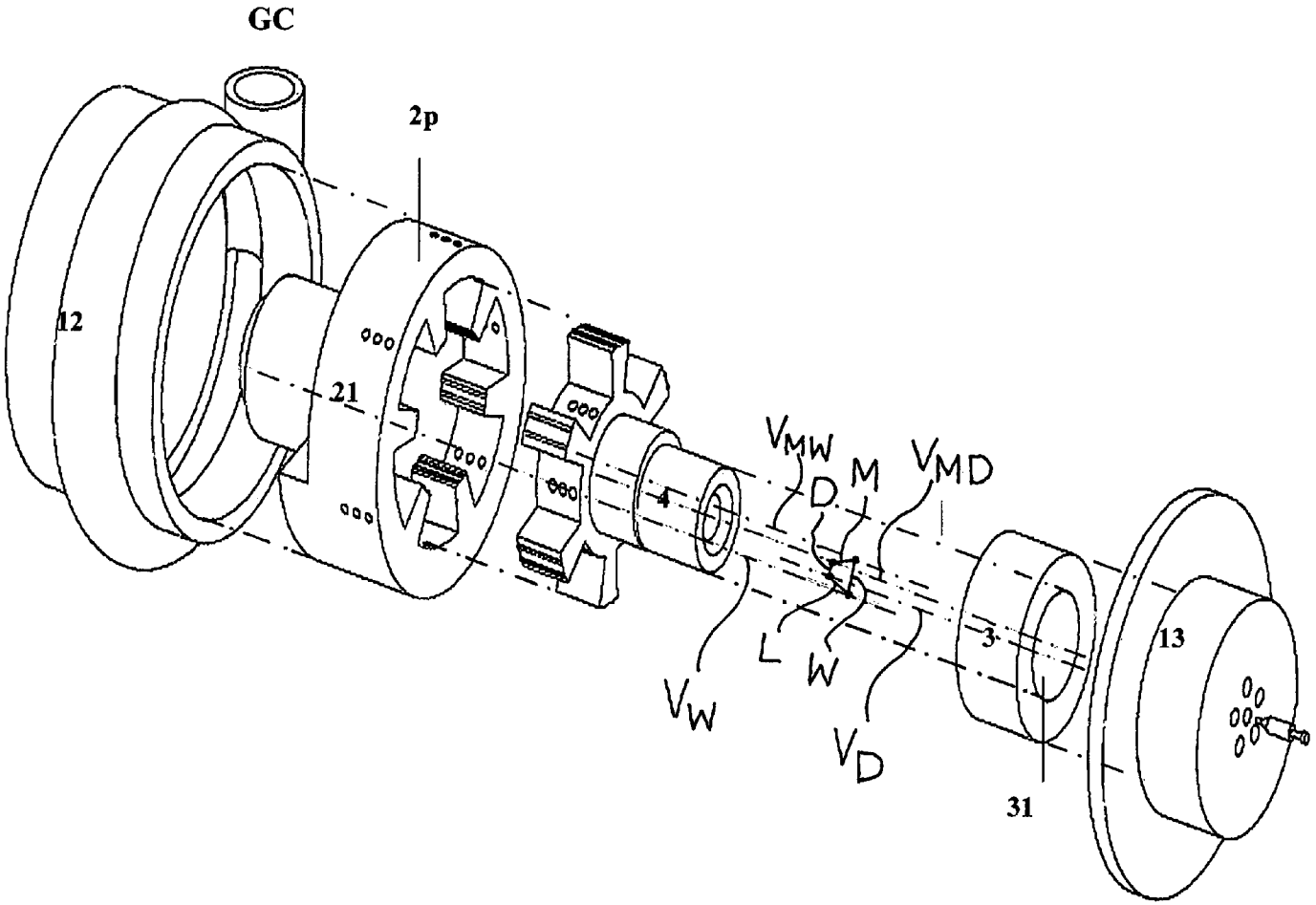
Figure 31:
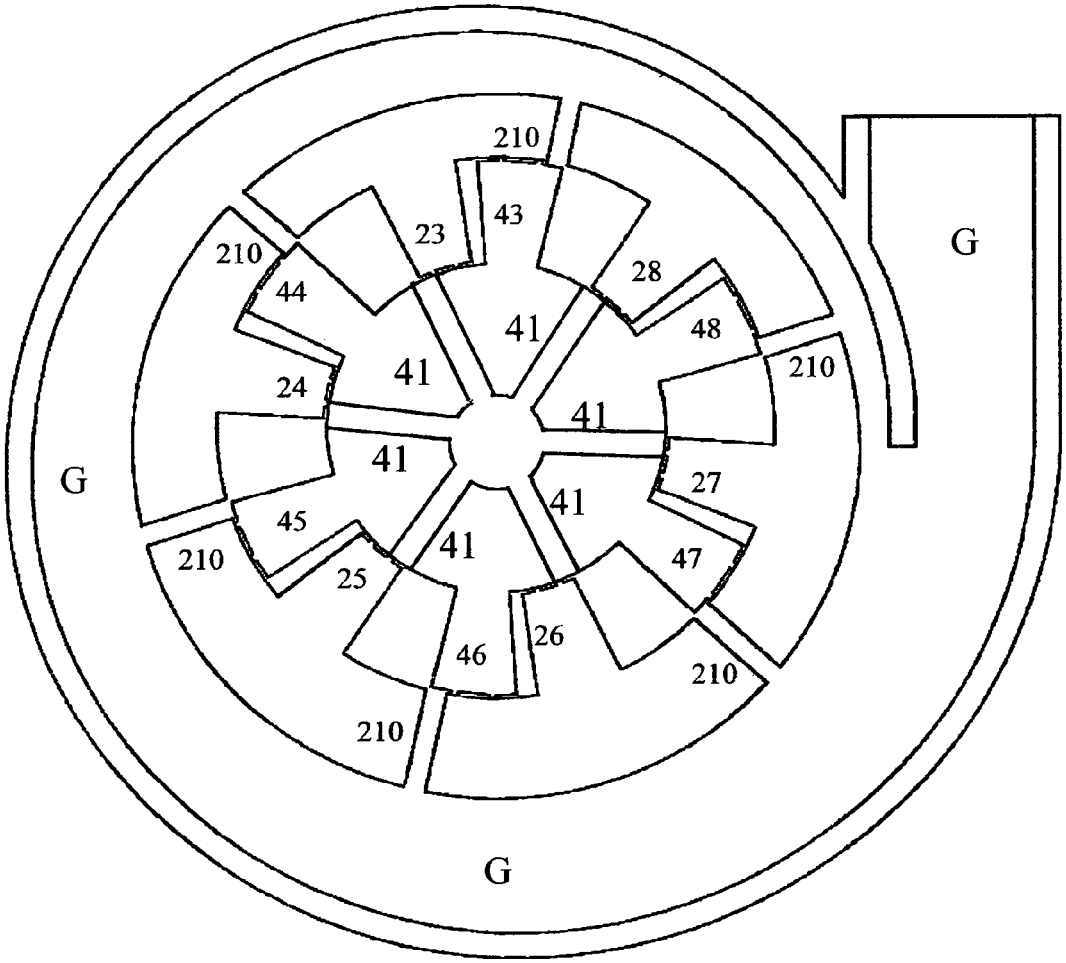
Figure 32:
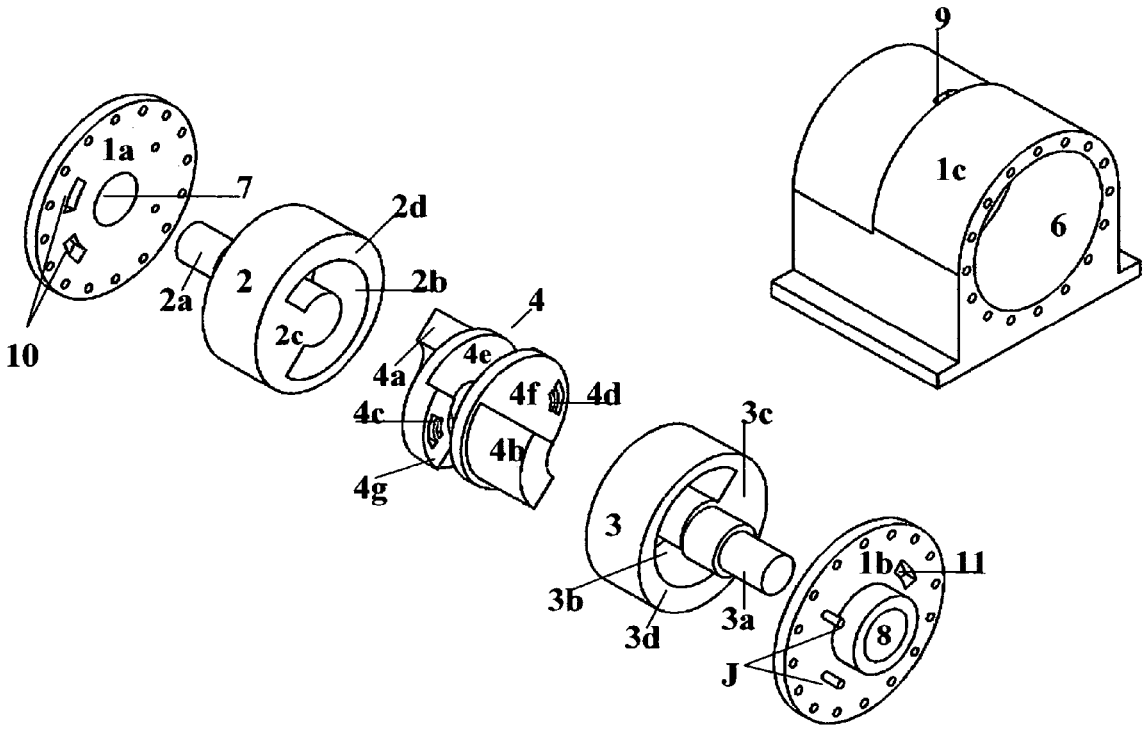
FIGS. 32-37 show another variant of the engine according to the invention producing 4 power impulses per shaft revolution. More specifically.
Figure 33:
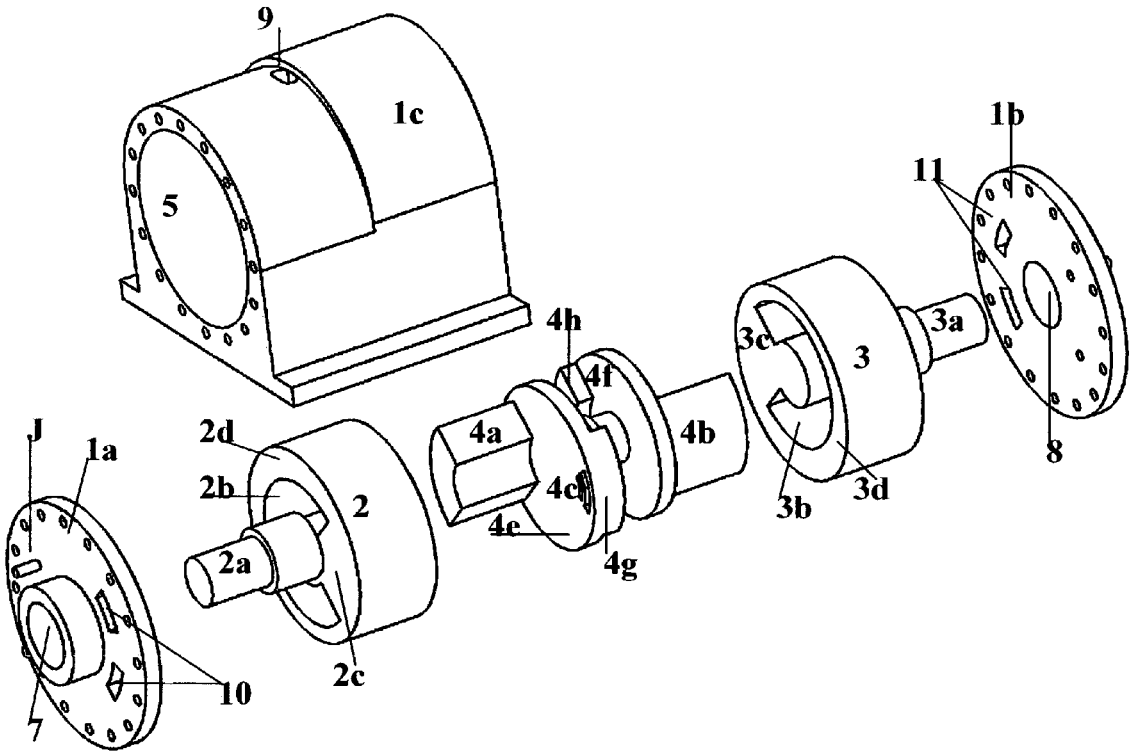
Figure 34:
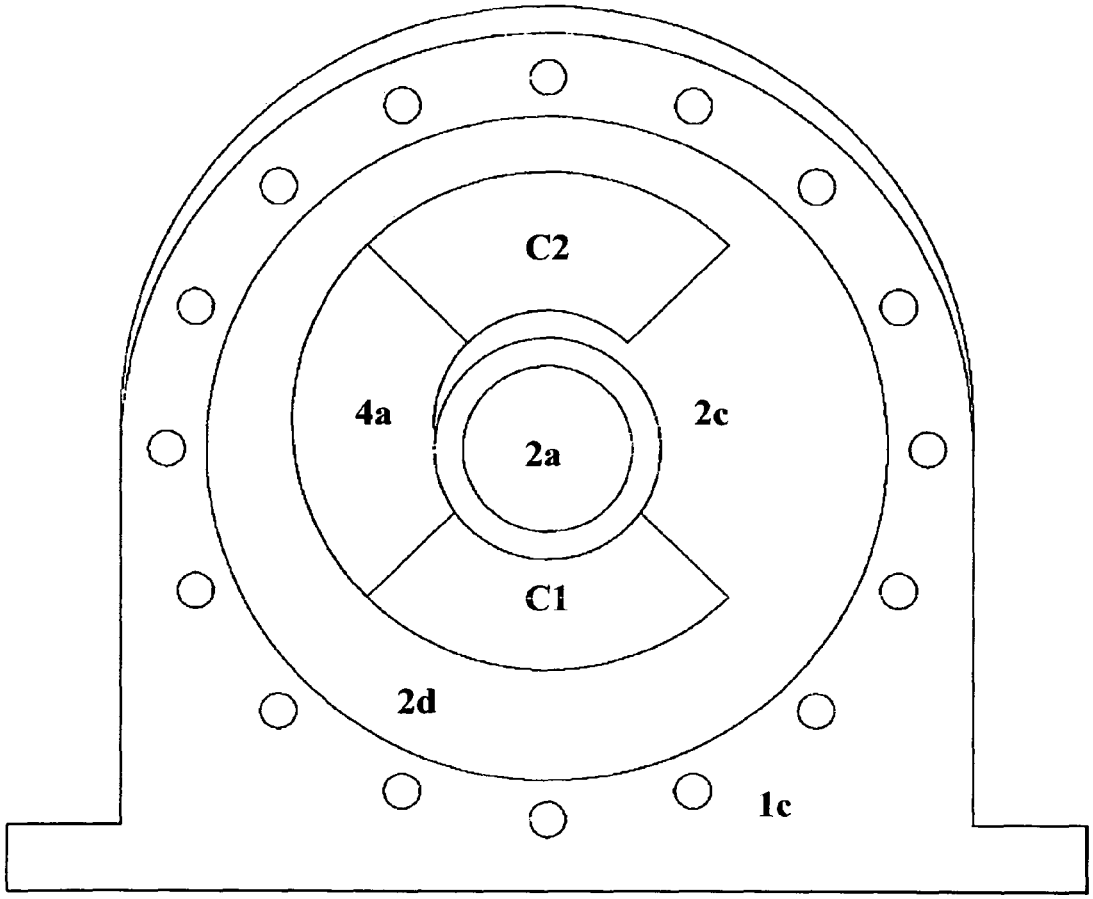
Figure 35:
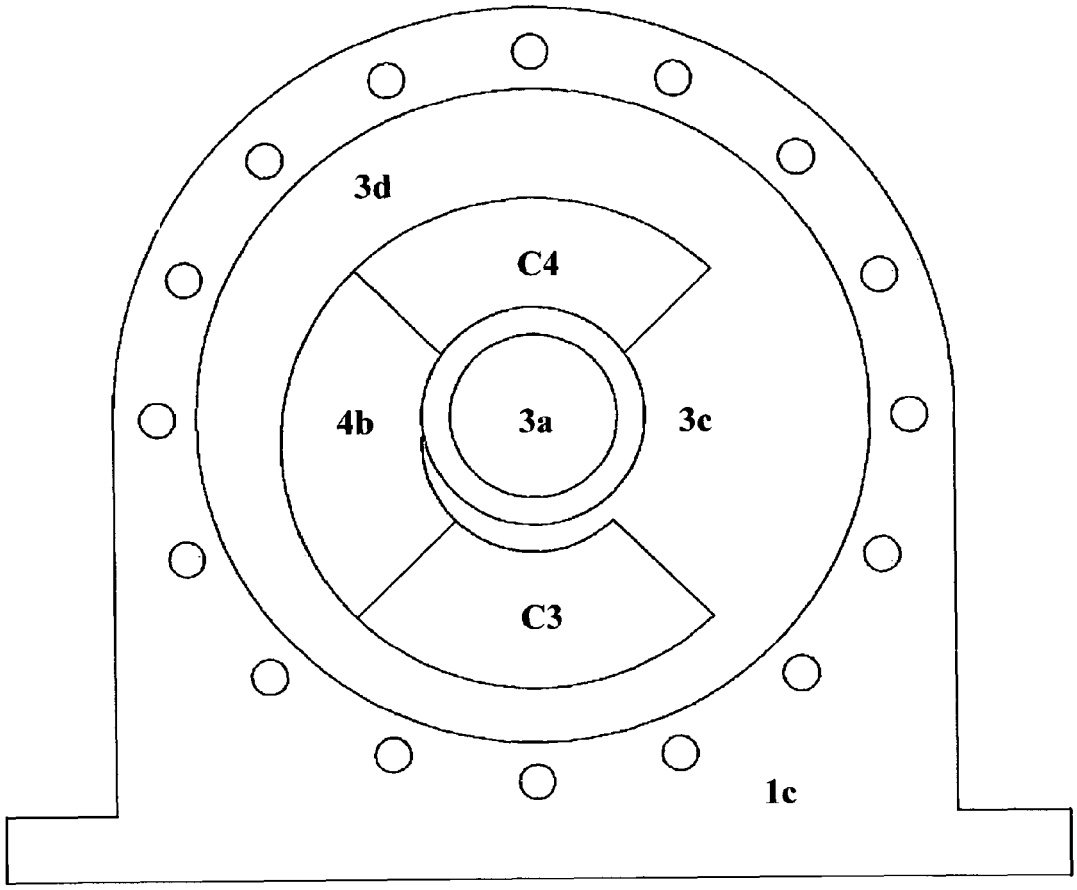
Figure 36:
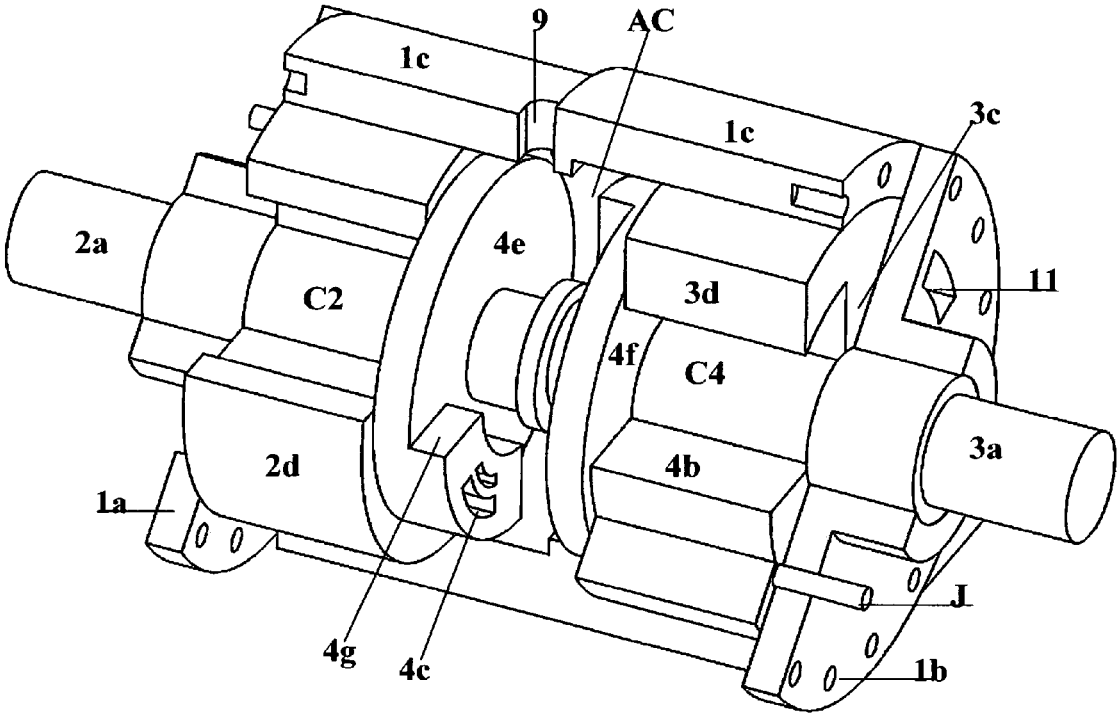
Figure 37:
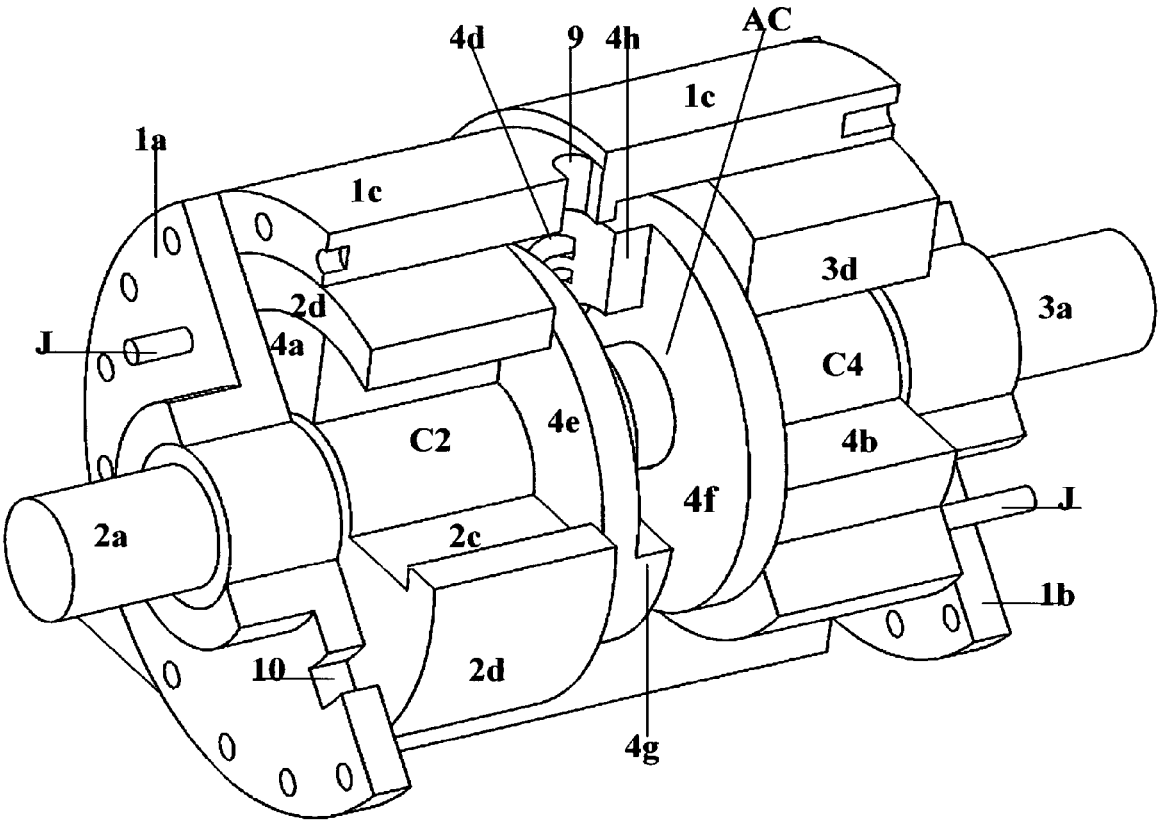
Figure 38:
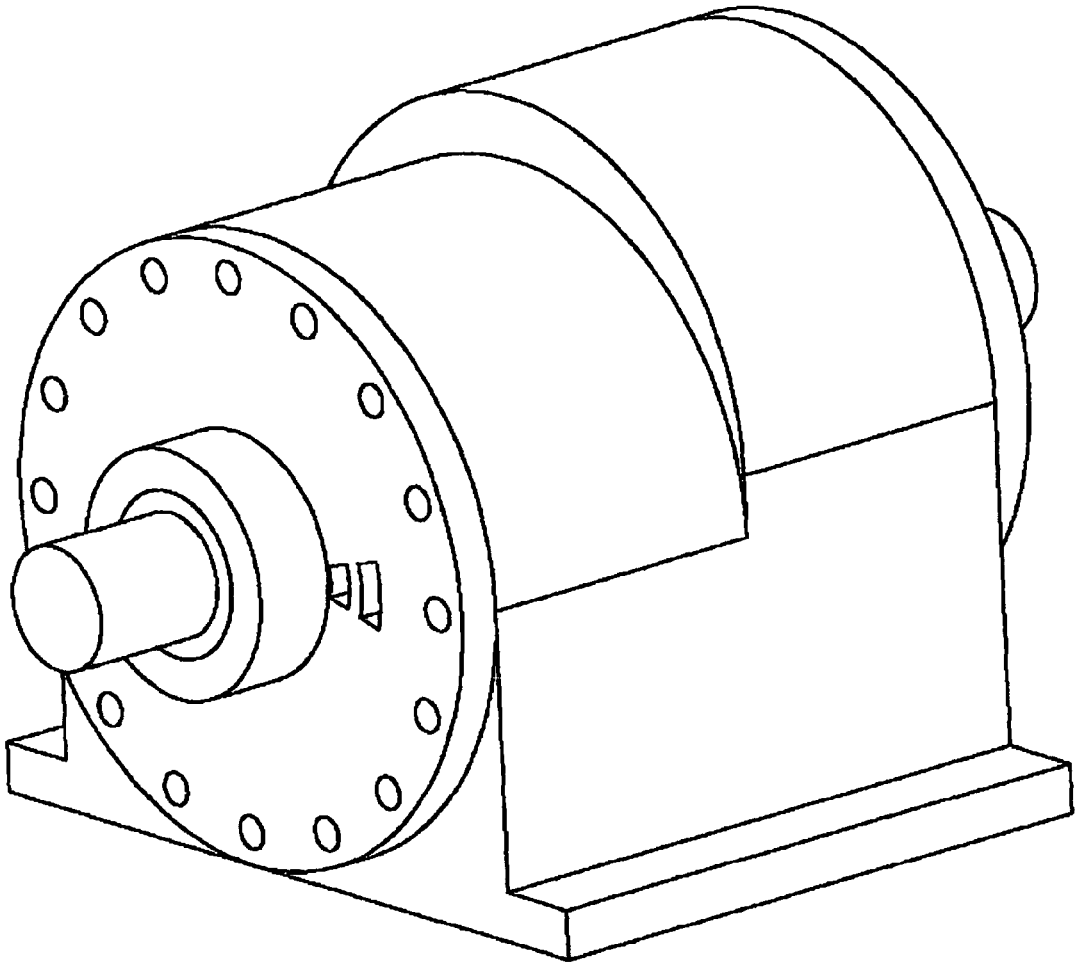
FIGS. 38-41 illustrate alternative shape of elements of the engine of essentially the same structure as that shown in FIGS. 32-37. More specifically.

Now I turn to the description of the rotary engine producing 2 power strokes per shaft revolution, and again I concentrate on the mechanical aspect of the design (let us indicate however that this is assumed to be a HCCI two-stroke engine, FIGS. 25-31). The engine utilizes a flat mechanism of the type described in the previous section, the kinetic scheme of which is shown in FIG. 9*a* above. Thus the engine has only three moving parts: W=2-the main (outboard) rotor, playing also the role of flywheel and forming a unique whole with the engine main shaft, M=4-an intermediate rotor, and D=3-an auxiliary eccentric, and only one kinetic couple, namely (W, M), is the "oscillating" one (all the other kinetic couples are rotary ones). The main rotor 2 and the auxiliary eccentric 3 are both supported rotationally in their respective bearings 112 and 133 in the parts 11 and 13 of the engine body 1. There are two main portions of the massive main rotor 2: "flywheel portion" 21 and a cover 22 (FIGS. 28-30). The "flywheel portion" 21 includes a massive pin (main shaft of the engine) 29, through which the main rotor is pivotally supported in engine's body through the bearing 112, and parts that contact hot gases produced during the engine work; these are six fins (or pistons) 23, . . . ,28 and a massive cylinder-shaped wall of combustion chambers, that is composed of a flat circular wall 211 carrying the main pin 29 at one side and the pistons at the other side, and an eccentric peripheral ring-shaped structure (wall) 2*p*, along the inner circumference of which are placed the pistons 23, . . . ,28. In the ring-shaped wall 2*p* there are radially-disposed hot gas passages and outlet ports 210 placed between the pistons 23, . . . ,28. The pistons 23, . . . ,28 and the ring-shaped peripheral wall 2*p* are placed eccentrically relative the pin 29 of the main rotor (the center of the whole assembly is the point of contact of the members W and M of the engine mechanism, see FIG. 9*a*). The massive "thick portion" M0 of the ring-shaped wall of the main rotor plays the role of the counterweight balancing the body force generated by the eccentrically placed assembly of the pistons 23, . . . ,28 and the intermediate rotor 4. The cover 22 in its central part has a bearing 221 supporting the intermediate rotor 4. It is fixed to the flywheel portion 21 using screws (not shown), and its principal role is to separate the combustion chambers from the rest of the engine (thanks to the presence of this cover, thrust bearings are not necessary in this engine).

Intermediate rotor 4 (FIGS. 28-30) has the general form of shaft of small diameter (in comparison with that of the main rotor), which makes its moment of inertia as small as possible (recall that minimizing the moment of inertia of the intermediate rotor is one of the main objectives of the present design). It is composed of two portions: the "hot portion" and the "cold portion". The circular "hot portion" carry six fins (or pistons) 43, . . . ,48 placed radially along its circumference. The "cold portion" has a massive pin 41 concentric with the circular "hot portion" and supported pivotally in the bearing 221 placed in the cover 22, and an eccentric 43 supported pivotally in a bearing 31 placed in the auxiliary eccentric 3. There is also a central circular air passage 49, and six assemblies of radially disposed air passages 410 placed between the pistons 43, . . . ,48. Confined by the (double-acting) pistons 23, . . . ,28 and 43, . . . ,48, the circular and ring-shaped wall 2*p* placed on the main rotor 2, cover 22, and the circular portion 41 of the intermediate rotor 4 there are twelve combustion chambers (see the commentary below). The whole mass of the intermediate rotor is assumed to be supported in the main rotor (which is very natural given the structure of the engine main parts), and is balanced by the counterweight M0.

Auxiliary eccentric 3 pivots in a bearing placed in engine's body, and has an eccentric bearing 31 supporting the intermediate rotor at its "cold" end (via the eccentric 43). Moment of inertia of the auxiliary eccentric is small in comparison with that of the main rotor.

The engine body is formed from three main pieces 11, 12, and 13. The two side pieces 11, 13 ("cold" pieces of the body) supports the main rotor 2 and the auxiliary eccentric 3 in their respective (radial) bearings. Placed in the "cold" side-piece 13 there is an air inlet port In and a fuel injector J; thus the fuel injector is placed in close proximity to the auxiliary eccentric, and is assumed to be driven by it. The central "hot" piece 12 of the body houses intermediate rotor 4 and "hot portion" of the main rotor. There is also a "turbine-type" spiral hot gases exhaust collector GC.

The large number of combustion chambers (FIG. 31) is related to a "small" "stroke" (movement of the pistons 43, . . . ,48 relative the pistons 23, . . . ,28), and I assume a "small" stroke of the pistons in order to make the engine well balanced (in order to maximize its rotational speed). In fact, the most natural way of balancing the engine (given specific structure of its main parts) is different than that described above. Namely, the centrifugal force produced by intermediate rotor 4 is balanced by the counterweight M0 placed on main rotor 2 rather than on the element 3, while the body force related to the non-constant rotational speed of the intermediate rotor and the auxiliary eccentric remains unbalanced, and the most natural way of minimizing this force (besides minimizing moment of inertia of these parts, which is assured by their above-described structure) is to make the piston stroke small enough. Thus there is a need for a large number of combustion chambers in order to keep the swept volume/total volume ratio as large as possible.

As was mentioned above, the engine mechanism comprises only one "oscillating" kinetic couple, namely the main rotor-intermediate rotor couple (all the other kinetic couples are rotational ones; the rotational speed (average) of auxiliary eccentric 3 is two times the rotational speed of the main rotor, see FIG. 9*a*), and the engine produces two power strokes per shaft revolution.

An important advantage that this engine shares with one of the two previous rotary ones is that only the useful (generating the driving torque) tangential component of the gas force is transferred to the engine running gear. The component of the gas force perpendicular to the axes of rotation of the rotors nullifies thanks to the symmetric placement of the combustion chambers that fire simultaneously (this feature the engine in question shares with the rotary engine producing 6 power strokes per revolution but not with the rotary engine producing 4 power strokes per shaft revolution (which is due to asymmetric structure of its main and secondary rotors)). This is an important advantage over the conventional piston engines, where the entire gas force produced at the beginning of the power stroke is transferred directly to the main and crank bearings, thus generating high loads that contribute nothing to the driving torque.

The engine, unlike the two previous ones, comprises no hot load bearing sliding components, thanks to the presence of massive "cold" pin on the intermediate rotor 4. Thus this two-stroke engine structure offers excellent constraints for the piston and sealing bars, quite unlike in the case of conventional two-stroke engines.

The construction of this rotary engine (like the two other ones) enables keeping the lubricating oil separate from the fuel and from mixing with the induction air.

Work of the engine (FIG. 31) is similar to that of the previous rotary engines. Thus the assembly of twelve combustion chambers is naturally divided into two sub-assemblies of six chambers each: as main rotor 2 rotates, volume of any combustion chamber of one sub-assembly increases and volume of any combustion chamber of the other sub-assembly decreases. As volume of one group of the combustion chambers approaches its maximum, the pistons open the outlet ports 210 placed at the peripheral ring-shaped portion 2*p* of main rotor 2 and hot low-pressure gases driven by centrifugal forces exit said combustion chambers, flow through the spiral collector GC, and are finally exhausted. Next, as volume of the combustion chambers still rises, the pistons open inlet ports placed at the "hot portion" of intermediate rotor 4. The fresh air, driven by centrifugal forces, enters the inlet port In placed at one of the "cold" side components of the engine body. Then fuel is injected into the air stream and homogeneous charge is produced in the central air passage 49 of intermediate rotor 4. The homogeneous charge passes through said central air passage, and enters six combustion chambers through the air passages 410 disposed radially in the "hot portion" of the intermediate rotor 4 displacing remaining hot low-pressure gases that exit through the outlet ports 210 placed at the peripheral ring-shaped portion 2*p* of main rotor 2; this is the scavenging. Next, as the rotors further rotate, volume of the combustion chambers decreases, the pistons close the inlet and outlet ports, and the homogeneous charge is compressed. As volume of the combustion chamber approaches its minimum, the homogeneous charge ignites and rapidly burns producing hot high-pressure gases. The gases expand producing useful power (received from the main rotor 2) and the whole process repeats. Next the whole process repeats with the two sub-assemblies of the combustion chambers subsequently interchanging their roles (in the one group of combustion chambers occurs the compression, while the other group generates the useful power).

4. Rotary Engine—4 Power Strokes Per Shaft Revolution (FIGS. 32-37)

This design provides another natural form of the rotary (or, more precisely, rotary-oscillating) 2-stroke piston engine utilizing the principal form of my flat mechanism (thus having only 3 moving elements) and producing 4 power strokes per revolution. Thus mechanism of this engine produces rotary-oscillatory motion of the "oscillator" 3 from rotary motion of the "shaft" 2.

This design incorporates new secondary ideas (mentioned in dependent claims), which are a specific configuration of the engine and specific shape of the engine parts, as well as specific scavenging system.

Thus the engine mechanism comprises 4 parts: body 1=L, "shaft" (main rotor) 2=W, oscillator (secondary rotor) 3=D and intermediate eccentric (intermediate rotor) 4=M. However the main rotor 2 and the secondary rotor 3 have precisely the same construction and the same kinetics and are mutually interchangeable. The main rotor 2 (respectively the secondary rotor 3) has main pin 2*a* (3*a*), eccentric hollow 2*b* (3*b*), double-acting piston 2*c* (3*c*) and external ring 2*d* (3*d*). The main rotor 2 (respectively the secondary rotor 3) pivots in the bearing 7 (8) and hollow 5 (6) placed in the engine body extreme part 1*a* (respectively 1*b*) and the central part 1*c*. There are external inlet ports 9 placed on the central part 1*c* of the engine body 1, and exhaust ports 10 and 11 placed on two extreme parts of the engine body 1*a* and 1*b*. There are two injectors J mounted in the extreme part 1*a* of the engine body similarly there are injectors J placed on the side element 1*a* of the engine body 1. Attached to the intermediate rotor 4 there are two double-acting pistons 4*a* and 4*b*. The intermediate rotor 4 has also two discs 4*e* and 4*f*; there are also internal inlet ports 4*c* and 4*d* placed on said discs and two counterweights 4*g* and 4*h* balancing body forces generated by the pistons 4*a* and 4*b* respectively. The piston 4*a* (respectively 4*b*) oscillates in the hollow 2*b* (3*b*) of the main rotor 2 (secondary rotor 3). Two pairs of opposed pistons 2*c*-4*a* and 3*c*-4*b*, external rings 2*d* and 3*d*, internal walls of the elements 1*a* and 1*b* of the engine body 1 and the discs 4*f* and 4*e* of the intermediate rotor 4 form the engine combustion chambers. Thus there are 4 "cylinders" C1, C2, C3, and C4 in this engine (which comprises only 3 moving parts) and the engine produces 4 power impulses for each full revolution of the shaft 2. The discs 4*e* and 4*f* bound also an air chamber AC placed in the central section 1*c* of the engine body 1.

Now a short description of the engine work follows. The main rotor 2 and the secondary rotor 3 rotate in the same direction (as the main rotor 2 rotates with a constant rotational speed v, the secondary rotor 3 rotates with non-constant rotational speed, the average value of which equals v) and the intermediate rotor 4 rotates and oscillates. Thus the two pairs of double-acting pistons 2*c*-4*a* and 3*c*-4*b* bound combustion chambers of changing volume inside of the hollows 2*b* and 3*b* respectively. The rotary motion of the main rotor 2 and the secondary rotor 3 governs opening and closing of exhaust ports 10 and 11 respectively. Proper phasing of opening/closing of the exhaust ports is assured by suitable geometry of the pistons 2*c*-4*a* and 3*c*-4*b*. The movement of the intermediate rotor pistons 4*a* (4*b*) relative the main rotor piston 2*c* (respectively the secondary rotor piston 3*c*) in the relevance system of the main rotor 2 (respectively secondary rotor 3) is just the oscillating movement. Opening and closing of the internal inlet ports 4*c* and 4*d* are governed by the oscillating movement (relative the intermediate rotor 4) of pistons 2*c* and 3*c* respectively. Air flows through the external inlet ports 9 and enters the air chamber AC and further enters the engine combustion chambers via internal inlet ports 4*c* and 4*d* displacing hot low-pressure gases that exit the combustion chambers through said exhaust ports 10 and 11. The engine executes ordinary 2-stroke Diesel cycle in each of its 4 combustion chambers during each revolution of its "shaft" 2.

Power can be received from either the main rotor 2 or the secondary rotor b. A flywheel should be attached to the "power-output element" to minimize rotary speed fluctuation. Alternatively the element intended for receiving power could be formed to have greater moment of inertia than the other revolving element.

This engine, like the other engines of the present patent application, features extraordinarily compact and robust structure and large swept volume/total engine volume ratio, by far exceeding in these aspects other rotary engines utilizing toothed wheels to transfer the movement from pistons to engine's shaft (see for example publication WO9618024). An important advantage of this engine (as well as those described above) over other known rotary engines, including Wankel, is that the average relative speed of the engine hot parts bounding engine's working chambers (namely the intermediate rotor 4 and both the rotors 2 and 3) is low, comparable to that of the piston relative the cylinder of conventional engines. (This is due to the fact that the rotor 4 executes the oscillating motion relative any of the rotors 2, b, and large rotational speed of the engine rotors (and hence large number of cycles per minute) can be combined with small speed of said rotor 4 relative both said rotors 2 and 3 by diminishing "stroke" (angle of oscillation) of the rotor 4 relative the rotors 2 and 3 (this in turn can be obtained by choosing suitable geometry of the engine mechanism). Therefore wear of engine's moving parts, including sealing, is comparable to that of components of conventional piston engines and much smaller that in other rotary engines. Moreover, diminishing the stroke of the engine pistons does not necessarily causes diminishing of the engine swept volume, as like in the case of the previously-described engine, a larger number of pistons may be attached to the rotor 4 and rotors 2 and 3 thus increasing the number of engine's working chambers.

5. Rotary Engine—4 Power Strokes Per Shaft Revolution (FIGS. 38-41)

Figure 39:
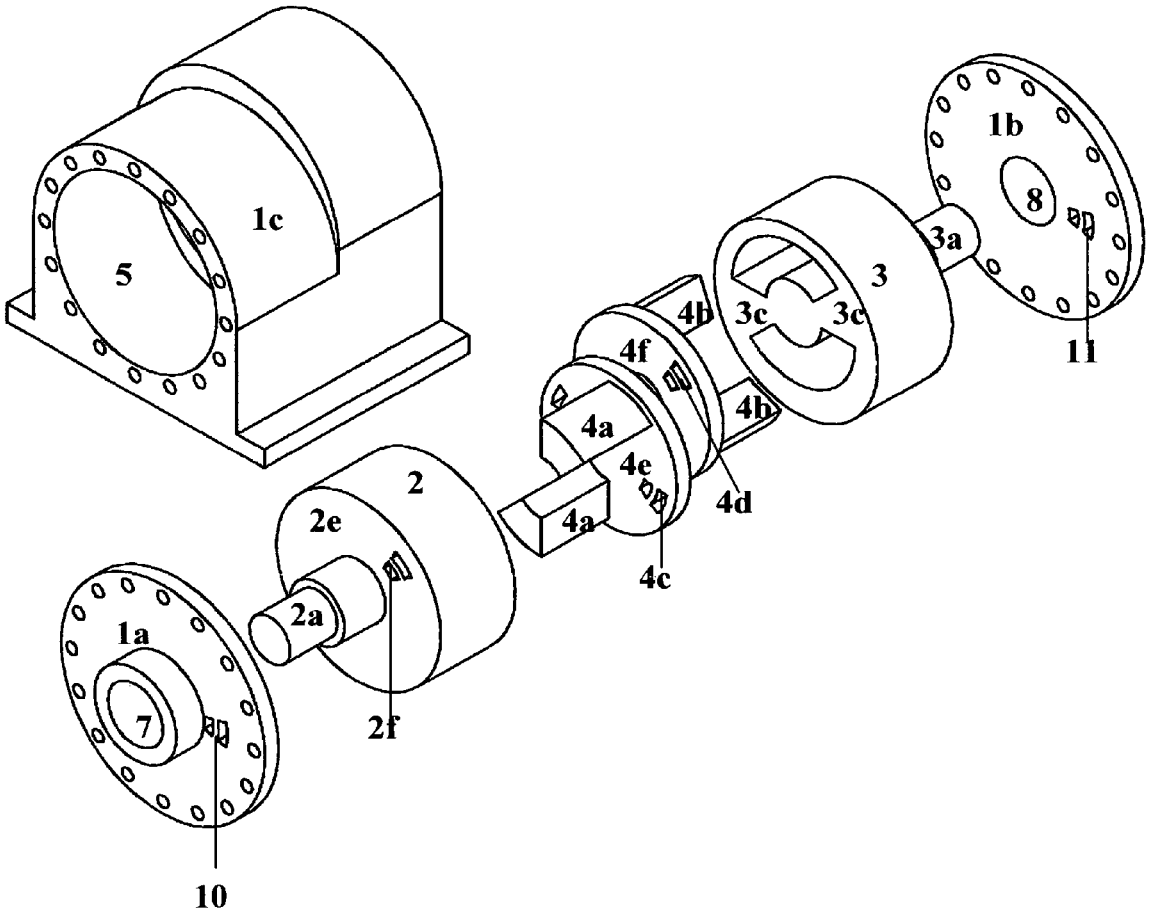
Figure 40:
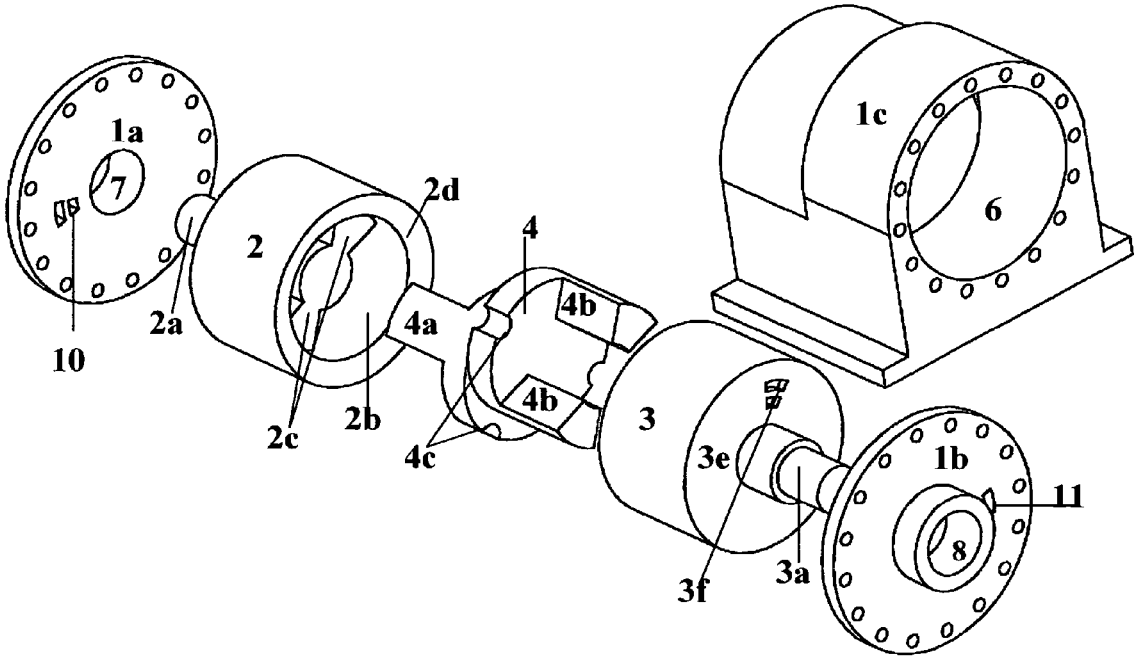
Figure 41:
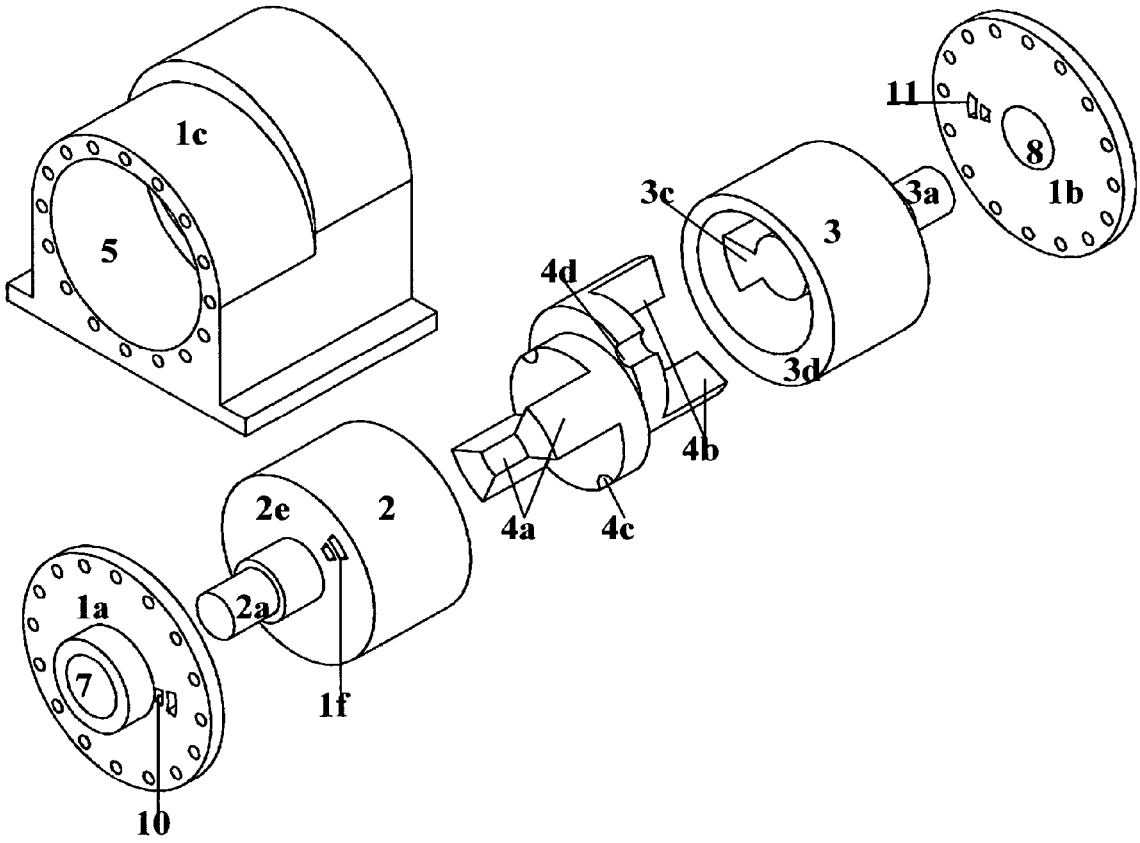
Figure 42:
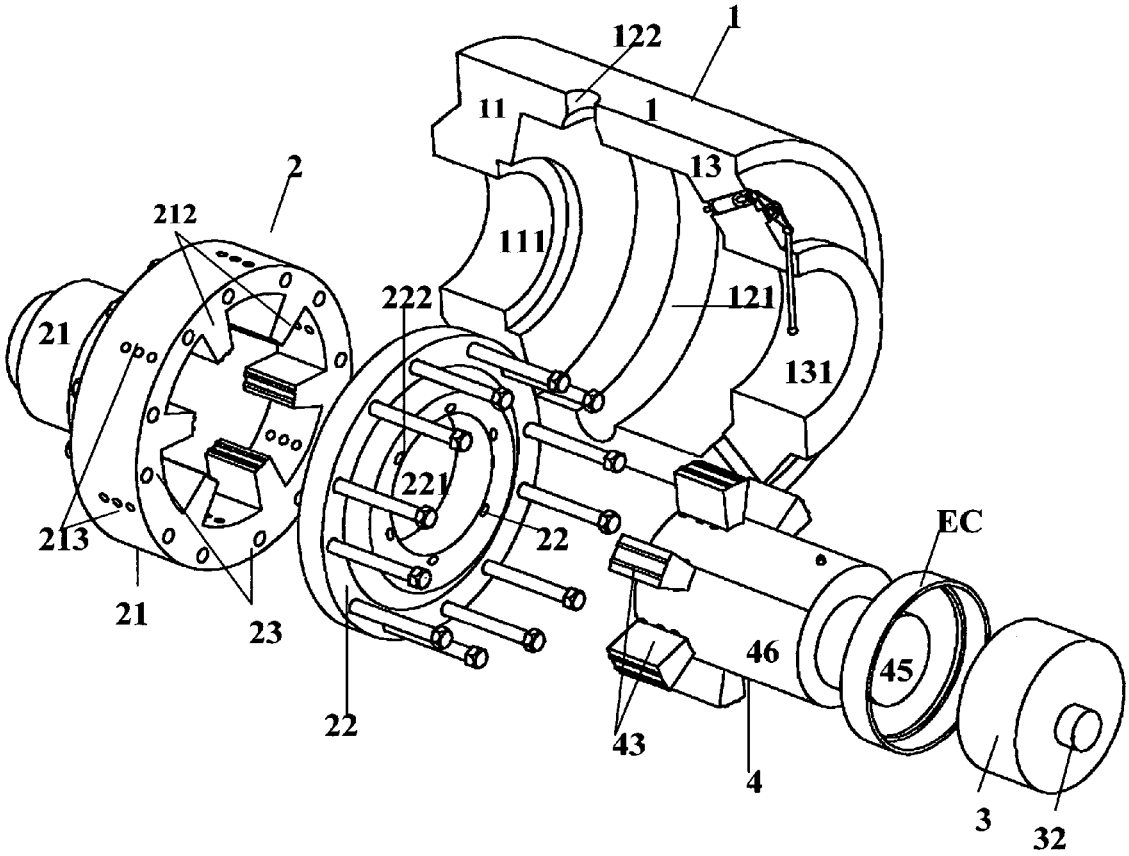
FIGS. 42-48 show 2-stroke rotary positive displacement detonation engine (PDDE). More specifically.
Figure 43:
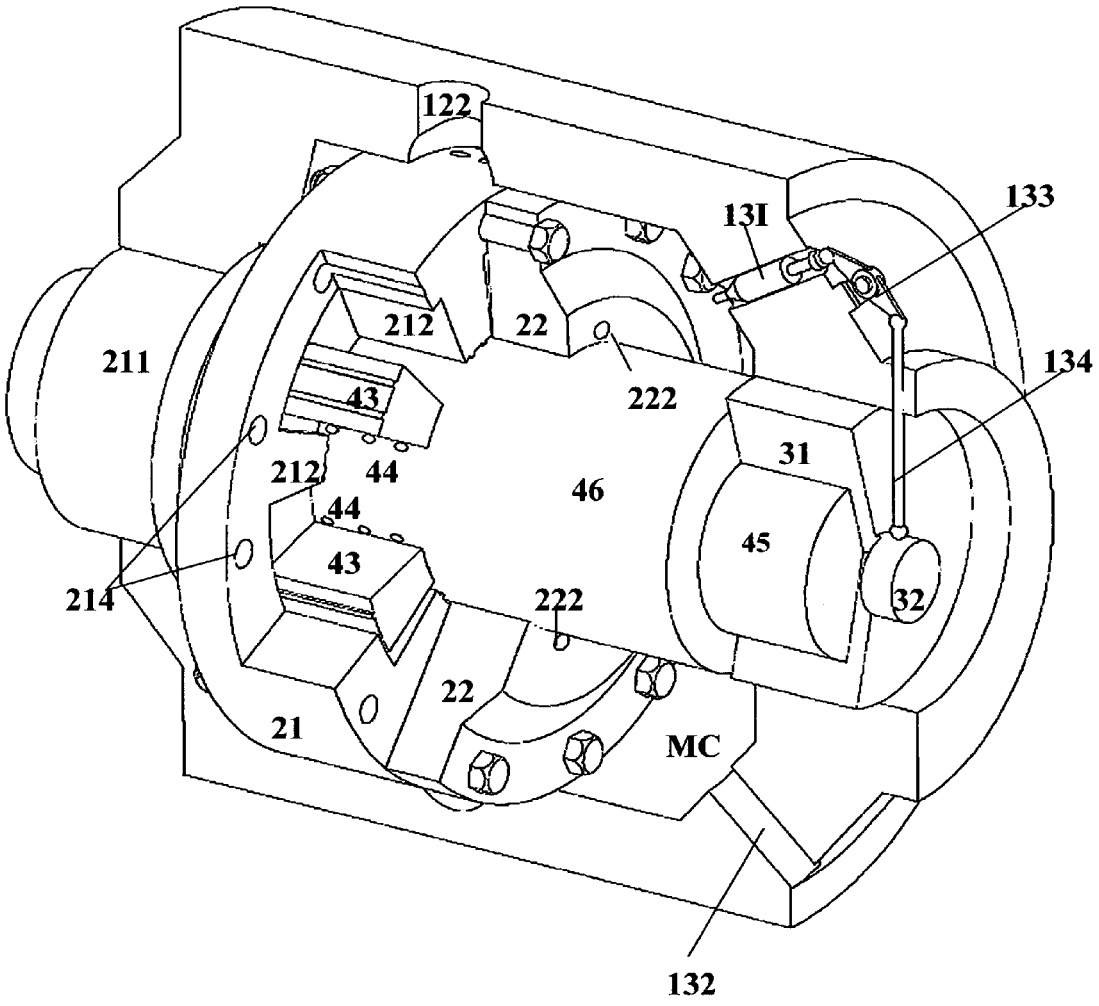
Figure 44:
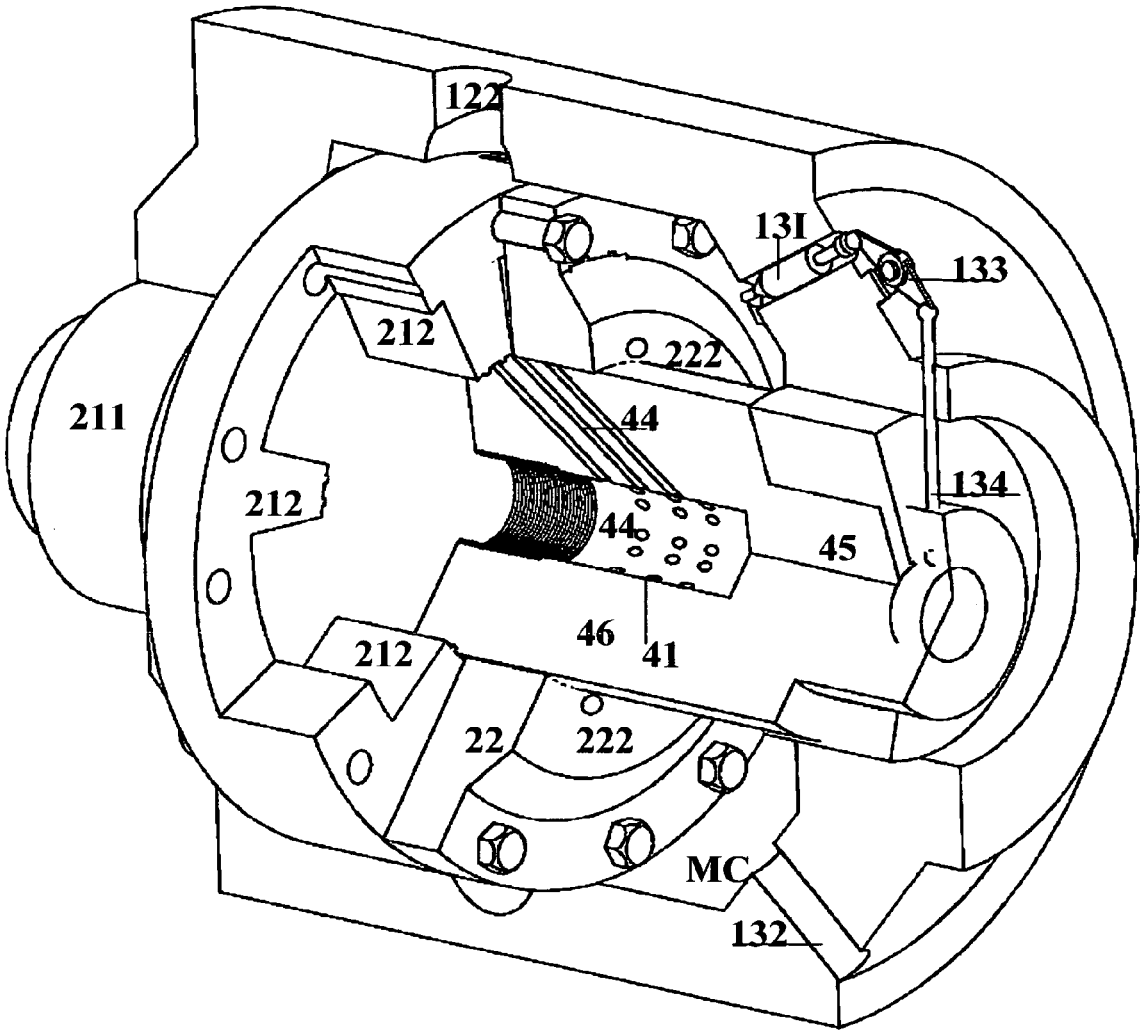

This is just a variant of Design 4 with identical kinetics and general layout but differently shaped elements (two variants of the engine elements are depicted in FIGS. 39 and 40-41). The changes (in comparison with the Design 4) are intended to further increase the swept volume/total volume ratio, decrease "stroke" (relative movement) of the engine pistons and improve balance of the engine. Thus both the main rotor 2 and the secondary rotor 3 are equipped with two double acting pistons 2*c* and 3*c* respectively and the intermediate rotor 4 has two assemblies of double-acting pistons 4*a* and 4*b* on each of its two ends. Consequently, the engine has 8 "cylinders" (combustion chambers) but still 4 power impulses per revolution. The main rotor 2 and the secondary rotor 3 are both equipped with walls 2*e* and 3*e* respectively. There are two internal exhaust ports 2*f* and 3*f* placed on the walls 2*e* and 3*e* of the main rotor 2 and the secondary rotor 3 respectively. Outer exhaust ports 10 and 11 are placed on the two extreme parts of the engine body 1*a* and 1*b* respectively. There are external inlet ports 9 placed on the central part of the engine body 1 and internal inlet ports 4*c* and 4*d* placed on the intermediate rotor 4. The movement of the intermediate rotor pistons 4*a* (respectively 4*b*) relative the main rotor pistons 2*c* (respectively the secondary rotor piston 3*c*) in the relevance system of the main rotor 2 (respectively secondary rotor 3) is just the oscillating movement. Unlike in the engine of the previous design, where rotary movement of the main rotor 2 and secondary rotor 3 is utilized to govern the opening and closing of outlet ports, opening and closing of both the internal exhaust and inlet ports are now exclusively governed by the oscillating movements of pistons. To be more precise, opening/closing of the exhaust ports 2*f* (respectively 3*f*) is governed by pistons 4*a* (respectively 4*b*), and opening/closing of the inlet ports 4*c* (respectively 4*d*) is governed by pistons 2*c* (respectively 3*c*). Air enters the air chamber placed in the central part 1*c* of the engine body through the external inlet ports and then enters the engine combustion chambers via internal inlet ports 4*c* and 4*d*. Hot low-pressure gases flows through the internal exhaust ports 2*f* and 3*f* and further via external exhaust ports 10 and 11 to atmosphere. Such arrangement of the engine is required to provide adequate opening/closing moments of inlet and outlet ports for all the engine combustion chambers, since to each revolution of the main rotor 2 there corresponds one full oscillation of the intermediate rotor 4 (relative the main rotor 2), and similarly for the secondary rotor 3.

Power can be received from either the main rotor 2 or the secondary rotor 3. A flywheel should be attached to the "power-output element" to minimize rotary speed fluctuation. Alternatively the element intended for receiving power could be made to have greater moment of inertia than the other revolving element.

6. Rotary Positive Displacement Detonation Engine (FIGS. 42-48)

This is a rotary-oscillating 2-stroke positive displacement detonation engine with main combustion chamber common for all engine's working chambers ("cylinders"). The principal aim of the design is two-fold: for the first to provide a mechanical structure of the engine capable to cope with extremely high mechanical loads met with in detonation engines, and for the second, to provide a rational combustion system for detonation engines, particularly an effective method of diminishing maximum mechanical loads and gradients of gas forces (understood as function of time).

General layout of the engine is similar to that of the engine 3, however this design incorporates a different scavenging system (which is dictated by the presence of common centrally placed combustion chamber) and therefore some elements are differently shaped.

Kinetics of the engine's mechanism is precisely as that of the engine 3. Thus the engine comprises only three major moving parts and its mechanism produces rotary motion of the main rotor 2 and rotary-oscillating motion of the eccentric 3 from oscillating motion of the intermediate rotor 4 relative the main rotor 2, and average rotational speed of the element 3 is 2 times the rotational speed of the element 2. The intermediate eccentric 4 oscillates relative the main rotor 2 and oscillates relative the eccentric 3, and executes compound planetary-oscillating movement relative the engine body 1.

The engine produces two power impulses per each revolution of its shaft 2. There is no separate camshaft and the engine, like the engines 1-5, does not require separate scavenging pump. The engine is arranged so as to minimize mass forces and shaft's rotational speed fluctuations, and to avoid mechanical loads to be transferred by engine's hot kinetic pairs (like the pair piston-cylinder in conventional engines). Moreover, an important advantage of the engine over other rotary engines, including Wankels, is that relative speed of engine's hot parts, namely engine's pistons and "cylinders", is comparable to that in conventional engines, and much smaller than in other rotary engines. Thanks to this feature, both the friction loses and wear of the engine parts are much smaller than in other rotary engines, thus the engine overall efficiency and durability is higher. Another important advantage of this rotary engine is its exceptionally effective scavenging/self supercharging system similar to that of the designs 1-5, which would provide the engine with exceptionally good power and torque characteristic. To be more precise, unlike in conventional engines, effectiveness of scavenging and self-supercharging of the engine with this scavenging/self supercharging system increases as rotational speed increases, thus power of the engine is progressive, i.e. rises faster than engine's rotational speed.

There is a new secondary idea behind the design, which concerns its specific combustion system, namely this is a rotary-oscillating detonation engine with main combustion chamber common for a group of (in particular all) working chambers of the engine (see a more detailed description below).

Engine's body 1 (FIGS. 42, 45, 46) consists of three parts 11, 12 and 13. In part 11 there is a bearing 111, which supports engine's shaft 2, and in part 13 there is a bearing 131 supporting engine's oscillator 3, low-pressure injector 131, inlet port 132 and assembly of rocking lever 133 and pushing rod 134, which drive the injector. In the central part 12 there is a circular gas passage 121 and exhaust port 122. Inside engine's body 1 there is a mixing chamber MC, destined for premixing air and fuel and preparing homogeneous charge. In proximity to the mixing chamber MC there is a circular conductor EC (FIG. 45) connected with a generator with the help of the cable (not shown).

The main rotor 2 (see FIGS. 45, 47) consists of two components 21 and 22. Part 21 is equipped with main pin 211, assembly of six double-acting pistons 212 and gas passages 213. Part 22 is equipped with bearing 221 (placed eccentrically relative the axis of rotation of the main rotor relative engine's body), which support intermediate rotor 4, and six air passages 222. Both the parts 21 and 22 are joined with the help of screws 23, which pass through screw apertures 214.

Figure 45:
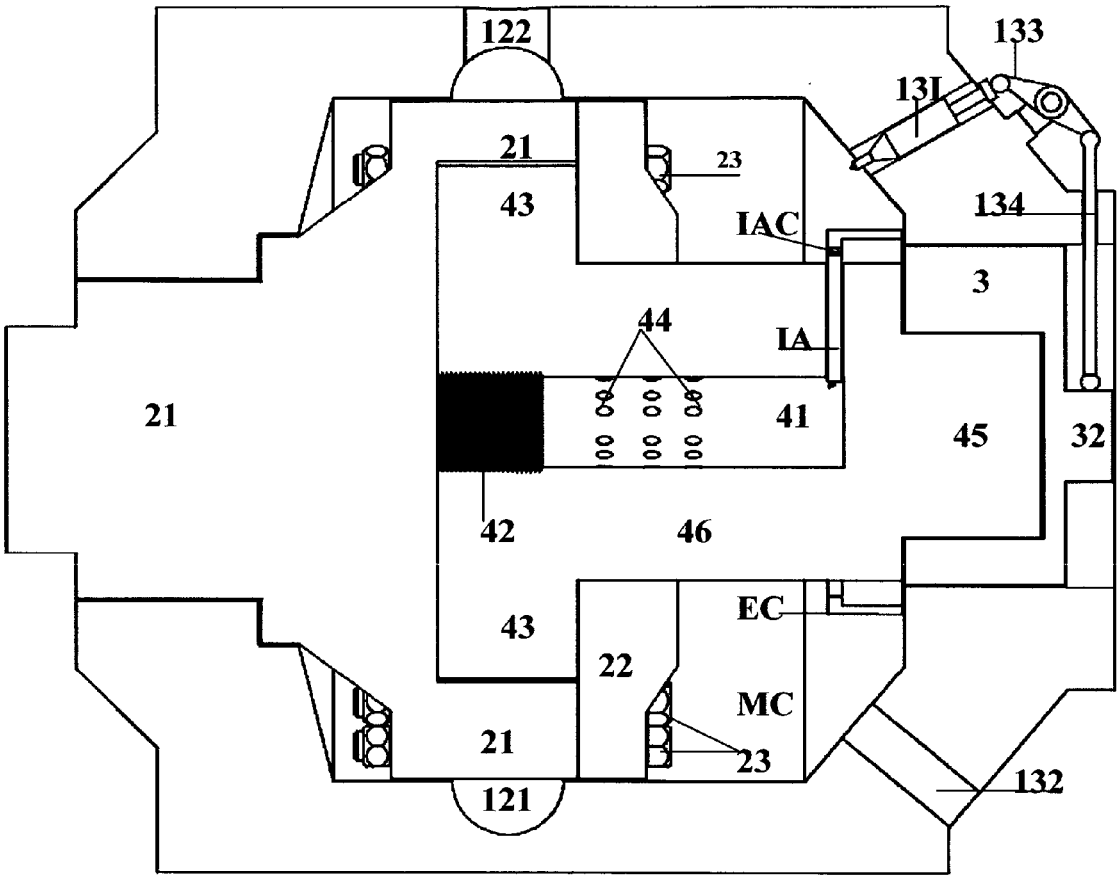
Figure 46:
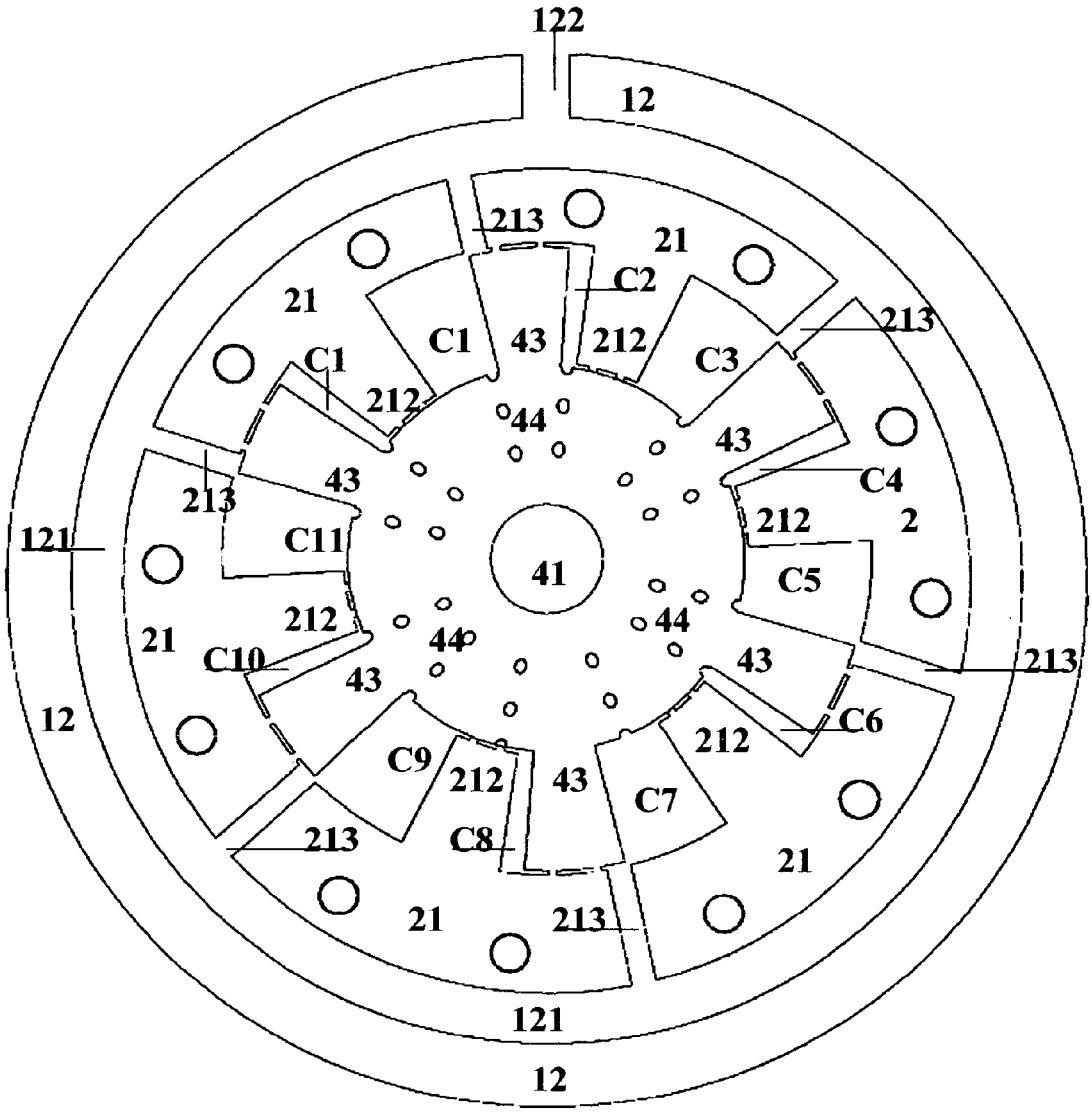
Figure 47:
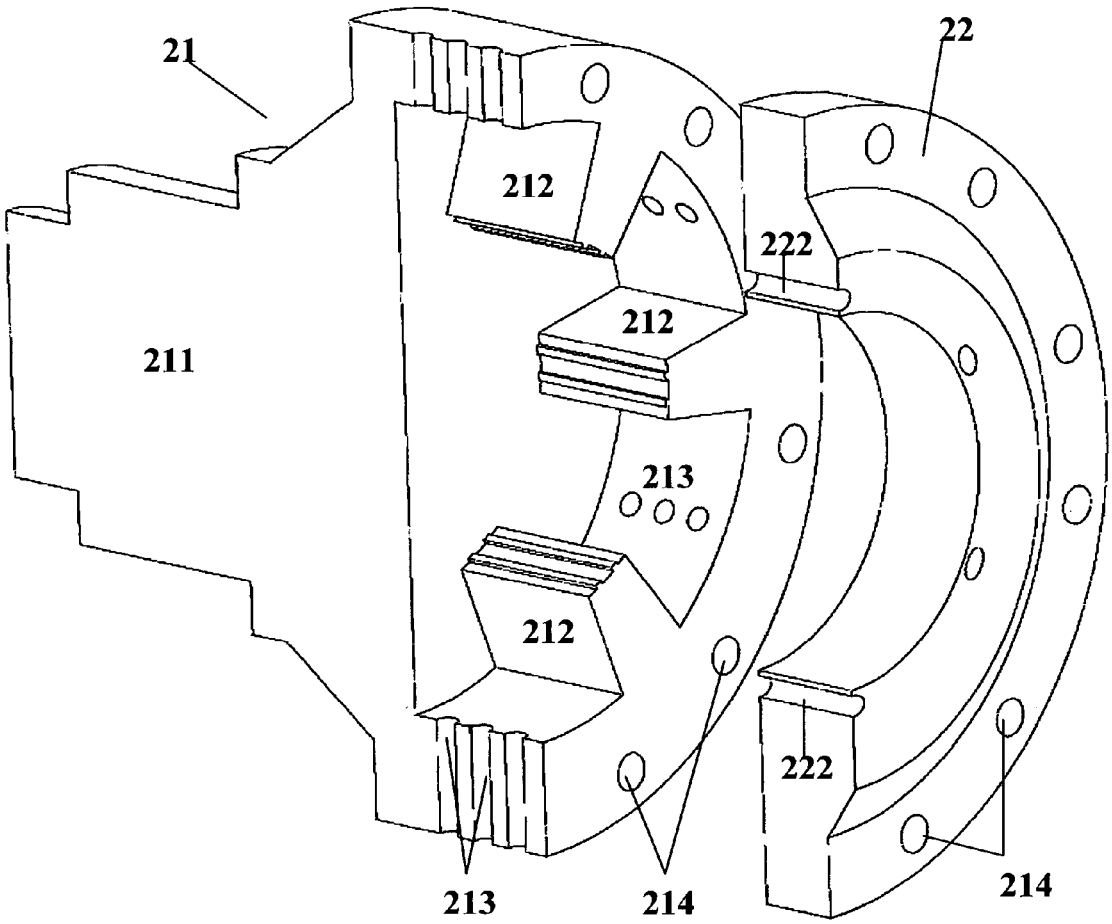
Figure 48:
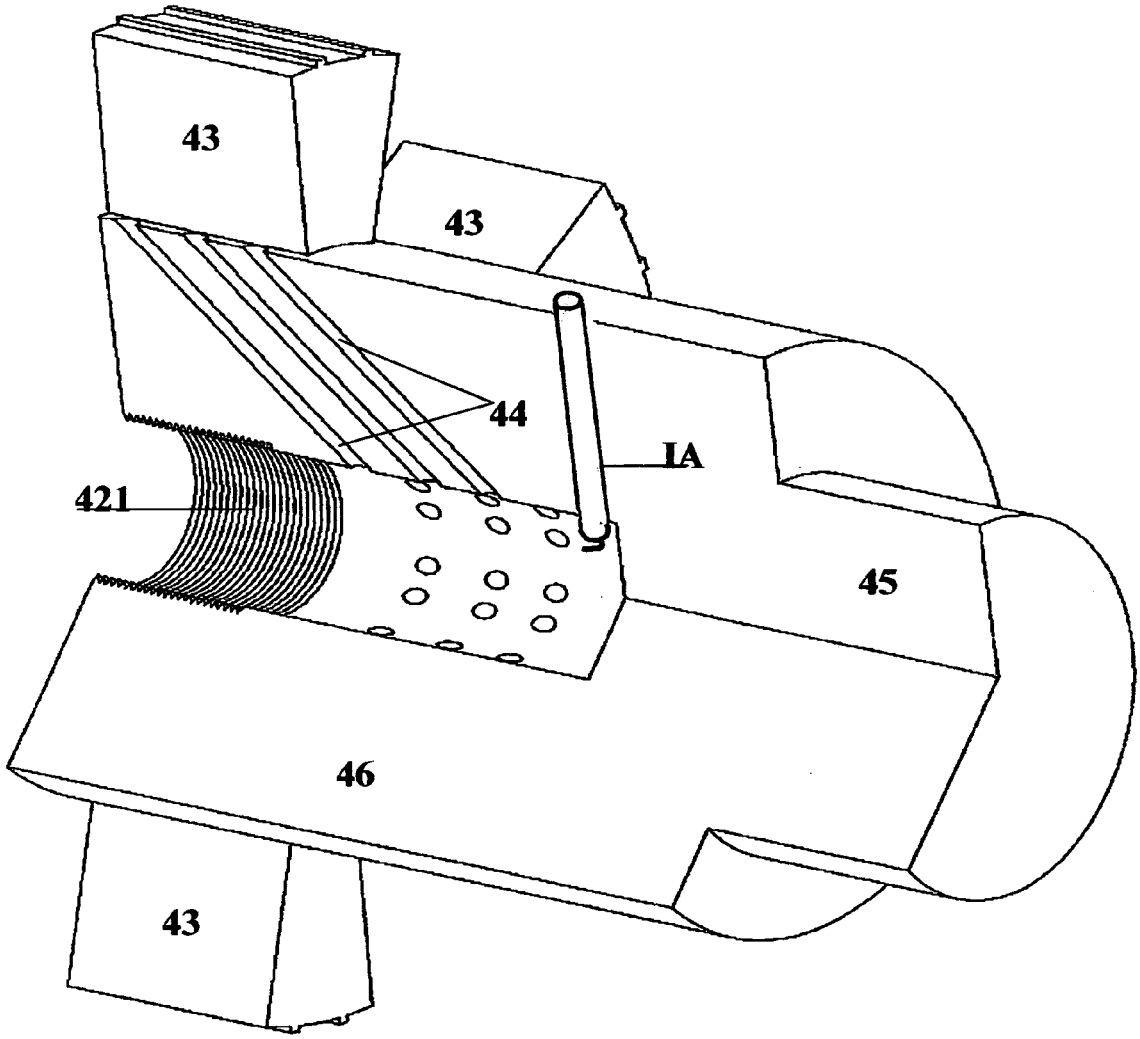

Intermediate rotor 4 (see FIGS. 45, 48) is equipped with the centrally placed main combustion chamber 41, lock 42 stopping said combustion chamber 41 (see FIG. 45), double-acting pistons 43, gas passages 44, and a pin 45 placed eccentrically, relative the cylindrical body 46 of the intermediate rotor. Cylindrical body 46 of intermediate rotor 4 pivots in bearing 221 of part 22 of main rotor 2, while its pin 45 pivots in bearing 31 of auxiliary eccentric 3. There is also a high voltage, high power ignition apparatus IA placed in the intermediate rotor 4 in close proximity to one end of combustion chamber 41. Said ignition apparatus IA is equipped with a contact IAC, which slides over the circular electrical conductor EC (FIG. 45). Combustion chamber 41 is long and narrow to facilitate detonation of the air/fuel mixture; central combustion chamber can be equipped with obstacles generating deflagration-to-detonation transition (not shown). Lock 42 is joined to the intermediate eccentric 4 with the help of thread 421. Placed in the intermediate rotor 4 there are also six gas passages 44 with their openings placed in the working chambers of the engine in closest proximity to their respective intermediate rotor pistons 43, thus providing constant communication between said working chambers and central combustion chamber 41.

Auxiliary eccentric 3 pivots in bearing 131 placed in part 13 of the engine body 1, and is equipped with eccentrically placed bearing 31 supporting pin 45 of intermediate eccentric 4, and auxiliary pin 32 with cam (not shown), which drives pushing rod 134.

Six pairs of the main rotor pistons 212 and intermediate rotor pistons 43 form twelve working chambers C1-C12 of precisely the same construction. This large number of working chambers enables to combine relatively small stroke of engine's pistons with relatively large swept volume, and small stroke considerably contributes to engine's good balance (there is the rule "the smaller stroke the better balance").

Moment of inertia of the main rotor 2 is much larger than that of the two other engine's moving parts (namely intermediate rotor 4 and auxiliary eccentric 3), and said shaft 2 do the work of the flywheel by itself. Means for balancing the engine are the same as those used in engine 3.

It is clear from the description above and accompanying drawings that engine's hot kinetic couples are free from mechanical loads; namely all mechanical loads are transferred by "cold" kinetic couples: bearing 111 and main pin 211; bearing 221 and cylindrical body 46 of intermediate eccentric 4; pin 45 and bearing 31; and bearing 131 and auxiliary eccentric 3.

Thanks to the specific arrangement of the engine no thrust bearings are needed, like in the engine 3.

Here is a short description of engine's work. As engine's main rotor 2 rotates, intermediate rotor 4 oscillates relative main rotor 2, thus causing cyclic change of volume of working chambers C1-C12. Assembly of working chambers C1-C12 naturally divides into two groups of "concordant" working chambers, i.e. these chambers, which volume simultaneously increases and simultaneously decreases; these groups are C1, C3, C5, C7, C9, C11 and C2, C4, C6, C8, C10, C12. As volume of one group of working chambers, say C1, C3, C5, C7, C9, C11, approaches its maximum, intermediate rotor pistons 43 open gas passages 213 placed in main rotor 2, and hot low-pressure gases driven by centrifugal forces flow from said working chambers to circular gas passage 121 and exit engine's body through exhaust port 122. Next intermediate eccentric pistons 43 open air passages 222, fresh air enters mixing chamber MC through inlet port 132 and fuel is being injected into it by injector 131 thus forming the homogeneous charge, and fresh air/fuel mixture, previously prepared in the mixing chamber MC, enters the working chambers C1, C3, C5, C7, C9, C11 through said air passages 222. This is the scavenging.

At the same time homogeneous air/fuel mixture contained in the working chambers C2, C4, C6, C8, C10, C12 is being compressed below its auto-ignition point, and flows through gas passages 44 from said working chambers to main combustion chamber 41. As volume of said working chambers assumes its minimum and pressure of the air/fuel mixture contained in main combustion chamber 41 attains its maximum, ignition apparatus IA is being activated. Electric current flows through the cable, circular conductor EC and reaches ignition apparatus IA through contact IAC, and said ignition apparatus IA causes the homogeneous charge contained in main combustion chamber 41 detonates thus rapidly producing hot, very high-pressure gases. This is the compression/combustion stroke.

Next hot very high-pressure gases contained in main combustion chamber 41 flow through gas passages 44 and enter working chambers C2, C4, C6, C8, C10, C12. As engine's main rotor 2 further rotate, volume of working chambers C2, C4, C6, C8, C10, C12 rises, hot very high-pressure gases contained therein expands, thus producing useful power. This is the power stroke.

As the main rotor 2 further rotates the whole process repeats with roles of the assemblies of working chambers C2, C4, C6, C8, C10, C12 and C1, C3, C5, C7, C9, C11 periodically interchanging.

Thanks to detonation occurring only in main combustion chamber of constant volume placed entirely, inside of one engine's element of very strong structure and detonation wave not affecting engine's pistons nor bearings, and thanks to hot very high-pressure gases produced by detonation being throttled in the gas passages 44, mechanical loads of engine's parts and their gradients are being diminished.

The foregoing description discloses six preferred embodiments of the invention. One skilled in the art will readily recognize from this description and from the accompanying figures and patent claims, that many changes and modifications can be made to the preferred embodiments without departing from the true spirit, scope and nature of the inventive concepts as defined in the following patent claims.

What I claim is:

1. Rotary internal combustion engine comprising:

a mechanism converting thermal energy of combustion gases to rotational motion;

wherein said mechanism converting thermal energy of combustion gases to rotational motion comprises precisely one stationary link, and precisely three moving links;

wherein said stationary link is the engine body;

wherein said three moving links are:

a main rotor;

a secondary rotor;

an intermediate rotor;

wherein said engine body includes two cylindrical cavities placed therein;

wherein the longitudinal axis of symmetry of one of said two cylindrical cavities included in the engine body is parallel to the longitudinal axis of symmetry of the other of said two cylindrical cavities included in the engine body;

wherein the longitudinal axis of symmetry of one of said two cylindrical cavities included in the engine body is displaced relative the longitudinal axis of symmetry of the other of said two cylindrical cavities included in the engine body by a distance $l>0$;

wherein said main rotor assumes the shape of a first circular cylinder with a first circular cavity and a number $n>0$ of fins or pistons placed in said first circular cavity of the main rotor;

wherein said main rotor is mounted rotatably in the first one of said two cylindrical cavities included in the engine body to form with the engine body a rotary kinetic couple;

wherein the axis of rotation of the main rotor relative the engine body coincides with the longitudinal axis of symmetry of the first one of said two cylindrical cavities included in the engine body;

wherein the longitudinal axis of symmetry of said first circular cavity of the main rotor is parallel to the axis of rotation of the main rotor relative the engine body;

wherein said secondary rotor assumes the shape of a second circular cylinder with a second circular cavity placed in said second circular cylinder forming said secondary rotor;

wherein said secondary rotor is mounted rotatably in the other of said two cylindrical cavities included in the engine body to form with the engine body a rotary kinetic couple;

wherein the axis of rotation of the secondary rotor relative the engine body coincides with the longitudinal axis of symmetry of the other of said two cylindrical cavities included in the engine body;

wherein the longitudinal axis of symmetry of said second circular cavity of the secondary rotor is parallel to the axis of rotation of the secondary rotor relative the engine body;

wherein one end of said intermediate rotor is mounted rotatably in the first circular cavity of the main rotor so that the intermediate rotor forms with the main rotor a rotary kinetic couple;

wherein the axis of rotation of said intermediate rotor relative the main rotor coincides with the longitudinal axis of symmetry of said first circular cavity of the main rotor;

wherein the axis of rotation of said intermediate rotor relative the main rotor is displaced relative the axis of rotation of the main rotor relative the engine body by a distance $w>0$;

wherein the other end of said intermediate rotor is mounted rotatably in the second circular cavity of the secondary rotor so that the intermediate rotor and the secondary rotor form another rotary kinetic couple;

wherein the axis of rotation of said intermediate rotor relative the secondary rotor coincides with the longitudinal axis of symmetry of the second circular cavity of the secondary rotor;

wherein the axis of rotation of said intermediate rotor relative the secondary rotor is displaced relative the axis of rotation of the secondary rotor relative the engine body by a distance $d>0$;

wherein the axis of rotation of said intermediate rotor relative the main rotor is displaced relative the axis of rotation of said intermediate rotor relative the secondary rotor by a distance $m>0$;

wherein the number n of fins or pistons are placed on said intermediate rotor;

wherein said intermediate rotor fins or pistons are mounted between said main rotor fins or pistons to form 2n combustion chambers.

2. Rotary internal combustion engine according to claim 1, wherein d>l.

3. Rotary internal combustion engine according to claim 2, wherein w=d.

4. Rotary internal combustion engine according to claim 1, wherein said main rotor includes a flywheel.

5. Rotary internal combustion engine according to claim 1, wherein a counterweight balancing in combination the body force generated by the intermediate rotor and the secondary rotor and the centrifugal force generated by the intermediate rotor and the main rotor is placed on the main rotor.

6. Rotary internal combustion engine according to claim 1, wherein w+l=m+d; and w>d.

7. Rotary internal combustion engine according to claim 6, wherein w=m and l=d.

8. Rotary internal combustion engine according to claim 1, characterized in that it is a Homogeneous Charge Compression Ignition (HCCI) engine.

* * * * *